US011109705B2

(12) United States Patent
Raphael et al.

(10) Patent No.: US 11,109,705 B2
(45) Date of Patent: Sep. 7, 2021

(54) MEDICATION RECEIVER

(71) Applicant: Securum Capsa, Inc., Los Angeles, CA (US)

(72) Inventors: Carlos Raphael, Los Angeles, CA (US); Jason Scott Altman, Los Angeles, CA (US); Elias Yael Marquez Flores, Hawthorne, CA (US)

(73) Assignee: Securum Capsa, Inc., Los Angeles, CA (US)

( * ) Notice: Subject to any disclaimer, the term of this patent is extended or adjusted under 35 U.S.C. 154(b) by 122 days.

(21) Appl. No.: 16/583,240

(22) Filed: Sep. 25, 2019

(65) Prior Publication Data

US 2020/0093309 A1 Mar. 26, 2020

Related U.S. Application Data

(60) Provisional application No. 62/736,655, filed on Sep. 26, 2018.

(51) Int. Cl.
*A47G 29/14* (2006.01)
*A47B 67/02* (2006.01)
(Continued)

(52) U.S. Cl.
CPC ..... *A47G 29/141* (2013.01); *A47B 67/02* (2013.01); *A47B 96/16* (2013.01); *A47G 29/20* (2013.01);
(Continued)

(58) Field of Classification Search
CPC ..... A47G 29/141; A47G 29/16; A47G 29/20; A47G 29/1216; A47G 2029/145;
(Continued)

(56) References Cited

U.S. PATENT DOCUMENTS 1,256,112 A 2/1918 Clawson
1,673,769 A 6/1928 Graham
(Continued)

FOREIGN PATENT DOCUMENTS

CN 206179120 U 5/2017
EP 1396595 B1 3/2004
(Continued)

OTHER PUBLICATIONS

Cottner SmartBox See: http://www.cottnertechnologies.com (last visited on May 11, 2019).
(Continued)

*Primary Examiner* — William L Miller
(74) *Attorney, Agent, or Firm* — Eric Kelly

(57) ABSTRACT

Medication-receivers for safely and securely receiving the temporarily delivery of medications are discussed. Such medication-receivers may be removably attached to exterior doors of structures such as, but not limited to, residences and/or businesses, without damage to such exterior doors, and in a manner that minimizes and/or deters theft of contents of the given medication-receiver. Such medication-receivers may have a cabinet and a downward sliding drawer for receiving the medication. The drawer may be locked to the cabinet. Such medication-receivers may be outfitted with various electronics that may facilitate safe and secure delivery of medication, including locking and unlocking of the drawer, delivery verification, recipient pickup verification, secure access controls, tamper monitoring, and the like.

74 Claims, 35 Drawing Sheets

(51) Int. Cl.
*A47B 96/16* (2006.01)
*A47G 29/20* (2006.01)

(52) U.S. Cl.
CPC .. *A47B 2067/025* (2013.01); *A47G 2029/145* (2013.01); *A47G 2029/149* (2013.01)

(58) Field of Classification Search
CPC ..... A47G 2029/148; A47G 2029/149; A47B 67/02; A47B 2067/025; A47B 96/16; E05B 65/46
USPC ..... 232/17, 19, 38, 45, 39; 312/351, 209, 312/333; 340/5.73, 569, 570; 70/85
See application file for complete search history.

(56) References Cited

U.S. PATENT DOCUMENTS 1,915,980 A 6/1933 Craft
2,098,469 A 3/1936 Smith
2,229,646 A 1/1941 Firestone
2,379,202 A 2/1944 Van Wagner
2,450,337 A * 9/1948 Hearst ..... A47B 67/02 312/323
2,456,479 A 12/1948 Antil
3,250,427 A * 5/1966 Pogue ..... A47G 29/20 220/324
3,644,011 A 2/1972 MacDonald
3,814,220 A 6/1974 Brody
4,035,964 A 7/1977 Robinson
4,066,208 A 1/1978 Jones
4,091,950 A 5/1978 Craven
4,494,690 A 1/1985 Dupuis
4,579,401 A 4/1986 Mears
4,657,249 A 4/1987 Offutt
4,694,668 A 9/1987 Ciletti
4,735,330 A 4/1988 Hoss
4,735,331 A 4/1988 Keenan
4,746,062 A 5/1988 Bartylla
4,844,332 A * 7/1989 Long ..... A47G 29/1209 232/17
4,901,912 A 2/1990 Pinard
4,909,052 A 3/1990 Hutwohl
4,944,422 A 7/1990 Aurness
4,998,424 A 3/1991 Lambert, II
5,150,834 A 9/1992 Bourke
5,161,709 A 11/1992 Oestreich
5,253,763 A 10/1993 Kirkley
D345,847 S 4/1994 Schuchard
5,299,704 A 4/1994 Thorby
5,433,375 A 7/1995 Warrick
5,544,619 A 8/1996 Braun
5,549,073 A 8/1996 Askins
5,624,071 A 4/1997 Sosan
5,845,843 A 12/1998 Kuller
5,961,036 A * 10/1999 Michael ..... G07F 7/069 221/9
6,032,855 A * 3/2000 Douglas ..... A47G 29/1203 232/1 D
6,138,910 A 10/2000 Madruga
6,155,715 A 12/2000 Lake
6,192,834 B1 2/2001 Kolozsvari
6,426,699 B1 7/2002 Porter
6,690,997 B2 2/2004 Rivalto
D487,347 S 3/2004 Felsenthal
6,719,195 B2 4/2004 Farentinos
7,004,344 B2 2/2006 Fulton
7,090,622 B2 8/2006 Hetrick
7,243,674 B2 7/2007 Devine
7,337,944 B2 3/2008 Devar
7,526,934 B2 5/2009 Conforti
7,657,466 B2 2/2010 Klingenberg
7,815,112 B2 10/2010 Volpe
7,891,034 B2 2/2011 Smith
7,988,035 B2 8/2011 Cox
D644,814 S 9/2011 Clarke
8,222,993 B2 7/2012 Bliding
8,334,765 B2 12/2012 Weinstein
8,413,831 B2 4/2013 Nolan
D707,472 S 6/2014 Wehner
D707,473 S 6/2014 Wehner
8,783,461 B2 7/2014 Hill
8,840,075 B2 9/2014 Dalebout
9,007,171 B2 4/2015 Yang
9,106,271 B2 8/2015 Metivier
9,211,025 B1 12/2015 Elhawwashy
9,364,112 B2 6/2016 Sundaresan
9,469,476 B1 10/2016 Ashoori
9,514,585 B2 12/2016 Ahearn
9,530,262 B2 12/2016 Johnson
9,530,295 B2 12/2016 Johnson
9,596,952 B2 3/2017 Mencel
9,619,955 B2 4/2017 Eichenblatt
9,624,695 B1 4/2017 Cheng
9,665,846 B2 5/2017 Gillen
9,679,429 B2 6/2017 Duncan
9,685,015 B2 6/2017 Johnson
9,685,018 B2 6/2017 Johnson
9,691,198 B2 6/2017 Cheng
9,741,186 B1 8/2017 Lemke
9,842,446 B2 12/2017 Vecchiotti
9,852,561 B2 12/2017 Dumas
9,861,221 B2 1/2018 Jiang
9,926,108 B2 3/2018 Wiley
9,965,934 B2 5/2018 Siminoff
10,083,561 B2 9/2018 Sundaresan
10,143,321 B2 12/2018 Hippert
10,299,617 B1 5/2019 Castellanos
10,321,780 B1 * 6/2019 James ..... A47G 29/16
10,362,889 B2 7/2019 Dehner
10,383,471 B1 * 8/2019 Barnes ..... A47G 29/16
2001/0040422 A1 11/2001 Gramlich
2002/0147919 A1 10/2002 Gentry
2002/0162883 A1 11/2002 Arvonio
2002/0178074 A1 11/2002 Bloom
2003/0006275 A1 1/2003 Gray
2004/0181570 A1 9/2004 Kaneko
2004/0256449 A1 12/2004 Stagnaro
2008/0004995 A1 1/2008 Klingenberg
2008/0236765 A1 10/2008 Sager
2009/0050072 A1 2/2009 Moser
2011/0284707 A1 11/2011 Adams
2012/0024942 A1 * 2/2012 Skouboe ..... A47G 29/124 232/24
2012/0269461 A1 10/2012 Proctor
2013/0056998 A1 3/2013 Chincarini
2013/0284800 A1 10/2013 Gillen
2014/0190081 A1 7/2014 Wanjohi
2014/0258168 A1 9/2014 Crawford
2015/0120015 A1 4/2015 Fadell
2015/0186840 A1 7/2015 Torres
2016/0033966 A1 2/2016 Farris
2016/0051073 A1 2/2016 Heinz
2016/0068306 A1 3/2016 Heinz
2016/0309939 A1 10/2016 Mencel
2016/0331171 A1 11/2016 Jiang
2016/0374494 A1 12/2016 Geng
2017/0127868 A1 5/2017 Adewuyi
2017/0188737 A1 7/2017 Hippert
2017/0286905 A1 * 10/2017 Richardson ..... G06Q 10/0832
2017/0295980 A1 * 10/2017 Willcox ..... A47G 29/141
2018/0070753 A1 3/2018 Eveloff
2018/0082554 A1 3/2018 Siminoff
2018/0114420 A1 4/2018 Siminoff
2018/0114421 A1 4/2018 Siminoff
2018/0174413 A1 6/2018 Siminoff
2018/0228310 A1 8/2018 Enobakhare
2018/0233010 A1 8/2018 Modestine
2018/0261060 A1 9/2018 Siminoff

(56) References Cited

U.S. PATENT DOCUMENTS

| | | | |
|---|---|---|---|
| 2018/0268674 | A1 | 9/2018 | Siminoff |
| 2019/0000255 | A1 | 1/2019 | Dehner |

FOREIGN PATENT DOCUMENTS

| | | | |
|---|---|---|---|
| EP | 2835078 | B1 | 2/2015 |
| WO | WO2001008078 | A1 | 2/2001 |
| WO | WO2015100390 | A1 | 7/2015 |
| WO | WO2016109838 | A1 | 7/2016 |

OTHER PUBLICATIONS

Porch Pod See: https://www.theporchpod.com (last visited on Feb. 4, 2019).
EDor See: https://www.edordelivery.com/ (last visited on May 11, 2019).
Parcelhome.com See https://www.parcelhome.com (last visited on May 11, 2019).
DynoSafe See: http://dynosafe.com/ (last visited on May 14, 2019).
Landport See https://www.thelandport.com (last visited on May 14, 2019).
ElephantTrunk See: https://www.amazon.com/Architectural-Mailboxes-6950B-elephantrunk-Locking/dp/B0796K9692/ref=sr_1_3?keywords=elephant+trunk+mailbox&qid=1557877877&s=gateway&sr=8-3 (last visited on May 14, 2019).
BrizeBox See: www.brizebox.com (last visited on May 11, 2019).
BoxLock See: https://www.getboxlock.com (last visited on May 14, 2019).
Dropsak See: http://www.dropsak.com (last visited on May 11, 2019).
Package Guardian See: https://www.amazon.com/Package-Guardian-Anti-Theft-Home-Deliveries/dp/B076VVW4JR/ref=sr_1_2?keywords=package+guardian&qid=1557878448&s=gateway&sr=8-2 (last visited on May 14, 2019).
Package Panther See: https://www.amazon.com/PACKAGE-PANTHER-Protection-FULLY-LINED-Instruction/dp/B075PXWNQL/ref=sr_1_1?keywords=package+panther&qid=1557878496&s=gateway&sr=8-1 (last visited on May 14, 2019).
The Original Porch Pirate Bag See: https://www.amazon.com/Original-Porch-Pirate-Bag-SHIPPING/dp/B01MF9W2I1/ref=pd_sbs_60_12?_encoding=UTF8&pd_rd_i=B01MF9W2I1&pd_rd_r=R42EH1F81NWYKZFC3RVK&pd_rd_w=XVjSo&pd_rd_wg=LLUIM&psc=1&refRID=R42EH1F81NWYKZFC3RVK (last visited on Dec. 29, 2017).
Collapsible crate See: https://www.officedepot.com/a/products/612392/Storex-Collapsible-File-Storage-Crate-14/ (last visited on May 11, 2019).
Folding cart See: https://www.officedepot.com/a/products/987304/Office-Depot-Brand-Mobile-Folding-Cart/ (last visited on May 11, 2019).
Folding cart See: https://www.officedepot.com/a/products/142842/Fusion-Cargo-Cart-41-H-x/ (last visited on May 11, 2019).
Amazon Locker See: https://www.amazon.com/b?ie=UTF8&node=6442600011 (last visited on May 14, 2019).
Package Guard See: https://www.amazon.com/Package-Guard-Sensor-Guaranteed-Protection/dp/B077915FYH/ref=pd_sbs_236_6?_encoding=UTF8&pd_rd_i=B077915FYH&pd_rd_r=8ARE7JGTSYRDEV37BA4N&pd_rd_w=zu6Ej&pd_rd_wg=zkN7h&psc=1&refRID=8ARE7JGTSYRDEV37BA4N (last visited on Dec. 29, 2017).
RTS Parcel Dropbox See: https://www.hayneedle.com/product/rtshomeaccentsparcelwirxdropbox.cfm?source=pla&kwid=Mailboxes%20newskus&tid=RTS105-1&adtype=pla&kw=&lsft=adtype: pla&gclid=EAlalQobChMl6fjNtoCp2AlVlshkCh1C3QKiEAQYFSABEgL9OPD_BwE (last visited on Dec. 29, 2017).
Mail Boss Locking Security Drop Box See: https://www.officedepot.com/a/products/691082/Mail-Boss-Locking-Security-Drop-Box/?cm_mmc=PLA-_-Google-_-Mailing_Packing_Shipping-_-691082-VQ6-51194742236-VQ16-c-VQ17-pla-VQ18-online-VQ19-691082-VQ20-101647056356-VQ21—VQ22-624117016-VQ27-10575817556&mrkgcl=1104&mrkgadid=3115174695&rkg_id=h-10bf4f1e8739a8f00825dbc73e6637e3_t-15143 Last visited Dec. 29, 2017.
QualArc Selma Locking Mail and Parcel Box See: http://www.bellacor.com/productdetail/qualarc-wf-pb018-selma-locking-mail-and-parcel-box-black-with-stainless-steel-1825962.htm?partid=googlePLA-DataFeed-Mailboxes-1825962&kpid=1825962&k_id=735p873338&utm_source=google&utm_medium=cpc&utm_campaign=shopping%20_%20decor&utm_term=&utm_content=outdoor%20_%20mailboxes&kclickid=6a3897bf—Last visited Dec. 29, 2017.
Amazon Key See: http://www.amazon.com/key (last visited on May 14, 2019).
Ring (various products and services) See: https://ring.com/ (last visited on May 14, 2019).

* cited by examiner

MEDICATION RECEIVER

PRIORITY NOTICE

The present application claims priority under 35 U.S.C. § 119(e) to U.S. Provisional Patent Application Ser. No. 62/736,655 filed on Sep. 26, 2018, the disclosure of which is incorporated herein by reference in its entirety.

TECHNICAL FIELD OF THE INVENTION

The present invention relates to cabinets with at least one drawer that are configured to be removably mounted and fixedly secured to a closed door wherein the cabinets may be further configured to securely temporarily receive goods, such as, but not limited to, medication.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Presently (circa 2018) there is a need for various medications (and the like) to be delivered to intended recipients (e.g., patients) and/or their caregivers at their residences and/or places of business. However, for various reasons it may be not possible and/or not practical for the intended recipient nor the caregiver to physically receive such delivered medication in person. Instead, there is a need for a secure enclosure device that could receive the delivered medication from the delivery person (or from the delivery robot), to temporarily hold (store) the delivered medication until the intended recipient or caregiver may access this secure enclosure device. There is a need that medication delivery could be verified in an automated manner and where such automated delivery verification could be communicated to the intended recipient and/or caregiver. Similarly, there is a need that pickup verification of the delivered medication by the intended recipient and/or caregiver could be automated and transmitted to interested parties (e.g., medical practitioner, medical insurer, and the like). There is a need that such a secure enclosure device would be conveniently located at the given residence and/or place of business, such as, proximate to an exterior entry door. There is a need that such a secure enclosure device would have controlled access, such that only the intended delivery person (or delivery robot) and the intended recipient or caregiver may access (open) the secure enclosure device. There is a need that such a secure enclosure device would not be easy to steal. There is a need that such a secure enclosure device would be placed at the residence and/or place of business in a location that is ergonomic and/or efficient for access by the delivery person (or delivery robot), the intended recipient or caregiver.

There is a need in the art for such a secure enclosure device.

It is to these ends that the present invention has been developed.

BRIEF SUMMARY OF THE INVENTION

To minimize the limitations in the prior art, and to minimize other limitations that will be apparent upon reading and understanding the present specification, embodiments of the present invention describes medication-receivers for safely and securely receiving the temporarily delivery of medications. In some embodiments, such medication-receivers may be removably attached to exterior doors of structures such as, but not limited to, residences and/or businesses, without damage to such exterior doors, and in a manner that may minimize and/or deter theft. In some embodiments, such medication-receivers may be outfitted with various electronics that may facilitate safe and secure delivery of medication, including delivery verification, recipient pickup verification, secure access controls, tamper monitoring, and the like.

In some embodiments, structurally, a given medication-receiver may comprise two main elements, a cabinet with controlled slide out drawer for the temporary receiving of the medication and door-attachment-hardware for the removable attachment to the exterior door.

It is an objective of the present invention to provide enclosures for the temporary receiving of delivered medication, wherein such enclosures may be termed, medication-receivers.

It is another objective of the present invention to provide a medication-receiver that is capable of being removably attached to an exterior of a door.

It is another objective of the present invention to provide a medication-receiver that is capable of being removably attached to an exterior of a door, wherein such attachment may be without damage to the exterior door.

It is another objective of the present invention to provide a medication-receiver that is capable of being removably attached to an exterior of a door, wherein such attachment may be in a manner that minimizes theft and/or undesirable tampering with the given medication-receiver.

It is another objective of the present invention to provide a medication-receiver with controlled access such that only an intended delivery person of the medication and/or an intended recipient or caregiver of the medication may access contents of the given medication-receiver.

It is another objective of the present invention to provide a medication-receiver with various electronics.

It is another objective of the present invention to provide a medication-receiver with various electronics that transform the medication-receiver from dumb to smart.

It is another objective of the present invention to provide a medication-receiver with various electronics that may facilitate safe and secure delivery of medication, including delivery verification, recipient pickup verification, secure access controls, tamper monitoring, and the like.

It is another objective of the present invention to provide a medication-receiver that removably attaches to an upper quadrant of the exterior door that is closer to a hinge-side of that exterior door than to a not-hinge-side of that exterior door.

It is another objective of the present invention to provide a medication-receiver that becomes securely and fixedly attached to the exterior door when the exterior door is closed.

It is yet another objective of the present invention to provide a medication-receiver that comprises a drawer for receiving the medication, wherein the drawer slides open in an outwards and downwards manner.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 10B and FIG. 10C may be opposing views with respect to each other.

FIG. 10D and FIG. 10E may be opposing views with respect to each other.

FIG. 10F and FIG. 10G may be opposing views with respect to each other.

REFERENCE NUMERAL SCHEDULE

Figure 1A:
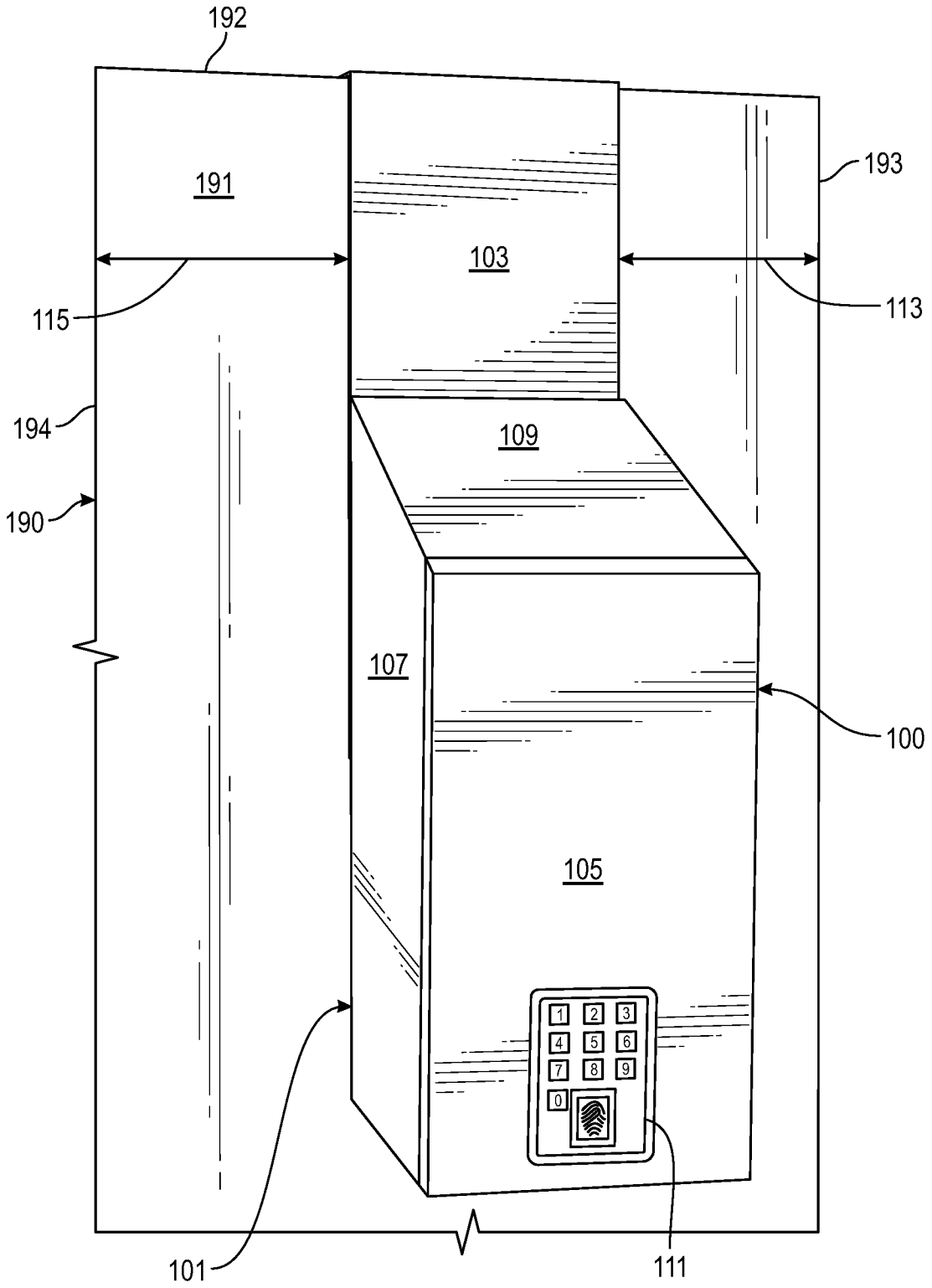
FIG. 1A may depict a front top perspective view of a medication-receiver mounted to a door.

100 medication-receiver 100
101 cabinet 101
103 door-attachment-hardware 103
105 front-of-drawer 105
107 side-of-cabinet 107
109 top-of-cabinet 109
110 bottom-of-cabinet 110
111 exterior-interface 111

113 distance-from-hinge-side 113
115 distance-from-not-hinge-side 115
190 door 190
191 exterior-door-surface 191
192 top-of-door 192
193 hinge-side 193
194 not-hinge-side 194
195 bottom-of-door 195
201 drawer 201
203 top-of-drawer 203
205 interior-side-wall 205
207 bottom-of-drawer 207
208 opening-to-drawer 208
209 exterior-side-wall 209
211 rail 211
401 fingerprint-scanner 401
403 keypad 403
405 first-I/O-means 405
407 second-I/O-means 407
501 J-hook-region 501
503 back-side 503
505 cushion 505
507 back-side-of-cabinet 507
603 door-attachment-hardware 603
605 top-bracket 605
607 side-bracket 607
609 rail-system 609
703 back-side 703
707 lower-side-bracket 707
709 side-bracket-guide 709
801 processor 801
803 memory 803
805 I/O for External Communications 805
807 I/O Means 807
807*a* light 807*a*
809 Power Supply 809
811 GPS 811
901 first-user-computing-device 901
903 second-user-computing-device 903
905 Server 905
907 Admin-Device 907
909 Internet/WAN/LAN 909
1000 medication-receiver 1000
1001 cabinet 1001
1003 door-attachment-hardware 1003
1005 main-planar-member 1005
1007 top-bracket 1007
1009 top-tab 1009
1011 first-side-bracket 1011
1013 first-side-tab 1013
1015 second-side-bracket 1015
1017 second-side-tab 1017
1019 rail 1019
1021 stop 1021
1020 slot-for-rail 1020
1101 rear-wall 1101
1103 reinforcement-member 1103
1121 complimentary-stop 1121
1201 PCB (circuit board) 1201
1205 housing (enclosure) 1205
1207 lower-compartment 1207
1209 power supply 1209
1211 drawer-member 1211
1213 upper-rail-assembly 1213
1215 lower-rail assembly 1215
1217 lock-assembly 1217
1219 wiring 1219
1311 rear-of-drawer-member 1311
1319 complimentary-wiring 1319
1320 electrical-connector 1320
1411 drawer-side-wall 1411
1413 drawer-floor 1413
1414 drawer-roof 1414
1415 drawer-inside-front 1415
1431 direction-of-sliding 1431
1433 angle 1433
1311 drawer-rear-wall 1311
1417 lock-receiver 1417
1419 depth-of-drawer 1419
1420 complimentary-connector 1420
1421 depth-of-drawer 1421
1431 direction-of-sliding 1431
1433 angle 1433
1513 distance-from-door-bottom 1513
1601 door-plate 1601
1613 distance-from-door-top 1613
1619 rail 1619
1621 stop 1621
1701 solar-panel 1701
1801 bottom-of-top-bracket 1801
1803 slot-for-rail 1803
1805 rail 1805
1807 top-of-planar-member 1807
1811 hole 1811

DETAILED DESCRIPTION OF THE INVENTION

Note, naming terminology employed herein with respect to terms/structures/parts/components/items with (or without) reference numerals are intended in impart functional and/or structural qualities of that given item. Additionally, such terms/structures/parts/components/items may be used with or without dashes/hyphens between the words. For example, "first-side-bracket" and "first side bracket" are interchangeable.

Various medication-receivers are disclosed and described herein. These medication-receivers may be for the temporary storage and/or housing of various received goods, articles, and/or products delivered to a given residence, business, door, building, home, gate, fence, wall, and/or the like. A given medication-receiver may be in the form of door (wall) mountable (attachable) cabinet, with downward sliding drawer, that securely locks when the downward sliding drawer is closed in the cabinet. In some embodiments, the received goods, articles, and/or products may be selected from one or more of: medication; medicine; medicated products; prescribed medication; over-the-counter (OTC) medication; custom compounded medication; medication in clinical trial; pharmaceuticals; biologics; insulin; nonsteroidal anti-inflammatory drugs (NSAIDs); pain killers; steroids; CBD (cannabidiol) containing products; cannabis containing products; THC (tetrahydrocannabinol) containing products; pills; tablets; patches (e.g., transdermal); vitamins; supplements; medical device; EpiPen; epinephrine auto-injector; auto-injector; documents; paper; boxes; bottles; syringes; syringe needles; dropper bottles; specimens; jars; blood sugar monitor; beakers; glasses; eye glasses; contact lenses; saline; medical waste; keys; acupuncture needles; wipes; swabs; smartphone; e-cigarette; e-cigarette refill; e-cigarette cartridge; vape pen; vape refill; vape cartridge; combinations thereof; and/or the like.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

In some embodiments, medication-receiver 100/1000 may comprise cabinet 101/1001 and door-attachment-hardware 103/1003/1601. In some embodiments, cabinet 101/1001 may comprise housing (e.g., 1205) and drawer 201/1211 that fits substantially within the housing. In some embodiments, medication-receiver 100/1000 may be for removably receiving at least one article for temporary housing (storing) of the at least one article within drawer 201/1211. Herein, the "drawer" and "drawer-member" may be used interchangeably. In some embodiments, medication-receiver 100/1000 may be configured for attachment to door 190 with hinges (this attachment may be removable in some embodiments). In some embodiments, drawer 201/1211 may have an interior of drawer 201/1211 that may be configured for receiving the at least one article. In some embodiments, cabinet 101/1001 may exist in two operational configurations a locked configuration and an unlocked configuration. In some embodiments, when cabinet 101/1001 may be in the locked configuration, the housing (e.g., 1205) of cabinet 101/1001 and a front-of-drawer 105 may substantially enclose the interior of drawer 201/1211. In some embodiments, when cabinet 101/1001 may in the unlocked configuration, at least a portion of drawer 201/1211 may slidingly extend out from the housing (e.g., 1205) of cabinet 101/1001 providing access to at least a portion of the interior of drawer 201/1211 (and providing access to the at least one article that may within the interior of drawer 201/1211). In some embodiments, at least a portion of door-attachment-hardware 103/1003/1601 may be attached to a rear of the housing, such as rear-wall 1101 (this attachment may be removable in some embodiments). In some embodiments, at least another portion of door-attachment-hardware 103/1003/1601 may be attached to door 190 (this attachment may be removable in some embodiments).

FIG. 1A may depict a front top perspective view of a medication-receiver 100 mounted to a door 190. In some embodiments, door 190 may be an access door to a structure (such as, but not limited to, a building). In some embodiments, door 190 may be an exterior door to the structure (e.g., building). In some embodiments, door 190 may be mounted (hung) in a door-frame. In some embodiments, door 190 and/or its door-frame may be sized to permit movement of humans through the door-frame. In some embodiments, door 190 may be of a fixed and predetermined size. In some embodiments, door 190 may be a gate in a wall and/or a gate in a fence. In some embodiments, door 190 may be substantially planar member. In some embodiments, door 190 may be a substantially rectangular prism member. In some embodiments, door 190 may be rigid to substantially rigid. In some embodiments, door 190 may be a structural member. In some embodiments, door 190 may be longer than wide. In some embodiments, door 190 may have a hinge-side 193 with one or more hinges attached to hinge-side 193. In some embodiments, door 190 may pivot/swing about an axis running through its hinges on hinge-side 193. In some embodiments, door 190 may have a not-hinge-side 194 that may be opposed from hinge-side 193, wherein not-hinge-side 194 may be free of hinges. In some embodiments, not-hinge-side 194 has no hinges. A door handle and/or door knob may be located closer to not-hinge-side 194 than to hinge-side 193. In some embodiments, hinge-side 193 and not-hinge-side 194 may be substantially parallel with each other. In some embodiments, door 190 in its operational configuration may be substantially vertically oriented with respect to a ground/floor. In some embodiments, hinge-side 193 and not-hinge-side 194 may be substantially vertically oriented with respect to the ground/floor. In some embodiments, door 190 may have a top designated top-of-door 192. In some embodiments, door 190 may have a bottom designated bottom-of-door 195. See figures FIG. 15B, FIG. 15C, FIG. 16B, and FIG. 16C for bottom-of-door 195. In some embodiments, top-of-door 192 and bottom-of-door 195 may be substantially parallel with each other. In some embodiments, top-of-door 192 may be substantially perpendicular with hinge-side 193 and/or not-hinge-side 194. In some embodiments, bottom-of-door 195 may be substantially perpendicular with hinge-side 193 and/or not-hinge-side 194. In some embodiments, top-of-door 192, hinge-side 193, not-hinge-side 194, and bottom-of-door 195 may define an outside peripheral boundary of door 190. See also figures FIG. 15B, FIG. 15C, FIG. 16B, and FIG. 16C for door 190.

Continuing discussing FIG. 1A, in some embodiments, medication-receiver 100 may be removably mounted to door 190. In some embodiments, medication-receiver 100 may be removably hung from door 190. In some embodiments, medication-receiver 100 may be positioned on an exterior-door-surface 191 of door 190. In some embodiments, medication-receiver 100 may be mounted closer to a hinge-side 193 of door 190 than to not-hinge-side 194 of door 190, as doing so may minimize interfering with natural door 190 swing/pivot mechanics along its hinges and with respect to the door's door-frame. In some embodiments, a distance-from-hinge-side 113 may be less than a distance-from-not-hinge-side 115, wherein these distances are from medication-receiver 100 to the door's given vertical edge, respectively. In some embodiments, medication-receiver 100 may be positioned in an upper vertical half of door 190 and closer to hinge-side 193 than to not-hinge-side 194.

Continuing discussing FIG. 1A, in some embodiments, medication-receiver 100 may comprise two main structures, cabinet 101 and door-attachment-hardware 103. In some embodiments, cabinet 101 may comprise a drawer 201 (see e.g., FIG. 2A), a front-of-drawer 105, two sides-of-cabinet 107, and a top-of-cabinet 109. In some embodiments, front-of-drawer 105 may also be a front of cabinet 101. In some embodiments, each of the two sides-of-cabinet 107 may be disposed opposite of each other. In some embodiments, each sides-of-cabinet 107 may be separated from each by about a width of top-of-cabinet 109 and/or by about a width of front-of-drawer 105. In some embodiments, front-of-drawer 105 and sides-of-cabinet 107 may be substantially vertically oriented when medication-receiver 100 may be properly mounted (attached) to door 190. In some embodiments, major exterior surfaces of front-of-drawer 105 and sides-of-cabinet 107 may be substantially flat and/or planar. In some embodiments, the major exterior surfaces of front-of-drawer 105 and sides-of-cabinet 107 may be substantially parallel with exterior-door-surface 191 when medication-receiver 100 may be properly mounted (attached) to door 190.

Continuing discussing FIG. 1A, in some embodiments, door-attachment-hardware 103 may provide a means for mounting, attaching, and/or hanging medication-receiver 100 to door 190. In some embodiments, such mounting, attaching, and/or hanging to door 190 with door-attachment-hardware 103 may be done without damaging door 190. In some embodiments, such mounting, attaching, and/or hanging to door 190 with door-attachment-hardware 103 may be done in a removable manner. Positioning of medication-receiver 100 on door 190 via door-attachment-hardware 103 may be as discussed above. In some embodiments, at least some portion of door-attachment-hardware 103 may (removably in some embodiments) engage top-of-door 192 and/or hinge-side 193 of door 190. In some embodiments, door-attachment-hardware 103 may comprise one or more mechanical fasteners. In some embodiments, door-attachment-hardware 103 may comprise one or more brackets, J-hooks, hooks, clips, and/or the like. In some embodiments, a portion of door-attachment-hardware 103 that does not engage door 190 may be attached to and/or in communication with at least some portion of cabinet 101. In some embodiments, door-attachment-hardware 103 may be at least a J-hook that may be an elongate planar member that with two bends proximate towards one terminal end sized for hanging over top-of-door 192 of door 190 and with the opposing terminal end attached to a back of cabinet 101.

Continuing discussing FIG. 1A, in some embodiments, cabinet 101 may comprise exterior-interface 111. In some embodiments, exterior-interface 111 may be means by which a user may exteriorly interact with locking or unlocking of drawer 201 from cabinet 101. In some embodiments, exterior-interface 111 may be means by which a user may exteriorly interact with opening or closing of drawer 201 from cabinet 101. In some embodiments, exterior-interface 111 may comprise various input/output (I/O) means. In some embodiments, exterior-interface 111 may be located exteriorly on front-of-drawer 105. In some embodiments, exterior-interface 111 may comprise various access-controls, such as one or more of: a graphical-user-interface, a touchscreen, a keypad, a fingerprint scanner, a button, a lever, a switch, a slide, a dial, a knob, a camera, a RFID/NFC reader, a microphone, a speaker, a light, a buzzer, a port (for communication and/or electrical power transmission), a handle, a pull, and/or the like.

Figure 1B:
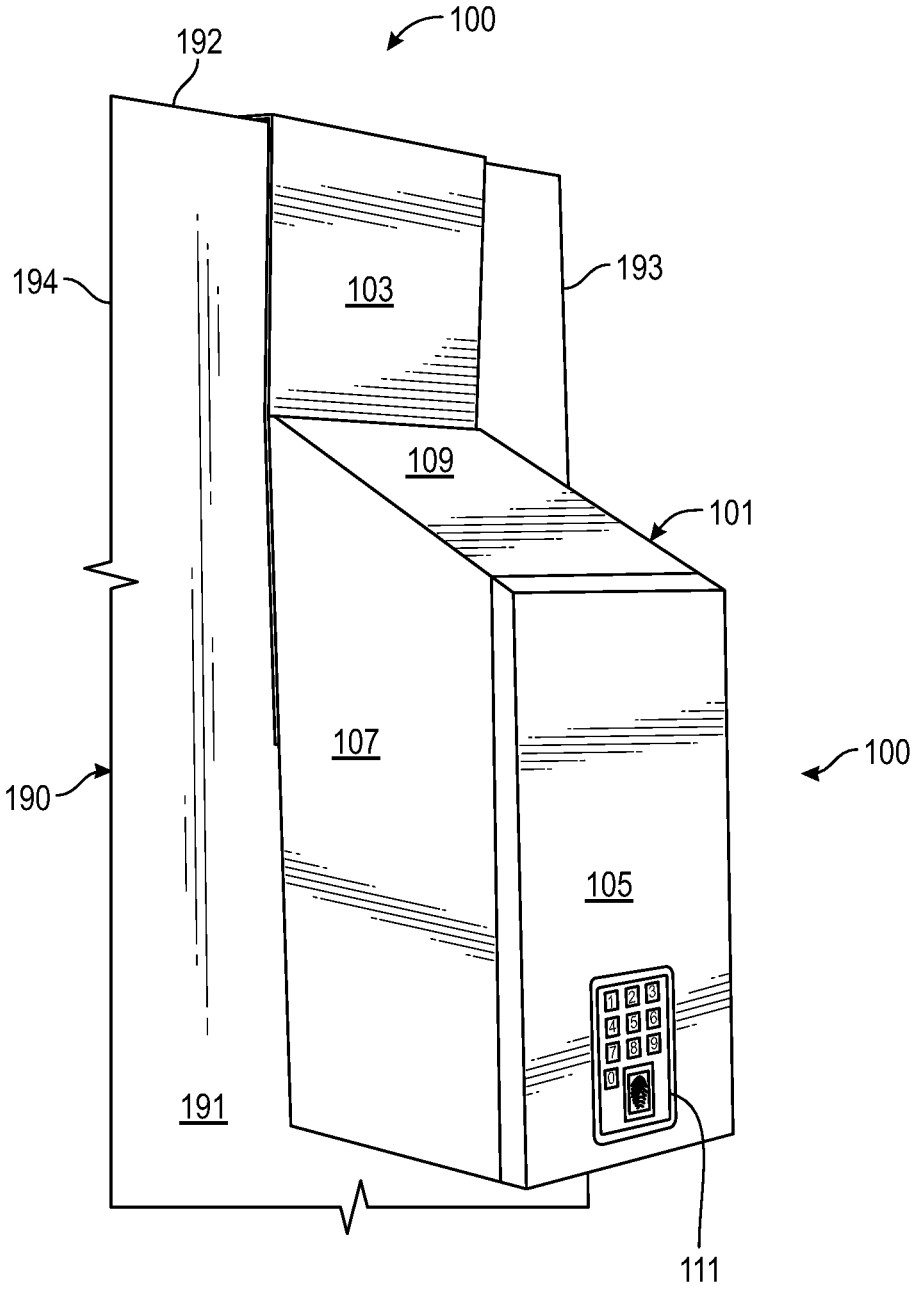
FIG. 1B may depict a front top perspective view of the medication-receiver mounted to the door.

FIG. 1B may depict a front top perspective view of a medication-receiver 100 mounted to door 190. A viewing angle of FIG. 1B may be different as compared to FIG. 1A, such that more of side-of-cabinet 107 may be seen in FIG. 1B.

Figure 1C:
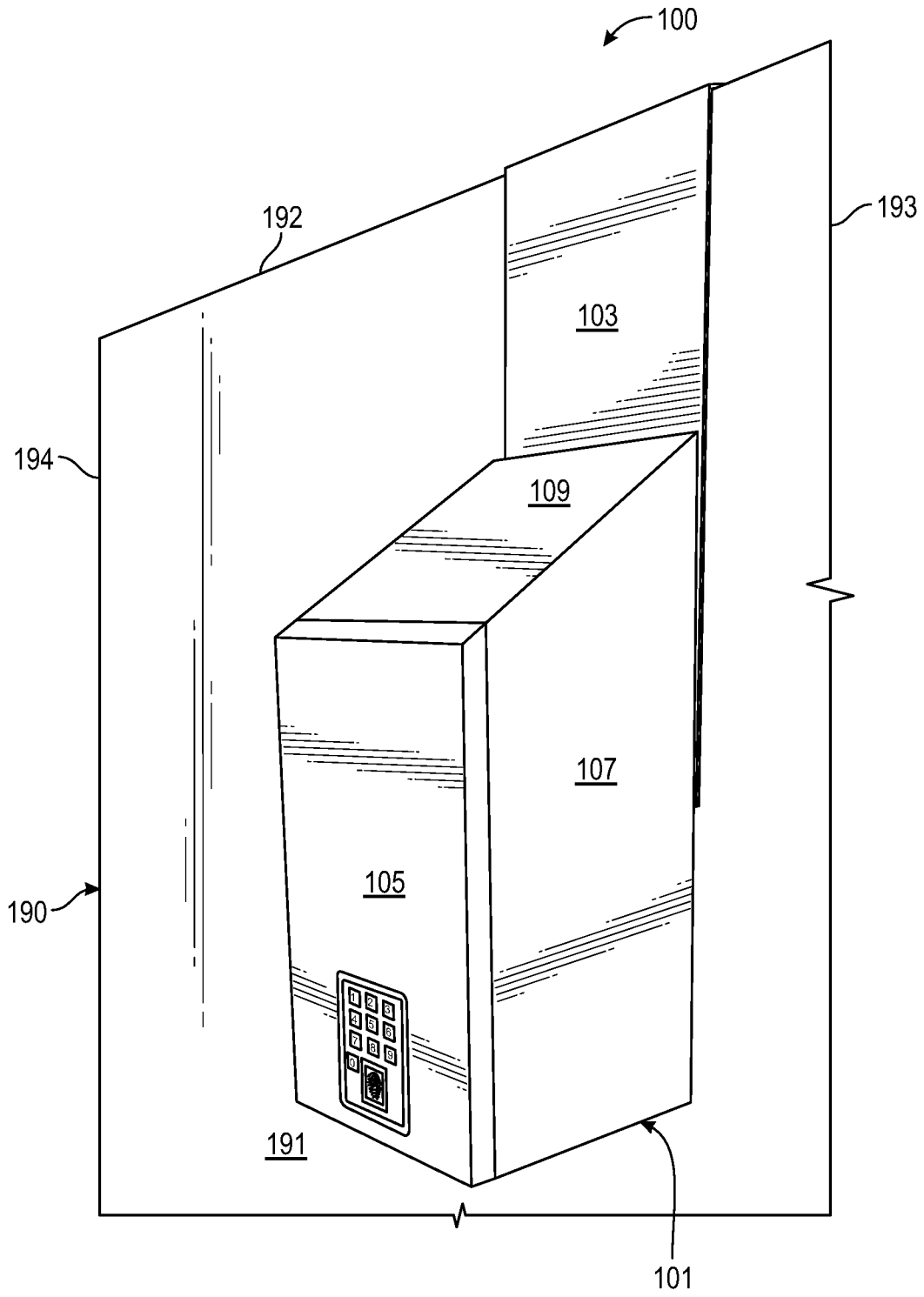
FIG. 1C may depict an opposing front top perspective view of the medication-receiver mounted to the door as compared to FIG. 1B.

FIG. 1C may depict an opposing front top perspective view of a medication-receiver 100 mounted to door 190 as compared to FIG. 1B. An opposing and different side-of-cabinet 107 may be seen in FIG. 1C.

Note, in FIG. 1A, FIG. 1B, and in FIG. 1C, drawer 201 of cabinet 101 may be in a closed and/or locked configuration.

In some embodiments, door-attachment-hardware 103, front-of-drawer 105, sides-of-cabinet 107, and top-of-cabinet 109 may substantially be one or more of: structural members, planar members, flat members, solid members, rigid members, and/or semi-rigid members.

Figure 2A:
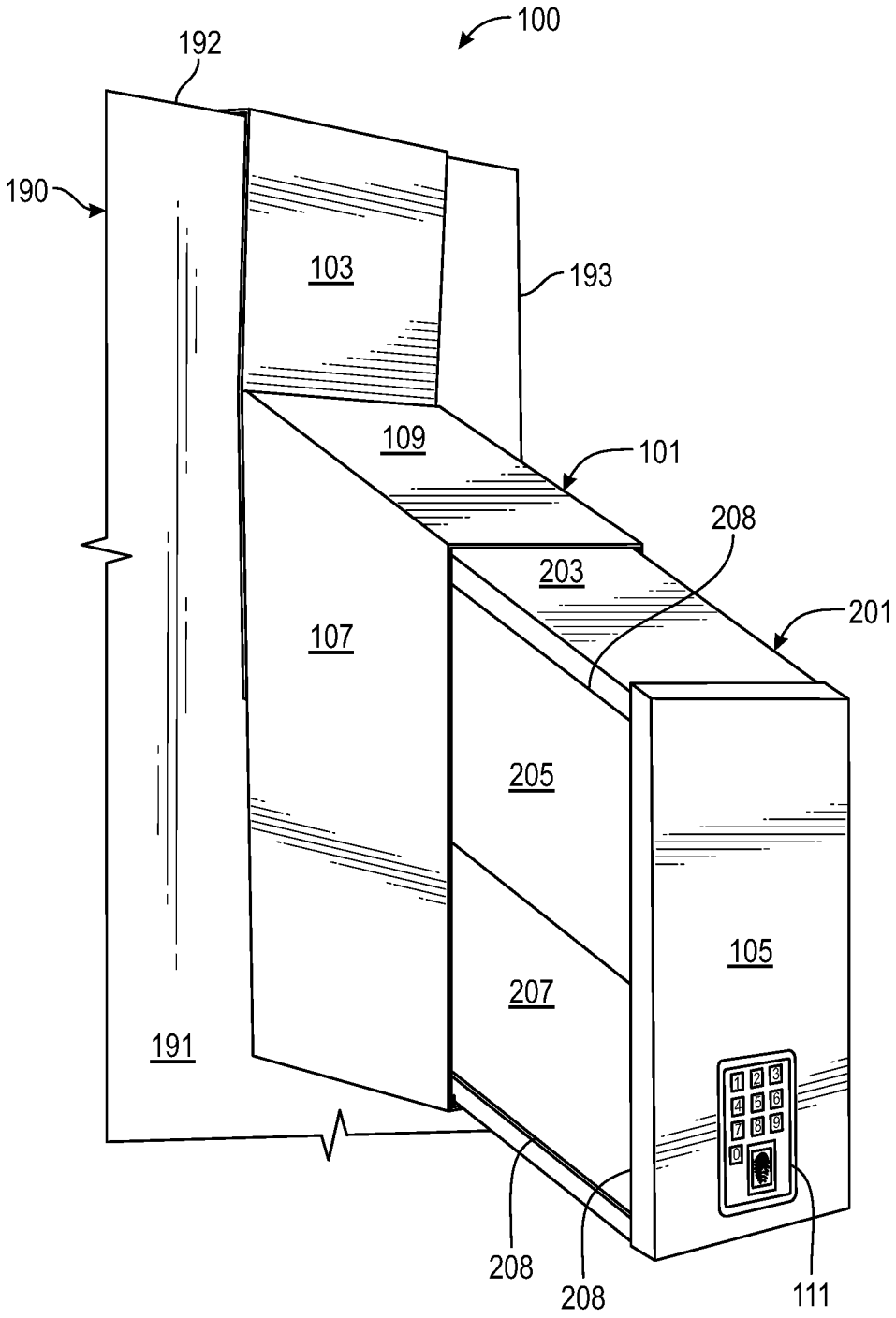
FIG. 2A may depict a front top perspective view of the medication-receiver mounted to the door, with a viewing angle similar to that shown in FIG. 1B, except in FIG. 2A a drawer of the cabinet may be in its open and unlocked configuration.

FIG. 2A may depict a front top perspective view of medication-receiver 100 mounted to door 190, with a viewing angle similar to that shown in FIG. 1B, except in FIG. 2A drawer 201 of cabinet 101 may be in its open and unlocked configuration. In some embodiments, drawer 201 in its closed configuration (see e.g., FIG. 1A, FIG. 1B, and/or FIG. 1C) may be housed at least substantially within a receiving cavity of cabinet 101. In some embodiments, drawer 201 in its open configuration (see e.g., FIG. 2A and/or FIG. 2B), drawer 201 may extend substantially outwards from this receiving cavity of cabinet 101. In some embodiments, drawer 201 may be a slide out drawer. In some embodiments, drawer 201 may be a pull out and push drawer. In some embodiments, drawer 201 may be a slide out drawer that operates under its own power for locking, unlocking, opening (sliding out of cabinet 101), and closing (sliding back into cabinet 101). In some embodiments, opening sliding motion of drawer 201 may be both outwards and downwards with respect to a bottom of medication-receiver 100 (or with respect to a bottom of door 190 or the ground/floor). In some embodiments, opening sliding motion of drawer 201 may be simultaneously outwards horizontally and downwards vertically with respect to a bottom of medication-receiver 100 (or with respect to a bottom of door 190 or the ground/floor). In some embodiments, closing sliding motion of drawer 201 may be in a substantially opposite direction as compared to the opening sliding motion. Note, such opening mechanics may be beneficial as drawer 201 in its open configuration may be lower than a bottom of cabinet 101, which may be desirable for loading and unloading of drawer 201 with goods. In some embodiments, such goods may be medication (e.g., prescribed or otherwise). In some embodiments, the goods may not be limited to medication.

Continuing discussing FIG. 2A, in some embodiments, drawer 201 may comprise front-of-drawer 105, a top-of-drawer 203, an interior-side-wall 205, and a bottom-of-drawer 207. In some embodiments, front-of-drawer 105, top-of-drawer 203, interior-side-wall 205, and bottom-of-drawer 207 may substantially be one or more of: structural members, planar members, flat members, solid members, rigid members, and/or semi-rigid members. In some embodiments, top-of-drawer 203 and bottom-of-drawer 207 may be disposed opposite of each other. In some embodiments, top-of-drawer 203 and bottom-of-drawer 207 may be substantially parallel with each other. In some embodiments, interior-side-wall 205 may connect top-of-drawer 203 to bottom-of-drawer 207. In some embodiments, front-of-drawer 105 may be attached to top-of-drawer 203, interior-side-wall 205, and bottom-of-drawer 207. In some embodiments, top-of-cabinet 109 and top-of-drawer 203 may be substantially parallel with each other. In some embodiments, when drawer 201 may be in its closed configuration, top-of-drawer 203 may be disposed directly beneath and proximate to top-of-cabinet 109. In some embodiments, front-of-drawer 105, top-of-drawer 203, interior-side-wall 205, and bottom-of-drawer 207 may substantially bound a volume for temporarily housing goods, such as, but not limited to medications. In some embodiments, this volume may be unbounded, i.e., open on at least one side, designated, opening-to-drawer 208. In some embodiments, drawer 201 may comprise opening-to-drawer 208. In some embodiments, opening-to-drawer 208 may provide loading and/or unloading access to the interior of drawer 201. In some embodiments, opening-to-drawer 208 may be disposed opposite of interior-side-wall 205. In some embodiments, opening-to-drawer 208 may be located on a side of drawer 201, such as a vertical side of 201. In some embodiments, opening-to-drawer 208 may be framed by top-of-drawer 203, front-of-drawer 105, interior-side-wall 205, and bottom-of-drawer 207. In some embodiments, bottom-of-drawer 207 may support goods placed into drawer 201.

Figure 2B:
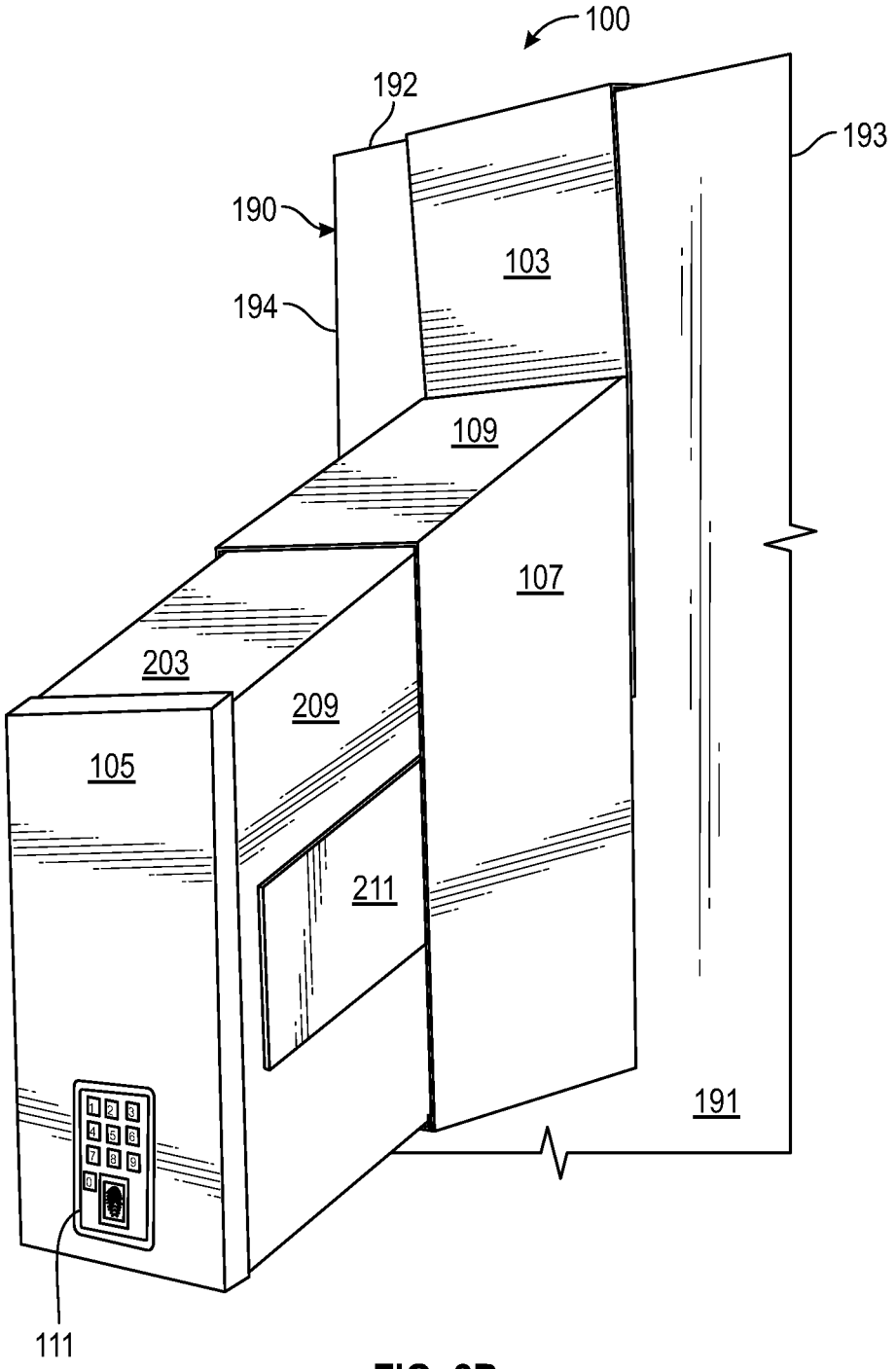
FIG. 2B may depict a front top perspective view of the medication-receiver mounted to the door, with a viewing angle similar to that shown in FIG. 1C, except in FIG. 2B the drawer of the cabinet may be in its open and unlocked configuration.

FIG. 2B may depict a front top perspective view of medication-receiver 100 mounted to door 190, with a viewing angle similar to that shown in FIG. 1C, except in FIG. 2B drawer 201 of cabinet 101 may be in its open and unlocked configuration. FIG. 2B may be an opposing view as compared to FIG. 2A. FIG. 2B may show exterior-side-wall 209 which may be the opposing side to interior-side-wall 205. In some embodiments, interior-side-wall 205 and exterior-side-wall 209 may different sides of the same side-wall of drawer 201. In some embodiments, drawer 201 may comprise exterior-side-wall 209. In some embodiments, disposed opposite of exterior-side-wall 209 may be opening-to-drawer 208. In some embodiments, exterior-side-wall 209 may substantially be one or more of: structural members, planar members, flat members, solid members, rigid members, and/or semi-rigid members. In some embodiments, front-of-drawer 105, top-of-drawer 203, and exterior-side-wall 209 may be attached to each other.

Continuing discussing FIG. 2B, in some embodiments, exterior-side-wall 209 may comprise rail 211. In some embodiments, drawer 201 may comprise rail 211. In some embodiments, rail 211 may be attached to 209. In some embodiments, rail 211 may provide structural support to drawer 201 when drawer 201 may extended (open) from cabinet 101. In some embodiments, rail 211 may facilitate the downwards and outwards translational mechanics of drawer 201 with respect to cabinet 101. In some embodiments, rail 211 may be received and/or engaged within cabinet 101. In some embodiments, rail 211 may be received and/or engaged within cabinet 101 by a complimentary rail structure.

Figure 3:
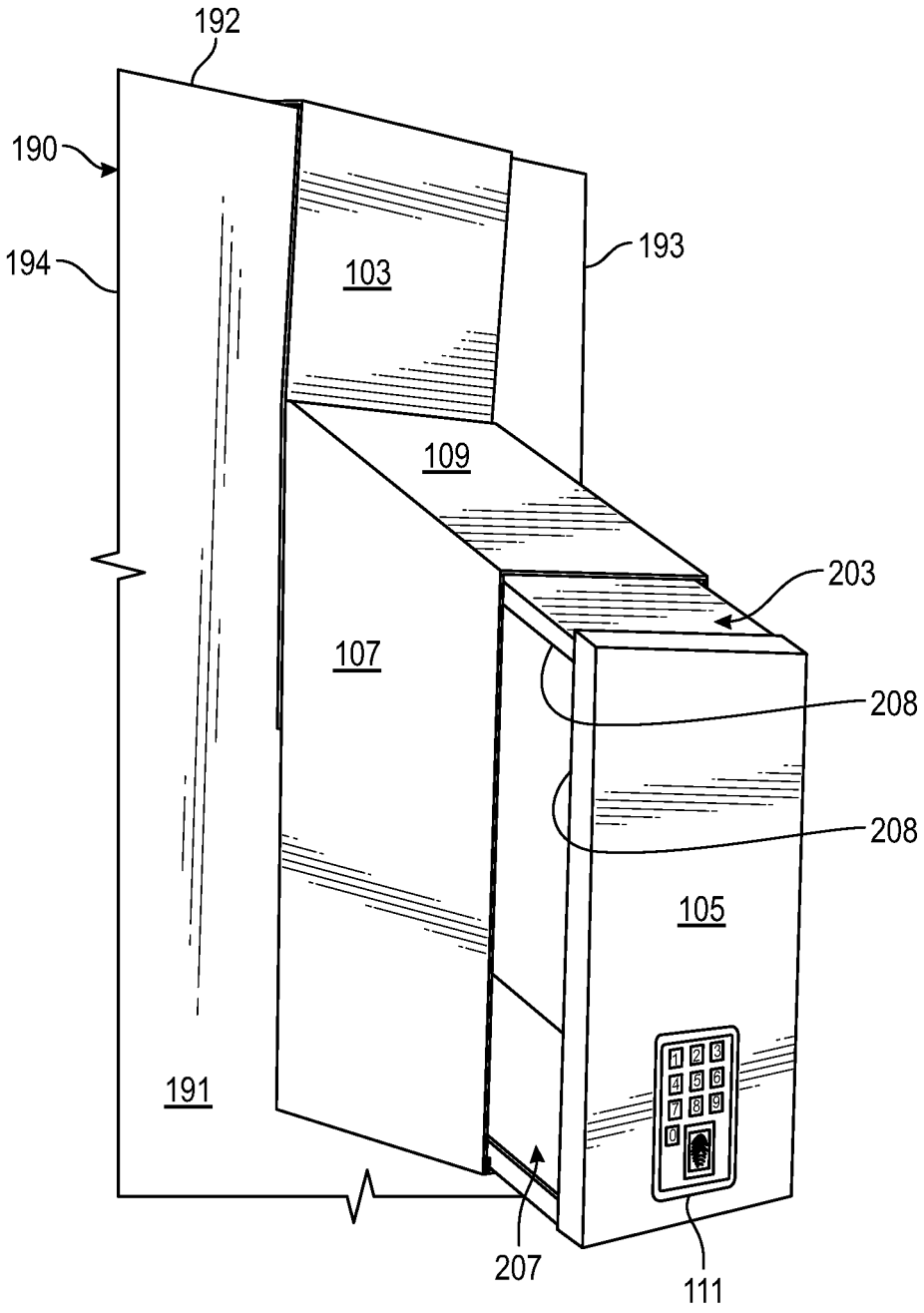
FIG. 3 may depict a top side perspective view of the medication-receiver with the drawer 201 partially extended (partially opened).

FIG. 3 may depict a top side perspective view of medication-receiver 100 with drawer 201 partially extended.

Figure 4:
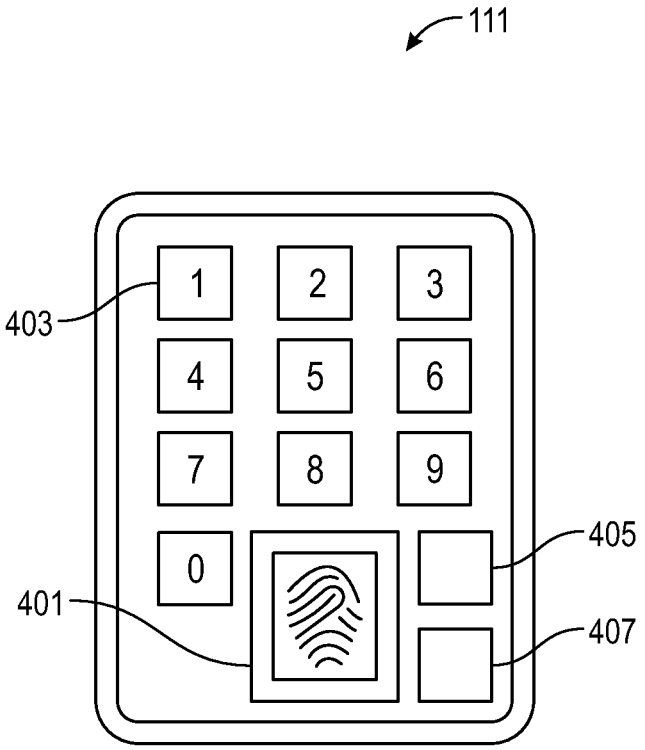
FIG. 4 may depict a close-up front view of an exterior-interface.

FIG. 4 may depict a close-up front view of exterior-interface 111. In some embodiments, exterior-interface 111 may be located on an exterior surface of medication-receiver 100, such as, but not limited to, front-of-drawer 105. In some embodiments, exterior-interface 111 may provide various input/output (I/O) means for a given user to interact with medication-receiver 100. In some embodiments, exterior-interface 111 may be in wired communication with various electronics and/or hardware components of medication-receiver 100. In some embodiments, exterior-interface 111 may comprise fingerprint-scanner 401. In some embodiments, fingerprint-scanner 401 may be configured to scan and/or read a fingerprint. In some embodiments, exterior-interface 111 may comprise keypad 403. In some embodiments, keypad 403 may comprise a plurality of buttons. In some embodiments, the plurality of buttons may have a predetermined quantity of buttons. In some embodiments, keypad 403 may comprise a plurality of buttons wherein each such button is designated a single number from zero to nine. In some embodiments, keypad 403 may comprise a plurality of buttons wherein each such button may be configured to input a number or a letter. In some embodiments, exterior-interface 111 may comprise first-I/O-means 405. In some embodiments, exterior-interface 111 may comprise second-I/O-means 407. In some embodiments, first-I/O-means 405 and/or second-I/O-means 407 may be selected from one or more of: a graphical-user-interface, a touch-screen, a keypad, a fingerprint scanner, a button, a lever, a switch, a slide, a dial, a knob, a camera, a RFID/NFC reader, a microphone, a speaker, a light, a buzzer, a port (for communication and/or electrical power transmission), a handle, a pull, and/or the like.

Figure 5:
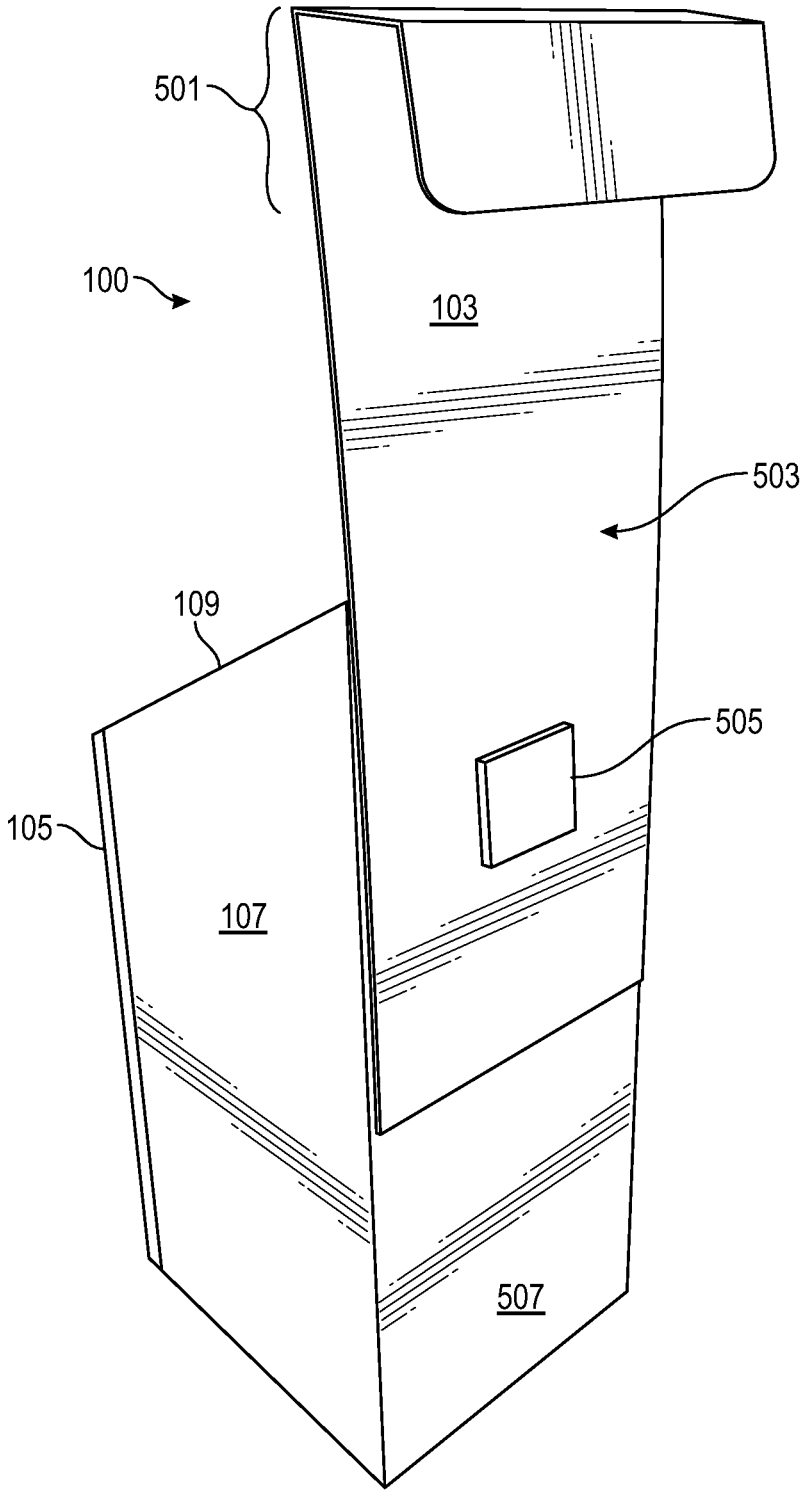
FIG. 5 may depict a perspective back (rear) view of the medication-receiver of FIG. 1.

FIG. 5 may depict a perspective back (rear) view of medication-receiver 100. From such a perspective back (rear) view of medication-receiver 100, a back (rear) side of cabinet 101 may be seen, designated back-side-of-cabinet 507. In some embodiments, cabinet 101 may comprise back-side-of-cabinet 507. In some embodiments, back-side-of-cabinet 507 may substantially be one or more of: a structural member, a planar member, a flat member, a solid member, a rigid member, and/or a semi-rigid member. In some embodiments, back-side-of-cabinet 507 may be disposed opposite of front-of-drawer 105. When medication-receiver 100 may be in proper use, such as mounted to a given door 190, back-side-of-cabinet 507 may be facing (or covering) a portion of exterior-door-surface 191.

Continuing discussing FIG. 5, in some embodiments, a back (rear) portion of door-attachment-hardware 103 may be visible, wherein this this back (rear) portion of door-attachment-hardware 103 may be designated back-side 503. When medication-receiver 100 may be in proper use, such as mounted to a given door 190, back-side 503 (or a majority portion thereof) may be facing (or covering) a portion of exterior-door-surface 191. In some embodiments, door-attachment-hardware 103 may be attached to back-side-of-cabinet 507. In some embodiments, back-side-of-cabinet 507 and back-side 503 may be a same single article of manufacture. In some embodiments, attached to one or more exterior portions of back-side 503 and/or back-side-of-cabinet 507 may be one or more cushions 505. In some embodiments, cushions 505 may act to protect exterior-door-surface 191 of door 190 from being scratched, dented, and/or banged on from back-side 503 and/or back-side-of-cabinet 507. In some embodiments, cushions 505 may act as bumpers. In some embodiments, exterior portions of cushions 505 may be substantially covered with one or more of a foam, an elastomer, a silicone, a rubber, a soft fabric, a soft thermoplastic, and/or the like.

Continuing discussing FIG. 5, in some embodiments, a top (upper) portion of door-attachment-hardware 103 may comprise J-hook-region 501. In some embodiments, J-hook-region 501 may be configured to removably engage of top-of-door 192 door 190. In some embodiments, J-hook-region 501 may be bracket that may hang on top-of-door 192. In some embodiments, J-hook-region 501 may be thin enough to minimally impact any weather stripping at a top of a doorway/doorjamb that may receive top-of-door 192 door 190. In some embodiments, the portion of door-attachment-hardware 103 disposed opposite of J-hook-region 501 may be attached to back-side-of-cabinet 507.

Figure 6:
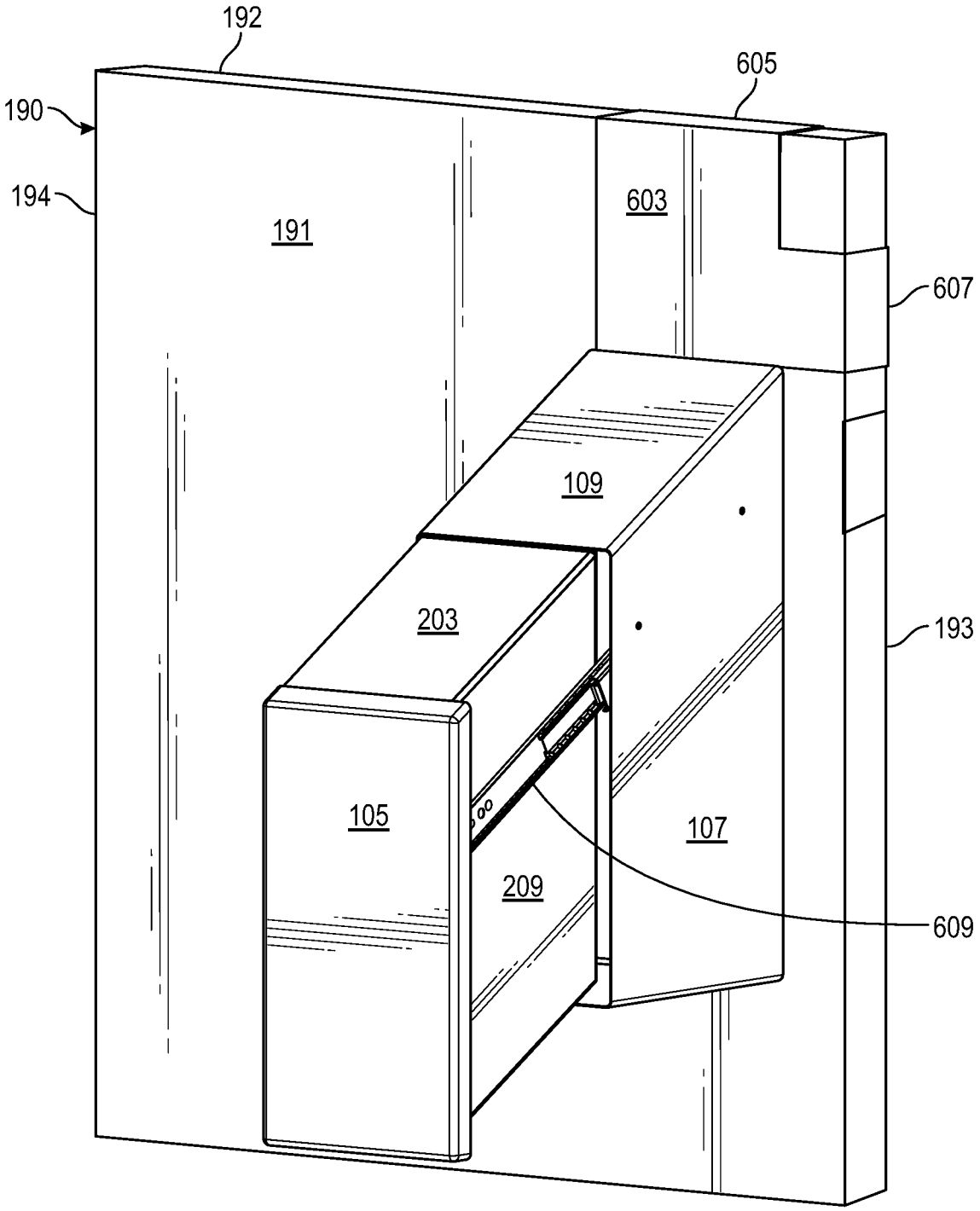
FIG. 6 may depict a front top perspective view of another embodiment of a medication-receiver mounted to the door, with the drawer of the cabinet in its open and unlocked configuration.

FIG. 6 may depict a front top perspective view of medication-receiver 100 mounted to door 190, with drawer 201 of cabinet 101 in its open and unlocked configuration. FIG. 6 may depict a view and a configuration similar to FIG. 2B, except the medication-receiver 100 shown in FIG. 6 may have some modifications to door-attachment-hardware 103 and to rail 211. That is, in FIG. 6, door-attachment-hardware 103 may be replaced with door-attachment-hardware 603; and/or rail 211 may be replaced with rail-system 609. In some embodiments, door-attachment-hardware 603 may be a variation of door-attachment-hardware 103. In some embodiments, door-attachment-hardware 603 may comprise top-bracket 605 and side-bracket 607. In some embodiments, top-bracket 605 may be configured to hang on top-of-door 192 of door 190. In some embodiments, side-bracket 607 may be configured to grip and/or wrap partially around hinge-side 193 of door 190. In some embodiments, side-bracket 607 may be configured to removably engage hinge-side 193 of door 190. In some embodiments, top-bracket 605 may structurally and functionally substantially similar to J-hook-region 501, e.g., for removable hanging on top-of-door 192 of door 190. In some embodiments, side-bracket 607 may structurally and functionally substantially similar to J-hook-region 501, except side-bracket 607 may be oriented perpendicularly from top-bracket 605 and side-bracket 607 may be for removable engagement of hinge-side 193 of door 190. In some embodiments, top-bracket 605 and side-bracket 607 may be fixed with respect to each other. In some embodiments, top-bracket 605 and side-bracket 607 may be substantially perpendicular to each other. In some embodiments, when medication-receiver 100 may be removably mounted to door 190 and when door 190 may be closed, top-bracket 605 and side-bracket 607 together may prevent medication-receiver 100 from moving on door 190. In some embodiments, when medication-receiver 100 may be removably mounted to door 190 and when door 190 may be closed, top-bracket 605 and side-bracket 607 together may removably fix medication-receiver 100 proximate to an upper corner of door 190 closer to hinge-side 193 than to not-hinge-side 194 and closer to top-of-door 192 than to a bottom of door 190. In some embodiments, top-bracket 605 and/or side-bracket 607 may be thin enough to minimally interfere with weather stripping associated with door 190.

Continuing discussing FIG. 6, in some embodiments, rail-system 609 may be a variation of rail 211. In some embodiments, rail-system 609 may be a drawer telescopic cantilever sliding extension for guiding and supporting the downwards and outwards sliding motion of drawer 201.

Figure 7A:
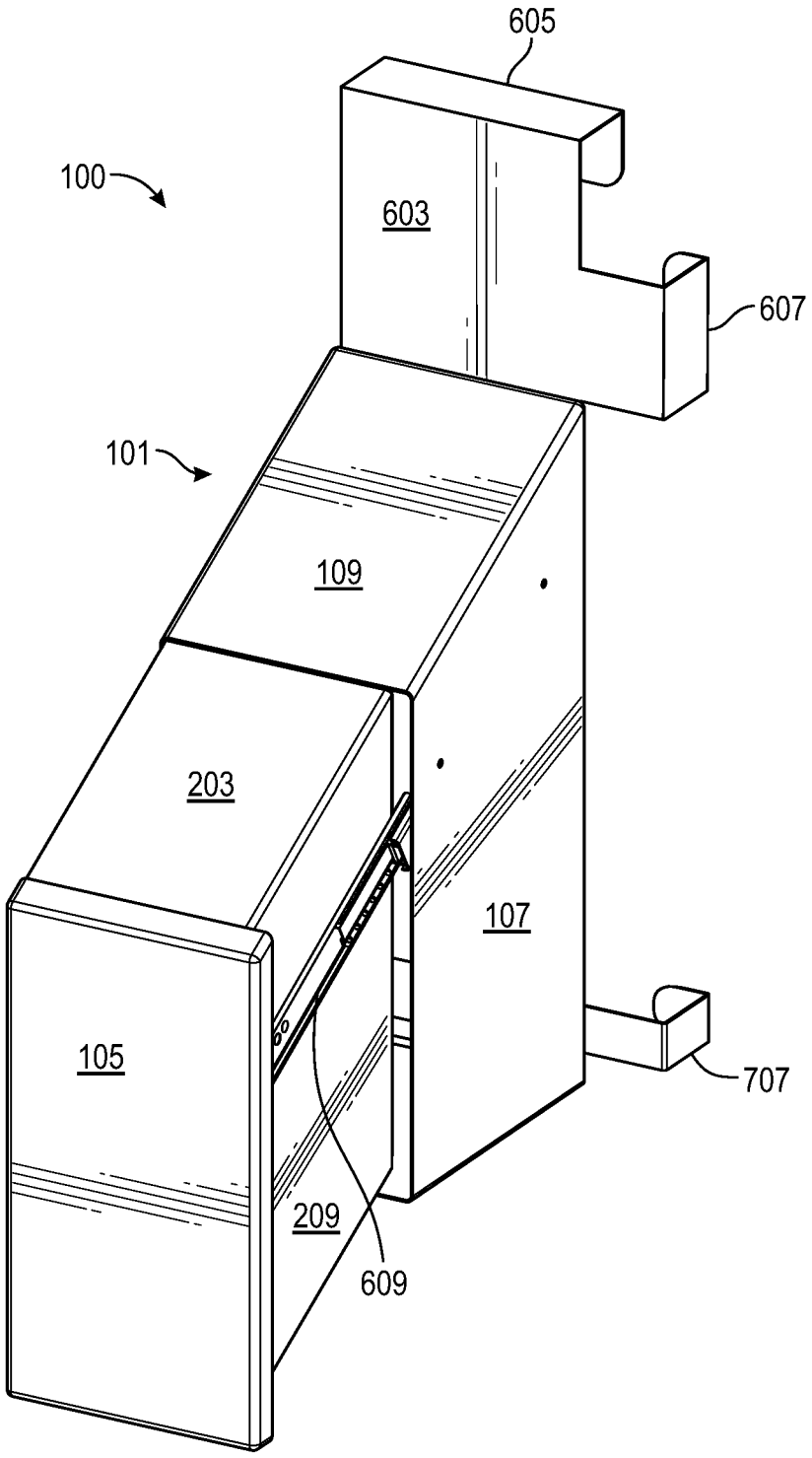
FIG. 7A may depict a similar embodiment of the medication-receiver shown in FIG. 6, except in FIG. 7A the medication-receiver may further comprise a lower-side-bracket.

FIG. 7A may depict a similar embodiment of medication-receiver 100 shown in FIG. 6, except in FIG. 7A medication-receiver 100 may further comprise lower-side-bracket 707. In some embodiments, lower-side-bracket 707 may be structurally and functionally substantially similar to side-bracket 607, except lower-side-bracket 707 may be disposed lower on medication-receiver 100 as compared to side-bracket 607. In some embodiments, lower-side-bracket 707 may be thin enough to minimally interfere with weather stripping associated with door 190. In some embodiments, lower-side-bracket 707 may be configured to grip and/or wrap partially around hinge-side 193 of door 190. In some embodiments, lower-side-bracket 707 may be configured to removably engage hinge-side 193 of door 190. In some embodiments, lower-side-bracket 707 may be fixedly spaced from side-bracket 607. In some embodiments, when medication-receiver 100 may be removably mounted to door 190 and when door 190 may be closed, top-bracket 605, side-bracket 607, and lower-side-bracket 707 together may prevent medication-receiver 100 from moving on door 190. In some embodiments, when medication-receiver 100 may be removably mounted to door 190 and when door 190 may be closed, top-bracket 605, side-bracket 607, and lower-side-bracket 707 together may removably fix medication-receiver 100 proximate to an upper corner of door 190 closer to hinge-side 193 than to not-hinge-side 194 and closer to top-of-door 192 than to a bottom of door 190.

Figure 7B:
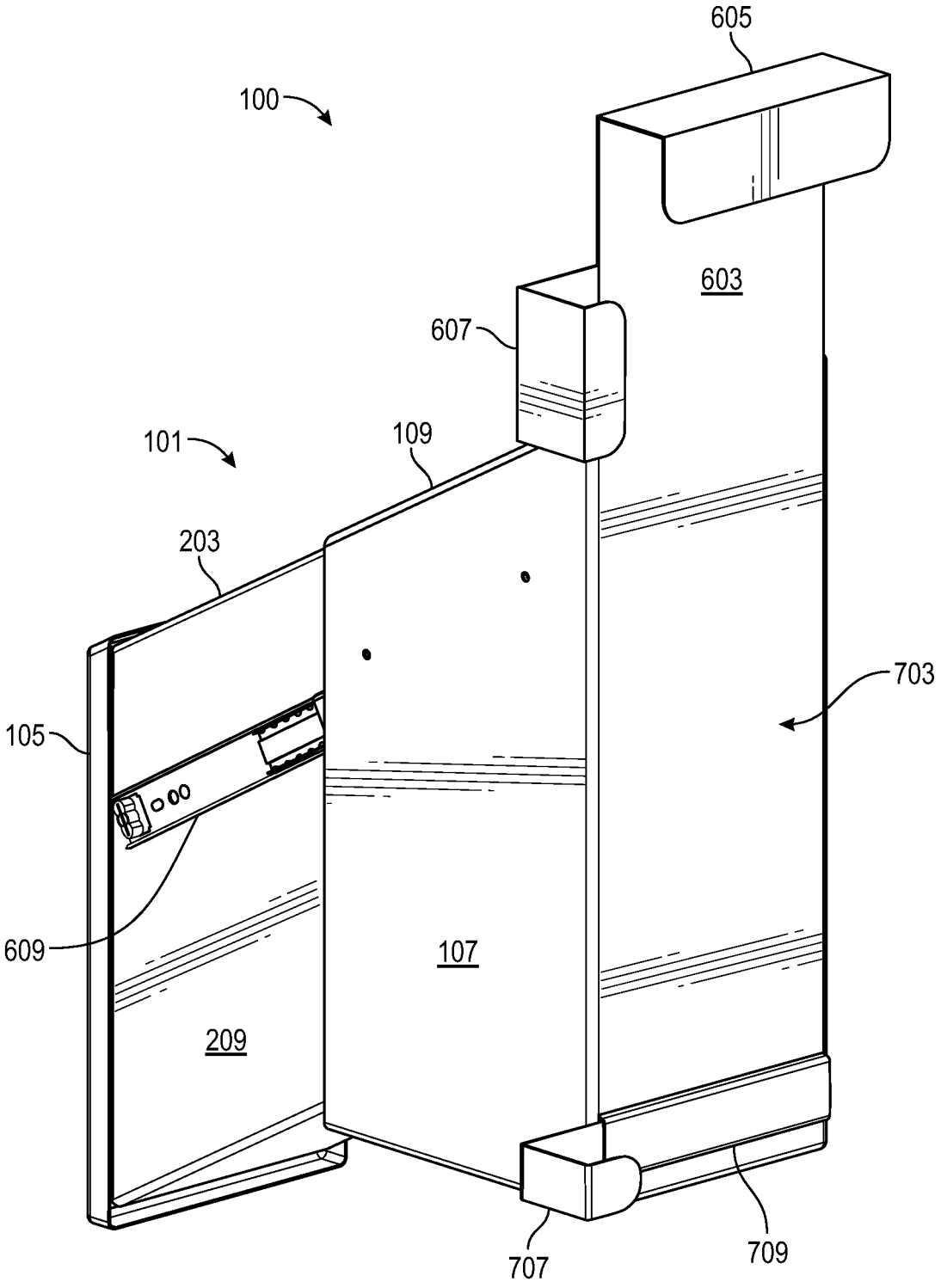
FIG. 7B may be an opposing back (rear) perspective view of the medication-receiver as compared to FIG. 7A.

FIG. 7B may be an opposing back (rear) perspective view of medication-receiver 100 as compared to FIG. 7A. From this back (rear) perspective view of FIG. 7B, back-side 703 may be seen. In some embodiments, back-side 703 may be a back (rear) side of cabinet 101 and/or a back (rear) side of door-attachment-hardware 603. In some embodiments, in a lower portion of back-side 703 may be side-bracket-guide 709. In some embodiments, side-bracket-guide 709 may be attached to an exterior lower portion of back-side 703. In some embodiments, side-bracket-guide 709 may be for receiving at least a portion of lower-side-bracket 707. In some embodiments, a substantially flat and elongate portion of lower-side-bracket 707 may slidingly fit into side-bracket-guide 709. In some embodiments, the sliding translation of the substantially flat and elongate portion of lower-side-bracket 707 in side-bracket-guide 709 may be locked (set/fixed) at various positions.

Figure 8:
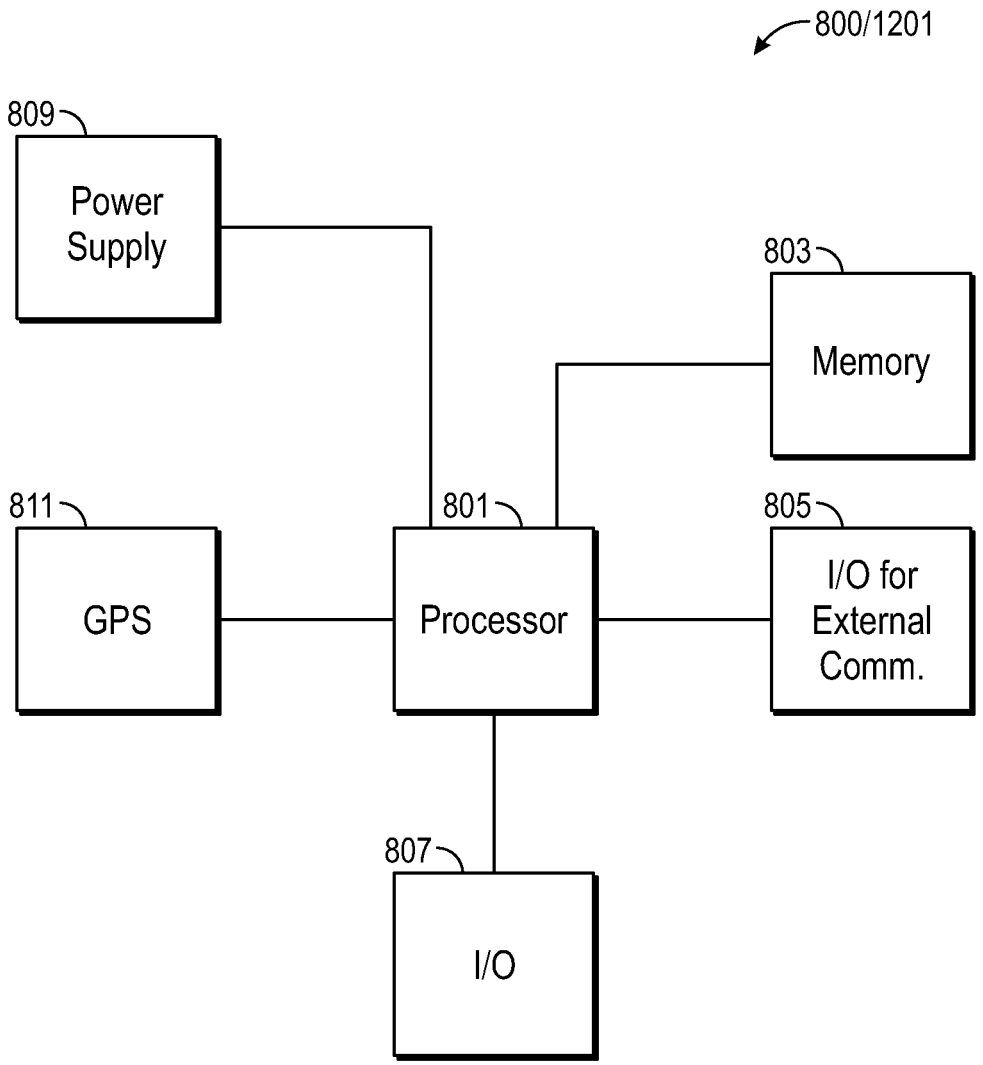
FIG. 8 may depict a block diagram showing some main sub-hardware elements for a computing-device that may be a part of a given medication-receiver.

FIG. 8 may depict a block diagram showing some main sub-hardware elements for a given computing-device 800. In some embodiments, medication-receiver 100/1000 may comprise at least one computing-device 800. In some embodiments, cabinet 101/1001 may comprise at least one computing-device 800. In some embodiments, computing-device 800 may be located in, on, and/or both in and on cabinet 101/1001. In some embodiments, at least some aspects of computing-device 800 may be located under bottom-of-drawer 207. In some embodiments, at least some aspects of computing-device 800 may be located under drawer-floor 1413. In some embodiments, at least some aspects of computing-device 800 may be located behind drawer-rear-wall 1311. In some embodiments, at least some aspects of computing-device 800 may be located above drawer-roof 1414. In some embodiments, at least some aspects of computing-device 800 may be located behind (and/or within) front-of-drawer 105, such as, but not limited to PCB 1201, Processor 801, Memory 803, I/O for External Communications 805, I/O Means 807, Power Supply 809, GPS 811, combinations thereof, and/or the like. In some embodiments, at least some aspects of computing-device 800 may be located within lower-compartment 1207, such as, but not limited to PCB 1201, Processor 801, Memory 803, I/O for External Communications 805, I/O Means 807, Power Supply 809, GPS 811, combinations thereof, and/or the like.

In some embodiments, computing-device 800 may be a computing device. In some embodiments, computing-device 800 may be a computer. In some embodiments, computing-device 800 may be selected from one or more of: a computing device of cabinet 101/1001, a computer, a smartphone, a tablet computing device, a laptop computer, a desktop computer, a tower computer, a server computer (server), a workstation computer (workstation), and/or the like. For example, and without limiting the scope of the present invention, in some embodiments, first-user-computing-device 901 (e.g., a smartphone or the like) (see FIG. 9) may be a computing-device 800. For example, and without limiting the scope of the present invention, in some embodiments, second-user-computing-device 903 (see FIG. 9) may be a computing-device 800. For example, and without limiting the scope of the present invention, in some embodiments, Server 905 (see FIG. 9) may be a computing-device 800. For example, and without limiting the scope of the present invention, in some embodiments, Admin-Device 907 (see FIG. 9) may be a computing-device 800.

In some embodiments, computing-device 800 may be a printed circuit board (PCB) or comprise one or more such PCBs, such as, but not limited to PCB 1201. In some embodiments, computing-device 800 may comprise one or more of the following sub-hardware elements: Processor(s) 801; one or more Memory 803; one or more I/O for External Communications 805; I/O Means 807; power-supply 809; connections from Processor(s) 801 to one or more Memory 803; connections from Processor(s) 801 to I/O for External Communications 805; connections from Processor(s) 801 to I/O Means 807; connections from Processor(s) 801 to power-supply 809; combinations thereof; and/or the like. "I/O" herein may refer to "inputs/outputs" as is commonly known in the computing and electronics industries. In some embodiments, the one or more Processors 801 may be electrically and/or optically coupled (e.g., via wiring, cabling, bus, and/or the like) with the one or more Memory 803, one or more I/O for External Communications 805, I/O Means 807, and power-supply 809.

In FIG. 8, Processor 801 may be one or more processors, including one or more central processors and/or one or more processors for graphics. In some embodiments, Processor 801 may be in communication with Memory 803. In some embodiments, Processor 801 may be in communication with I/O for External Communications 805. In some embodiments, Processor 801 may be in communication with I/O Means 807. In some embodiments, Processor 801 may be in communication with power-supply 809. In some embodiments, Processor 801 may receive electrical power necessary for operations from power-supply 809.

In some embodiments, PCB 1201 may comprise at least one Processor 801. In some embodiments, PCB 1201 may comprise at least one Processor 801 and at least one Memory 803. In some embodiments, PCB 1201 may comprise at least one Processor 801 and at least one I/O for External Communications 805. In some embodiments, PCB 1201 may comprise at least one Processor 801 and at least one I/O Means 807. In some embodiments, PCB 1201 may comprise at least one Processor 801 and at least connections to other I/O Means 807. In some embodiments, PCB 1201 may comprise at least one Processor 801 and at least one GPS 811. In some embodiments, PCB 1201 may comprise at least one Processor 801 and at least connections to Power Supply 809. In some embodiments, PCB 1201 may comprise at least one Processor 801 and at least connections to power supply 1209.

In some embodiments, cabinet 101/1001 may comprise one or more computing-devices 800. In some embodiments, one or more I/O Means 807 may be located on and/or in cabinet 101/1001. In some embodiments, I/O Means 807 may be located on an internal surface and/or on an external (exterior) surface of cabinet 101/1001. In some embodiments, I/O Means 807 may be directed internally and/or externally of cabinet 101/1001.

In some embodiments, the inputs of I/O Means 807 of a given computing-device 800 may be one or more inputs selected from: inputs from exterior-interface 111; inputs from fingerprint-scanner 401; inputs from keypad 403; inputs from first-I/O-means 405; inputs from second-I/O-means 407; drawer 201 open/closed sensors (e.g., microswitch); drawer-member 1211 open/closed sensors; external motion sensor/detector; internal motion/movement sensor (e.g., accelerometer or the like); accelerometer; touchscreen of computing-device 800; buttons of computing-device 800; switches of computing-device 800; keyboard of computing-device 800; stylus of computing-device 800; mouse of computing-device 800; trackball of computing-device 800; touchpad of computing-device 800; lever of computing-device 800; slide of computing-device 800; dials of computing-device 800; camera(s) (external and/or internal) of computing-device 800; at least one internal camera (directed to an inside of drawer-member 1211 or to an inside of drawer 201); at least one external camera (e.g., directed from a front exterior of front-of-drawer 105); range finder-detector of computing-device 800; proximity detectors of computing-device 800 (e.g., RFID/NFC reader/receiver/scanner); motion detector of computing-device 800; hardwired electrical power ports (e.g., a USB port or the like) of computing-device 800; hardwired data ports (e.g., a USB port or the like) of computing-device 800; incoming communications received via I/O for External Communications 805 of computing-device 800; microphones of computing-device 800; at least one internal temperature sensor (for measuring temperature inside of drawer-member 1211 or an inside of drawer 201); at least one temperature sensor for measuring a temperature external to medication-receiver 100/1000; internal heater/cooler (for cooling an inside of drawer-member 1211 or an inside of drawer 201); internal fan (for cooling an inside of drawer-member 1211 or an inside of drawer 201); internal chiller (for cooling an inside of drawer-member 1211 or an inside of drawer 201); external nighttime/daylight sensor; clock; timer; solar-panel(s) (e.g., solar-panel 1701); lock-assembly 1217; GPS module/chipset; combinations thereof; and/or the like. In some embodiments, I/O Means 807 may comprise a GPS chip set (and/or GPS module) and/or the like for determining the position of computing-device 800 (i.e., the position of cabinet 101/1001).

In some embodiments, the outputs of I/O Means 807 may be one or more outputs selected from: state of lock (e.g., locked or unlocked) (wherein this lock may be one or more solenoid bolt locks in some embodiments, and/or magnetic locks in other embodiments); lock-assembly 1217; drawer 201 light(s); drawer-member 1211 light(s); external light(s); internal light(s); IR light(s); back lighting; light emitting diodes (LEDs); light bar(s); light strip(s); different colored light(s); status light(s); indication light(s); light(s) to enhance visibility; strobe light(s); alarm light(s); information displayed on a monitor, screen (including a touchscreen), or display of computing-device 800; readouts of computing-device 800; speakers of computing-device 800; buzzers of computing-device 800; bells of computing-device 800; whistles of computing-device 800; lights and/or LEDs of computing-device 800; alarms of computing-device 800; scanners of and/or in communication with computing-device 800; printers of and/or in communication with computing-device 800; outgoing information transmitted via the hardwired port (e.g., a USB port or the like) of computing-device 800; outgoing information transmitted via I/O for External Communications 805, and/or the like.

Figure 10A:
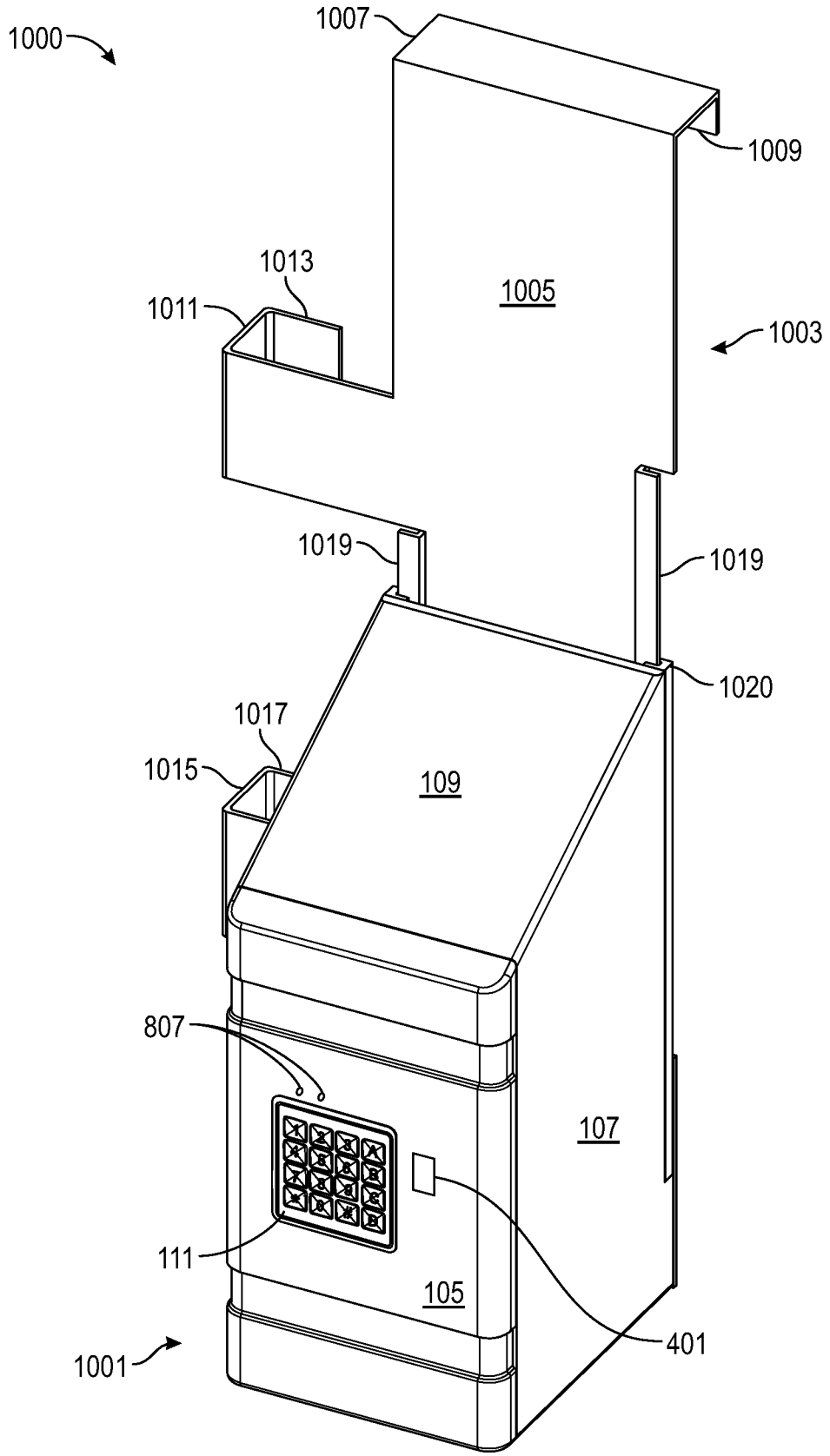
FIG. 10A may depict a top right perspective view of a medication-receiver with its cabinet in a process of being removably attached to door-attachment-hardware.

In some embodiments, medication-receiver 100/1000 may comprise at least one interior camera 807 (see e.g., FIG. 14A) and at least one external camera 807 (see e.g., FIG. 10A). In some embodiments, the at least one interior camera 807 may be directed to view the interior of drawer 201/1211 and may be attached to drawer 201/1211. In some embodiments, the at least one external camera 807 may be attached to front-of-drawer 105 and may directed to capturing images that are external and in front of the medication-receiver 100/1000 within a predetermined range of field. In some embodiments, at least one interior camera 807 and at least one external camera 807 may be operatively and/or electronically linked to processor 801 and/or to PCB 1201. In some embodiments, at least one interior camera 807 and at least one external camera 807 may be controlled by processor 801 and/or by PCB 1201. Herein, the "front of the drawer" and "front-of-drawer 105" may be used interchangeably.

Note, the external oriented (exteriorly mounted) camera (s), the microphone(s), and/or the fingerprint scanner(s)/reader(s) 401 may facilitate user identity. The external oriented (exteriorly mounted) camera(s), the microphone(s), and/or the fingerprint scanner(s)/reader(s) 401 may facilitate biometric user identification. Facial recognition, eye/ocular recognition, voice recognition, and/or fingerprint recognition may be utilized by cabinet 101/1001. In some embodiments, opening of drawer 201 and/or opening of drawer-member 1211 may only be permitted by a user whose identity has been verified by facial recognition, eye/ocular recognition, voice recognition, and/or fingerprint recognition at the given cabinet 101/1001 by use of the one or more external oriented (exteriorly mounted) camera(s), the microphone(s), and/or the fingerprint scanner(s)/reader(s) 401 of the given cabinet 101/1001. This may be so for the intended recipient, patient, and/or caregiver (e.g., User 1 in FIG. 9); and/or this may be true for the delivery person (e.g., User 2 in FIG. 9).

In some embodiments, I/O Means 807 may comprise at least one light 807*a*. In some embodiments, light 807*a* may be a type of I/O Means 807. In some embodiments, light 807*a* may be electrically and operatively linked to Processor 801 (and/or to PCB 1201). In some embodiments, light 807*a* may be selected from one or more of: drawer 201 light(s); drawer-member 1211 light(s); external light(s); internal light(s); IR light(s); back lighting; light emitting diodes (LEDs); light bar(s); light strip(s); different colored light(s); status light(s); indication light(s); light(s) to enhance visibility; strobe light(s); alarm light(s); combinations thereof; and/or the like. In some embodiments, light 807*a* may provide light(s) and/or lighting external and/or internal to cabinet 101/1001. In some embodiments, light 807*a* may be located on an external surface of cabinet 101/1001 and/or on an internal surface of cabinet 101/1001.

In some embodiments, medication-receiver 100/1000 may comprise at least one external camera 807, at least one light emitting diode (LED) 807*a*, at least one touch interface 111, at least one antenna 805, at least one power source 809/1209, and at least one processor 801. In some embodiments, at least one external camera 807, at least one LED 807*a*, at least one touch interface 111, at least one antenna 805, and at least one power source 809/1209 may all be operatively connected to the at least one processor 801. In some embodiments, at least one external camera 807, at least one LED 807*a*, and at least one touch interface 111 may all be located at least partially on an exterior of cabinet 101/1001 (such as, but not limited, to front-of-drawer 105). In some embodiments, at least one antenna 805, at least one power source 809, and at least one processor 801 may be located at least partially within front-of-drawer 105.

Continuing discussing FIG. 8, in some embodiments, Processor 801 may execute a computer program known as an operating system (e.g., a Microsoft Windows operating system, a Linux operation system, an Apple and/or Macintosh operating system, a mobile computing device operating system, any other suitable operating system, and/or combinations thereof) which may control the execution of other computer programs (e.g., application programs, including in some embodiments a computer program styled as "PRL Rx Software"); and may provide for scheduling, input/output (I/O) and other device control, accounting, compilation, storage assignment, data management, memory management, communication; and/or dataflow control. Collectively, Processor 801 and its operating system may define a computer platform for which the application programs and other computer program languages may be written in. In some embodiments, Processor 801 may also execute one or more computer programs to implement various functions and/or methods of the present invention, such as the PRL Rx Software that may be one main aspect of the present invention. These computer programs may be written in any type of computer program language, including, but not limited to, a procedural programming language, object-oriented programming language, macro language, and/or combinations thereof.

These computer programs, including the operating system and/or the PRL Rx Software, may be stored (e.g., non-transitorily stored) in Memory 803. Memory 803 may store (hold) information on a volatile or non-volatile medium, and may be fixed and/or removable. Memory 803 may include a tangible computer readable and computer writable non-volatile recording medium, on which signals are stored that define a computer program or information to be used by the computer program. The recording medium may, for example, be disk memory, flash memory, and/or any other article(s) of manufacture usable to record and store information (in a non-transitory fashion). In some embodiments, in operation, Processor 801 may cause(s) data (such as, but not limited to, user account data, user profile data, user preference data, delivery verification logs, usage logs, access logs, keystroke logs, camera captures [e.g., photos and/or video], microphone captures [e.g., audio captures], GPS/positional information, movement/translation information, fingerprint scans, fingerprint reference files, usernames, passwords, passcodes, environmental data logs, etc.) to be read from the nonvolatile recording medium into a volatile memory (e.g., a random access memory, or RAM) that may allow for more efficient (i.e., faster) access to the information by the Processor 801 as compared against the nonvolatile recording medium. Such RAM memory may be located in/on the Memory 803 and/or in/on Processor 801. See e.g., FIG. 8. The Processor 801 may manipulate(s) the data within integrated circuit memory and may then copy the data to the nonvolatile recording medium after processing may be completed. A variety of mechanisms are known for managing data movement between the nonvolatile recording medium and the integrated circuit memory element, and the invention is not limited to any mechanism, whether now known or later developed. The invention is also not limited to a particular processing unit (e.g., Processor 801) or storage unit (e.g., Memory 803).

Note, each and every method and/or step discussed herein and as depicted in the figures may be implemented as non-transitory computer-readable medium including codes executable by a processor, such as Processor 801. That is, such non-transitory computer-readable medium may be the one or more Memory 803 storage units. That is, such a processor may be Processor 801; or alternatively, Processor 801 may comprise such a processor.

The PRL Rx Software may be non-transitorily stored in Memory 803. In some embodiments, the PRL Rx Software may be distributed across several and different Memory 803*s* of a single computing-device 800. In some embodiments, the PRL Rx Software may be distributed across several and different Memory 803*s* of several and different computing-devices 800. In some embodiments, some portions of the PRL Rx Software (e.g., a user GUI or user cookie, user's data or portion thereof) may be non-transitorily stored in Memory 803 of computing-device(s) 800 such as first-user-computing-device 901 and/or second-user-computing-device 903; wherein other portions of the PRL Rx Software (e.g., user account data, user profile data, user preference data, delivery verification logs, usage logs, access logs, keystroke logs, camera captures [e.g., photos and/or video], microphone captures [e.g., audio captures], GPS/positional information, movement/translation information, fingerprint scans, fingerprint reference files, usernames, passwords, passcodes, environmental data logs, etc.) may be non-transitorily stored in Memory 803 of a computing-device 800 that is a Server 905. Wherein yet further other portions the PRL Rx Software (e.g., admin's GUI or admin's cookie) may be non-transitorily stored in Memory 803 of a computing-device 800 that is an Admin-Device 907.

New and/or updates to code, program, software applications, operating system, firmware, and/or the PRL Rx Software may be saved non-transitorily onto Memory 803 from I/O Means 807 and/or via I/O for External Communications 805.

Continuing discussing FIG. 8, in some embodiments, Processor 801 may also be in (electrical and/or optical) communication with I/O for External Communications 805. Processor 801 may control I/O for External Communications 805, depending upon the instructions that Processor 801 may be processing/executing. I/O for External Communications 805 may permit communication between first-user-computing-device 901 and/or second-user-computing-device 903. I/O for External Communications 805 may permit communication between a given computing-device 800 (e.g., first-user-computing-device 901 and/or second-user-computing-device 903) and other computing-devices (e.g., servers 905 and/or admin-devices 907) that are or are not part of the given computing-device 800, and/or that may not be under the control of a given computing-device 800. I/O for External Communications 805 may permit communication between a given computing-device 800 and another computing-device 800. I/O for External Communications 805 may permit communication between a given computing-device 800 and server(s) 905. I/O for External Communications 805 may permit communication between a given computing-device 800 and admin-device 907.

In some embodiments, I/O for External Communications 805 may comprise one or more radios and/or antennas to facilitate wireless communications, such as WiFi (Wi-Fi), Bluetooth, ZigBee, cellular, a predetermined wireless communication protocol, combinations thereof, and/or the like. In some embodiments, I/O for External Communications 805 may comprise at least one Bluetooth chipset and/or the like. In some embodiments, I/O for External Communications 805 may comprise a network card and/or a network adapter. In some embodiments, I/O for External Communications 805 may be a network card and/or a network adapter. In some embodiments, I/O for External Communications 805 may be in wired and/or wireless communications with the Internet, WAN (wide area network), LAN (local area network) (see e.g., internet/network/WAN/LAN 909 in FIG. 9). Communications between a given computing-device 800 that may rely upon I/O for External Communications 805 and one or more of: another computing-device 800, first-user-computing-device 901, second-user-computing-device 903, server 905, and/or admin-device 907—may be routed through such a network (see e.g., internet/network/WAN/LAN 909 in FIG. 9). In some embodiments, I/O for External Communications 805 may comprise one or more radios and/or antennas to facilitate reading, interrogating, and/or scanning of RFID tags (and/or NFC tags).

In some embodiments, power-supply 809 may provide electrical power to the main sub-hardware elements and/or electronics of computing-device 800. In some embodiments, power-supply 809 may be one or more batteries. In some embodiments, power-supply 809 may be one or more rechargeable batteries. In some embodiments, power-supply 809 may be one or more backup batteries. In some embodiments, power-supply 809 may be one or more AC/DC adapters or electrical power conditioners allowing computing-device 800 to received standardized AC electrical power from wired power source. In some embodiments, power-supply 809 may comprise one or more solar panels for generating electrical power, wherein such one or more solar panels may be located on an external surface of medication-receiver 100 (such as, but not limited to top-of-cabinet 109).

The main sub-hardware elements of a given computing-device 800, including their workings and configurations, are well known in the relevant computing and electronics industries and such information is incorporated herein by reference.

Figure 9:
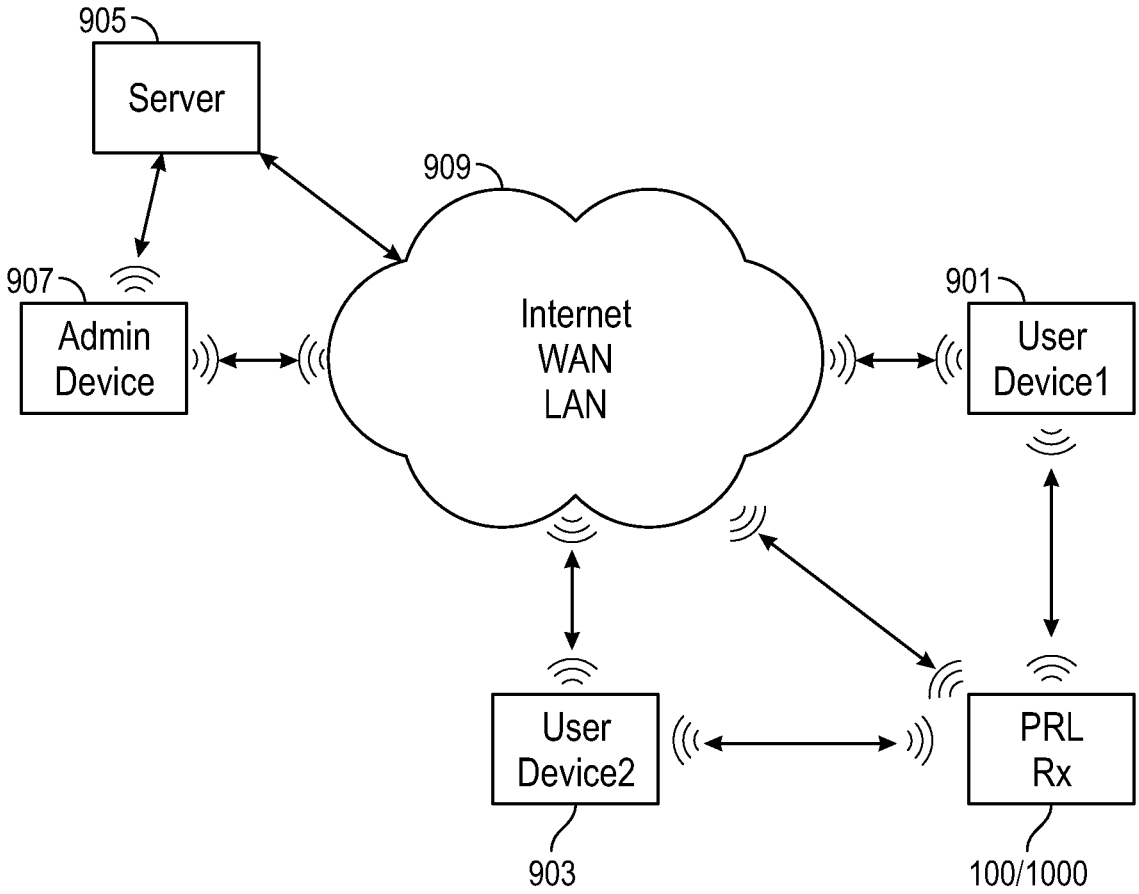
FIG. 9 may depict a block diagram showing the medication-receiver in wireless (or wired) communication with various other computing-devices.

FIG. 9 may depict a block diagram showing medication-receiver 100/1000 in wireless (or wired) communication with other computing-devices. FIG. 9 may depict a block diagram showing how aspects of the PRL Rx Software communicate with itself and with other devices. In some embodiments, first-user-computing-device 901 may be a type of computing-device 800. In some embodiments, first-user-computing-device 901 may be associated with User 1. In some embodiments, User 1 may be delivery person (and/or delivery robot) who may be delivering one or more goods to a given medication-receiver 100/1000. In some embodiments, there may be one or more first-user-computing-device(s) 901. In some embodiments, second-user-computing-device 903 may be a type of computing-device 800. In some embodiments, second-user-computing-device(s) 903 may be associated with User 2. In some embodiments, User 2 may be an intended recipient (e.g., a patient or caregiver) of the one or more goods delivered and received into a given medication-receiver 100/1000. In some embodiments, there may be one or more second-user-computing-device(s) 903. In some embodiments, first-user-computing-device 901 and second-user-computing-device 903 may be different computing-devices, but could be of a same type of computing-device (e.g., a smartphone). In some embodiments, Server 905 may be a type of computing-device 800. In some embodiments, there may be one or more Server(s) 905. In some embodiments, one or more Server(s) 905 may be associated with back-end operations of the PRL Rx Software and/or with databases maintained on such Servers 905. In some embodiments, Admin-Device 907 may be a type of computing-device 800. In some embodiments, Internet/WAN/LAN 909 may comprise various network switches, routers, hubs, gateways, modems, hotspots, signal expanders, and/or the like facilitating data flow. In some embodiments, these network switches, routers, hubs, gateways, modems, hotspots, and signal expanders, and/or the like may be types of computing-devices 800. In some embodiments, WAN may refer to a wide area network. In some embodiments, LAN may refer to a local area network.

Continuing discussing FIG. 9, in some embodiments, first-user-computing-device 901 may be in communication with Internet/WAN/LAN 909. In some embodiments, first-user-computing-device 901 may be in wireless and/or wired communication with Internet/WAN/LAN 909.

Continuing discussing FIG. 9, in some embodiments, first-user-computing-device 901 may be in communication with the computing-device 800 of medication-receiver 100/1000. In some embodiments, communications between first-user-computing-device 901 and medication-receiver 100/1000 may be via (e.g., through and/or across) Internet/WAN/LAN 909. In some embodiments, communications between first-user-computing-device 901 and medication-receiver 100/1000 may be routed through Internet/WAN/LAN 909. In some embodiments, first-user-computing-device 901 may communicate directly with medication-receiver 100/1000. In some embodiments, such direct communications may be wireless. In some embodiments, first-user-computing-device 901 may have RFID and/or NFC tags and/or readers for using RFID and/or NFC to open, lock, unlock, and/or close drawer 201 of medication-receiver 100. In some embodiments, first-user-computing-device 901 may have RFID and/or NFC tags and/or readers for using RFID and/or NFC to open, lock, unlock, and/or close drawer-member 1211 of medication-receiver 1000.

Continuing discussing FIG. 9, in some embodiments, first-user-computing-device 901 may be in communication with one or more Server(s) 905. In some embodiments, communications between first-user-computing-device 901 and one or more Server(s) 905 may be via (e.g., through and/or across) Internet/WAN/LAN 909. In some embodiments, communications between first-user-computing-device 901 and one or more Server(s) 905 may be routed through Internet/WAN/LAN 909.

Continuing discussing FIG. 9, in some embodiments, second-user-computing-device 903 may be in communication with Internet/WAN/LAN 909. In some embodiments, second-user-computing-device 903 may be in wireless and/or wired communication with Internet/WAN/LAN 909.

Continuing discussing FIG. 9, in some embodiments, second-user-computing-device 903 may be in communication with the computing-device 800 of medication-receiver 100/1000. In some embodiments, communications between second-user-computing-device 903 and medication-receiver 100/1000 may be via (e.g., through and/or across) Internet/WAN/LAN 909. In some embodiments, communications between second-user-computing-device 903 and medication-receiver 100/1000 may be routed through Internet/WAN/LAN 909. In some embodiments, second-user-computing-device 903 may communicate directly with medication-receiver 100/1000. In some embodiments, such direct communications may be wireless. In some embodiments, User 2, via second-user-computing-device 903, may receive delivery confirmations and/or verification information. In some embodiments, such received delivery confirmations and/or verification information may be via text message, sms message, email, phone call, voicemail, popup message, popup notification, and/or the like. In some embodiments, second-user-computing-device 903 may have RFID and/or NFC tags and/or readers for using RFID and/or NFC to open, lock, unlock, and/or close drawer 201 of medication-receiver 100. In some embodiments, second-user-computing-device 903 may have RFID and/or NFC tags and/or readers for using RFID and/or NFC to open, lock, unlock, and/or close drawer-member 1211 of medication-receiver 1000.

In some embodiments, User 1 and/or User 2 may use exterior-interface 111 to access (e.g., open) drawer 201 of cabinet 101 of medication-receiver 100. In some embodiments, User 1 and/or User 2 may use exterior-interface 111 to access (e.g., open) drawer-member 1211 of cabinet 1001 of medication-receiver 1000.

Continuing discussing FIG. 9, in some embodiments, second-user-computing-device 903 may be in communication with one or more Server(s) 905. In some embodiments, communications between second-user-computing-device 903 and one or more Server(s) 905 may be via (e.g., through and/or across) Internet/WAN/LAN 909. In some embodiments, communications between second-user-computing-device 903 and one or more Server(s) 905 may be routed through Internet/WAN/LAN 909.

Continuing discussing FIG. 9, in some embodiments, Admin-Device 907 may be in communication with Internet/WAN/LAN 909. In some embodiments, Admin-Device 907 may be in wireless and/or wired communication with Internet/WAN/LAN 909.

Continuing discussing FIG. 9, in some embodiments, Admin-Device 907 may be in communication with the computing-device 800 of medication-receiver 100/1000. In some embodiments, communications between Admin-Device 907 and medication-receiver 100/1000 may be via (e.g., through and/or across) Internet/WAN/LAN 909. In some embodiments, communications between Admin-Device 907 and medication-receiver 100/1000 may be routed through Internet/WAN/LAN 909. In some embodiments, Admin-Device 907 may communicate directly with medication-receiver 100/1000. In some embodiments, such direct communications may be wireless. In some embodiments, Admin-Device 907 may have RFID and/or NFC tags and/or readers for using RFID and/or NFC to open, lock, unlock, and/or close drawer 201 of medication-receiver 100. In some embodiments, Admin-Device 907 may have RFID and/or NFC tags and/or readers for using RFID and/or NFC to open, lock, unlock, and/or close drawer-member 1211 of medication-receiver 1000.

Continuing discussing FIG. 9, in some embodiments, Admin-Device 907 may be in communication with one or more Server(s) 905. In some embodiments, Admin-Device 907 may be in direct communication with one or more Server(s) 905. In some embodiments, communications between Admin-Device 907 and one or more Server(s) 905 may be via (e.g., through and/or across) Internet/WAN/LAN 909. In some embodiments, communications between Admin-Device 907 and one or more Server(s) 905 may be routed through Internet/WAN/LAN 909.

In some embodiments, at least some portion of the PRL Rx Software may be running and/or non-transitorily stored on computing-device 800 of medication-receiver 100/1000, firstuser-computing-device 901, second-user-computing-device 903, and/or the one or more Server(s) 905.

In some embodiments, at least some portion of the PRL Rx Software that may be running on the one or more Server(s) 905 may direct (cause) an update of the PRL Rx Software to be loaded onto the Memory 803 of: computing-device 800 of medication-receiver 100/1000, first-user-computing-device(s) 901, and/or second-user-computing-device(s) 903.

Continuing discussing FIG. 9, in some embodiments, first-user-computing-device 901 may be in communication with one or more Admin-Device(s) 907. In some embodiments, first-user-computing-device 901 may be in wireless and/or wired communication with one or more admin-device(s) 907. In some embodiments, communications between first-user-computing-device 901 and the one or more Admin-Device(s) 907 may be routed through Internet/WAN/LAN 909.

Continuing discussing FIG. 9, in some embodiments, second-user-computing-device 903 may be in communication with one or more Admin-Device(s) 907. In some embodiments, second-user-computing-device 903 may be in wireless and/or wired communication with one or more Admin-Device(s) 907. In some embodiments, communications between second-user-computing-device 903 and the one or more Admin-Device(s) 907 may be routed through Internet/WAN/LAN 909.

Continuing discussing FIG. 9, in some embodiments, computing-device 800 of medication-receiver 100/1000 may be in communication with one or more Admin-Device(s) 907. In some embodiments, computing-device 800 of medication-receiver 100/1000 may be in wireless and/or wired communication with one or more Admin-Device(s) 907. In some embodiments, communications between computing-device 800 of medication-receiver 100/1000 and the one or more Admin-Device(s) 907 may be routed through Internet/WAN/LAN 909.

Continuing discussing FIG. 9, in some embodiments, the one or more Server(s) 905 may be in communication with the one or more Admin-Device(s) 907. In some embodiments, the one or more Server(s) 905 may be in wireless and/or wired communication with the one or more Admin-Device(s) 907. In some embodiments, communications between the one or more Server(s) 905 and the one or more Admin-Device(s) 907 may be routed through Internet/WAN/LAN 909. In some embodiments, at least some portion of the PRL Rx Software may be running on the one or more Admin-Device(s) 907. In some embodiments, at least some portion of the PRL Rx Software that may be running on the one or more Admin-Device(s) 907, and with proper logged in credentials, may access, edit, control, and/or override portions of the PRL Rx Software and/or data located in Memory 803 of the one or more Server(s) 905. In some embodiments, at least some portion of the PRL Rx Software that may be running on the one or more Admin-Device(s) 907, and with proper logged in credentials, may access, edit, control, and/or override portions of the PRL Rx Software and/or data located in Memory 803 of the first-user-computing-device 901.

In some embodiments, at least some portion of the PRL Rx Software that may be running on the one or more Admin-Device(s) 907, and with proper logged in credentials, may access, edit, control, and/or override portions of the Software and/or data located in Memory 803 of the second-user-computing-device 903.

In some embodiments, at least some portion of the PRL Rx Software that may be running on the one or more Admin-Device(s) 907, and with proper logged in credentials, may access, edit, control, and/or override portions of the PRL Rx Software and/or data located in Memory 803 of computing-device 800 of medication-receiver 100/1000.

In some embodiments, medication-receiver 1000 may be substantially similar with respect to purpose, function, and/or structure(s), to medication-receiver 100, except as otherwise noted below.

Figure 10B:
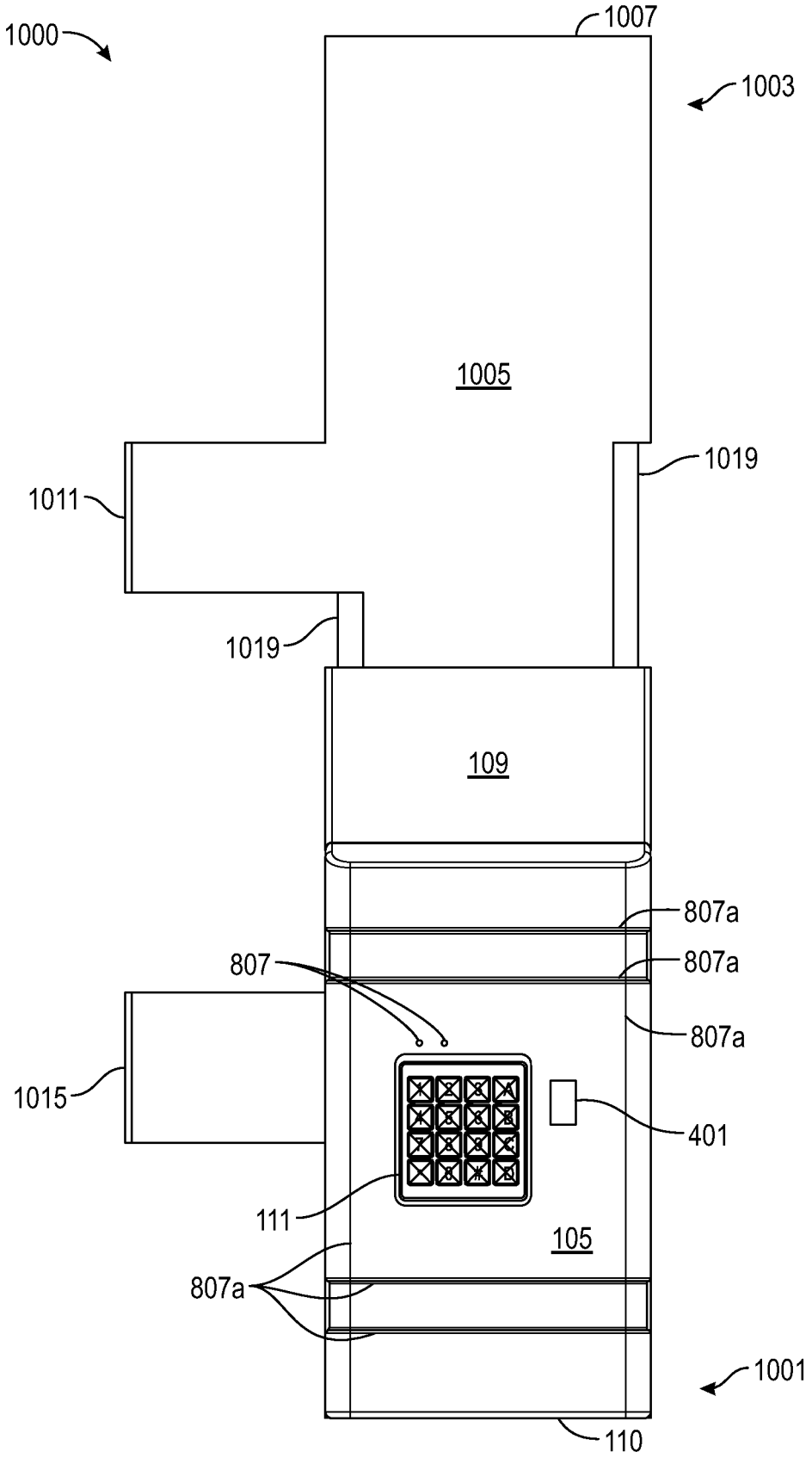
FIG. 10B may depict a front view of the configuration shown in FIG. 10A.
Figure 10C:
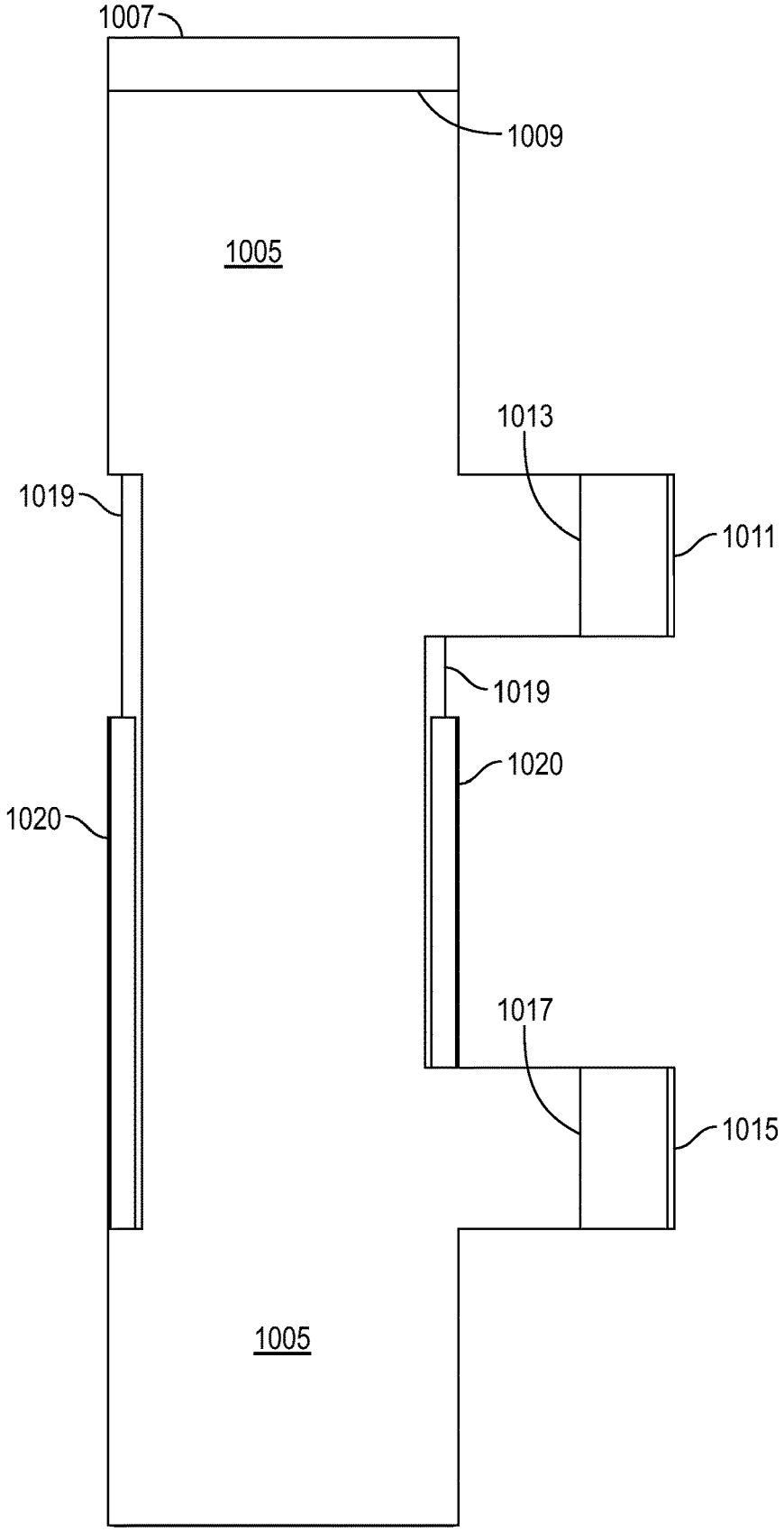
FIG. 10C may depict a rear (back) view of the configuration shown in FIG. 10A.
Figure 10D:
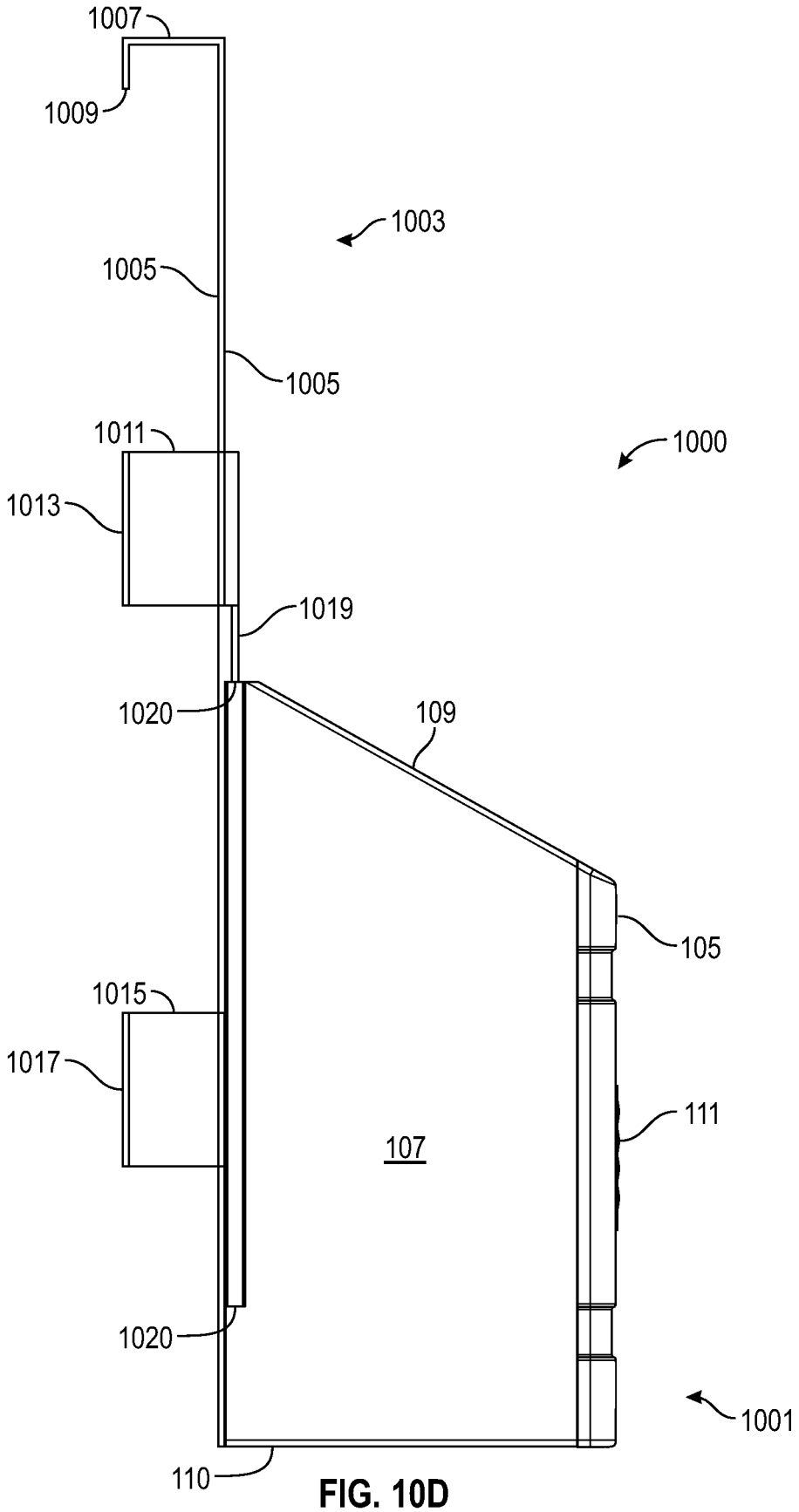
FIG. 10D may depict a left-side view of the configuration shown in FIG. 10A.
Figure 10E:
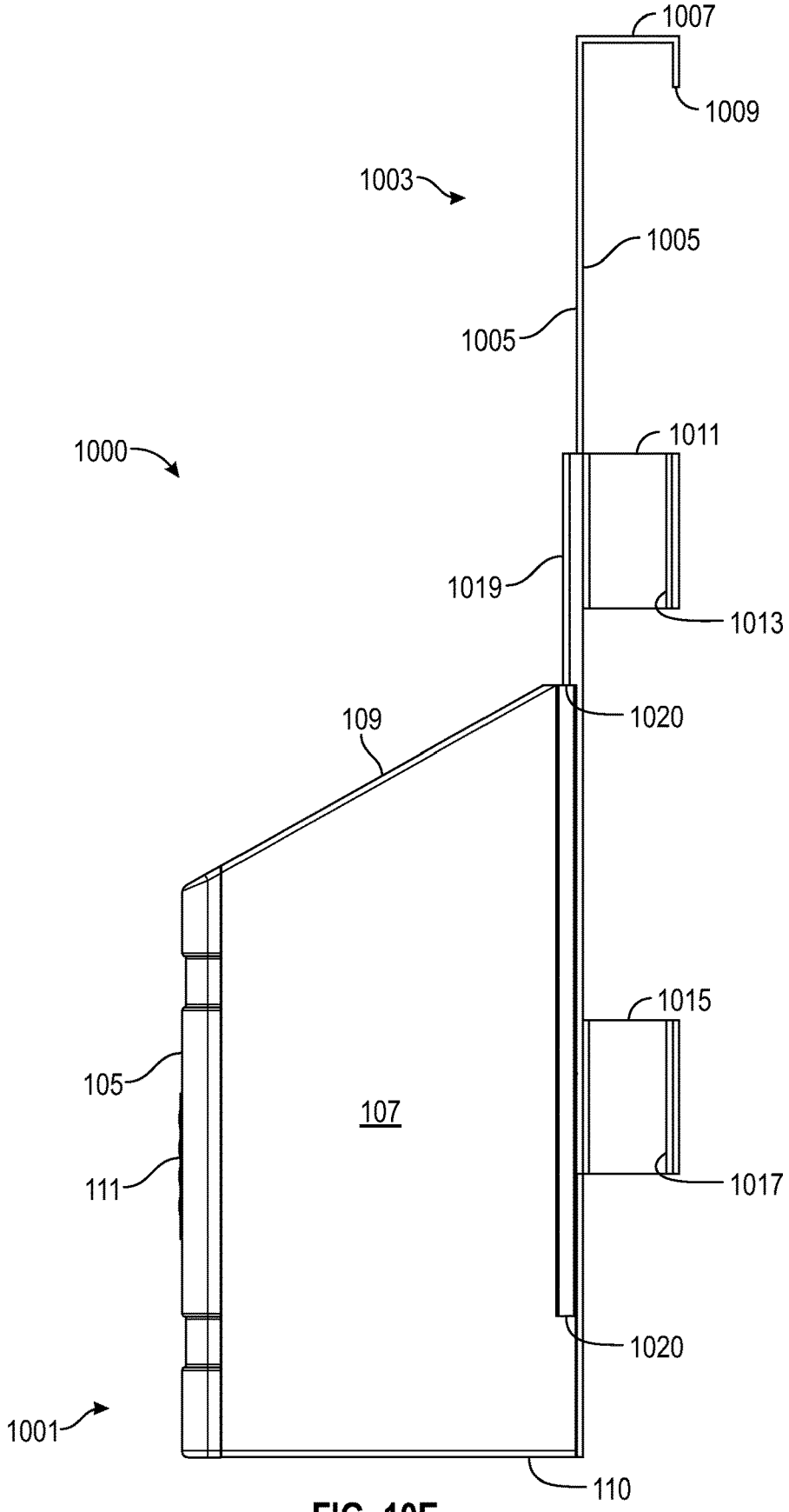
FIG. 10E may depict a right-side view of the configuration shown in FIG. 10A.
Figure 10F:
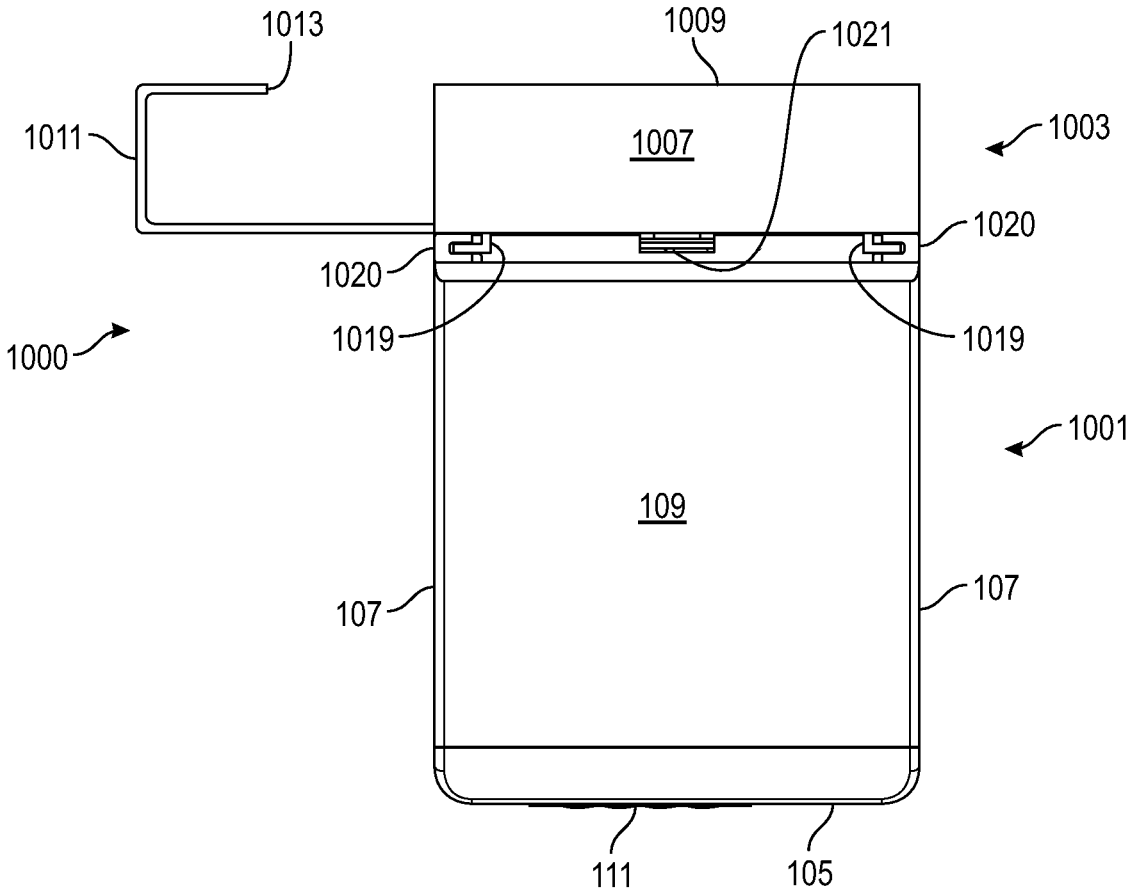
FIG. 10F may depict a top view of the configuration shown in FIG. 10A.
Figure 10G:
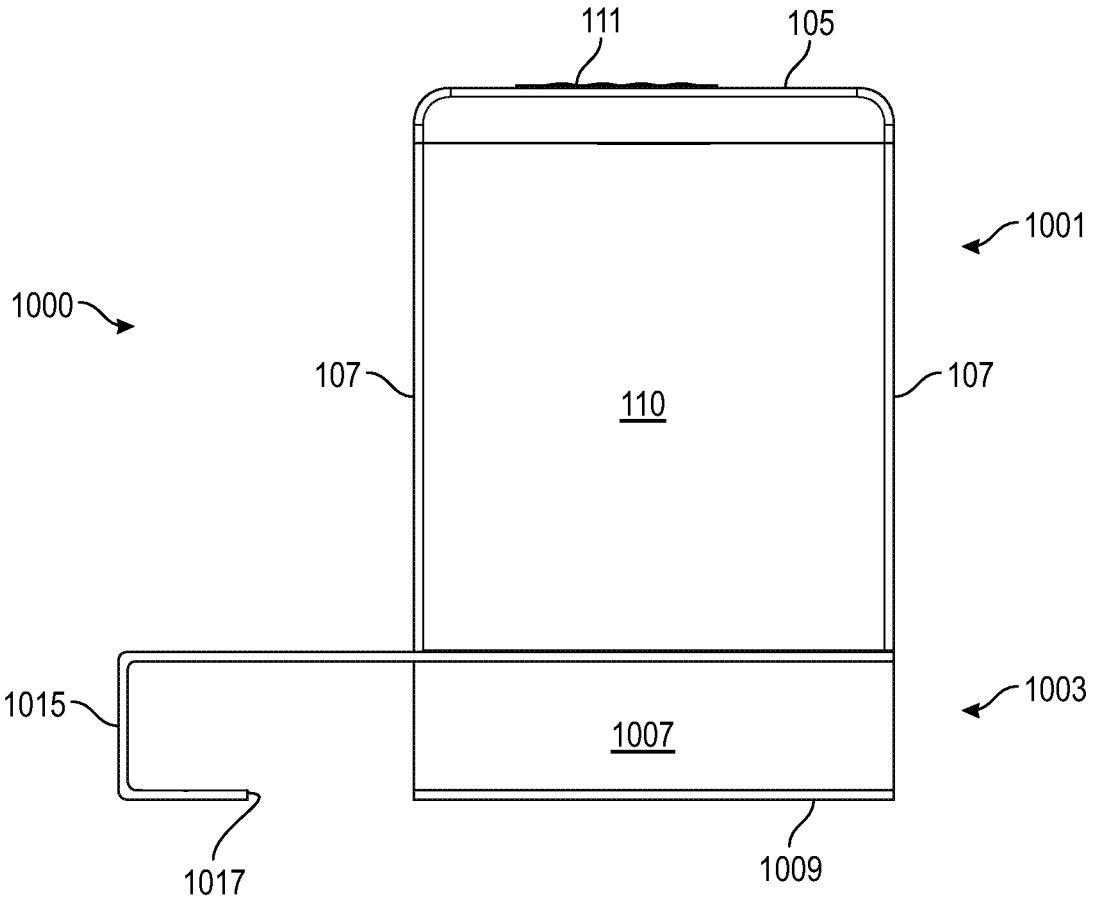
FIG. 10G may depict a bottom view of the configuration shown in FIG. 10A.
Figure 11:
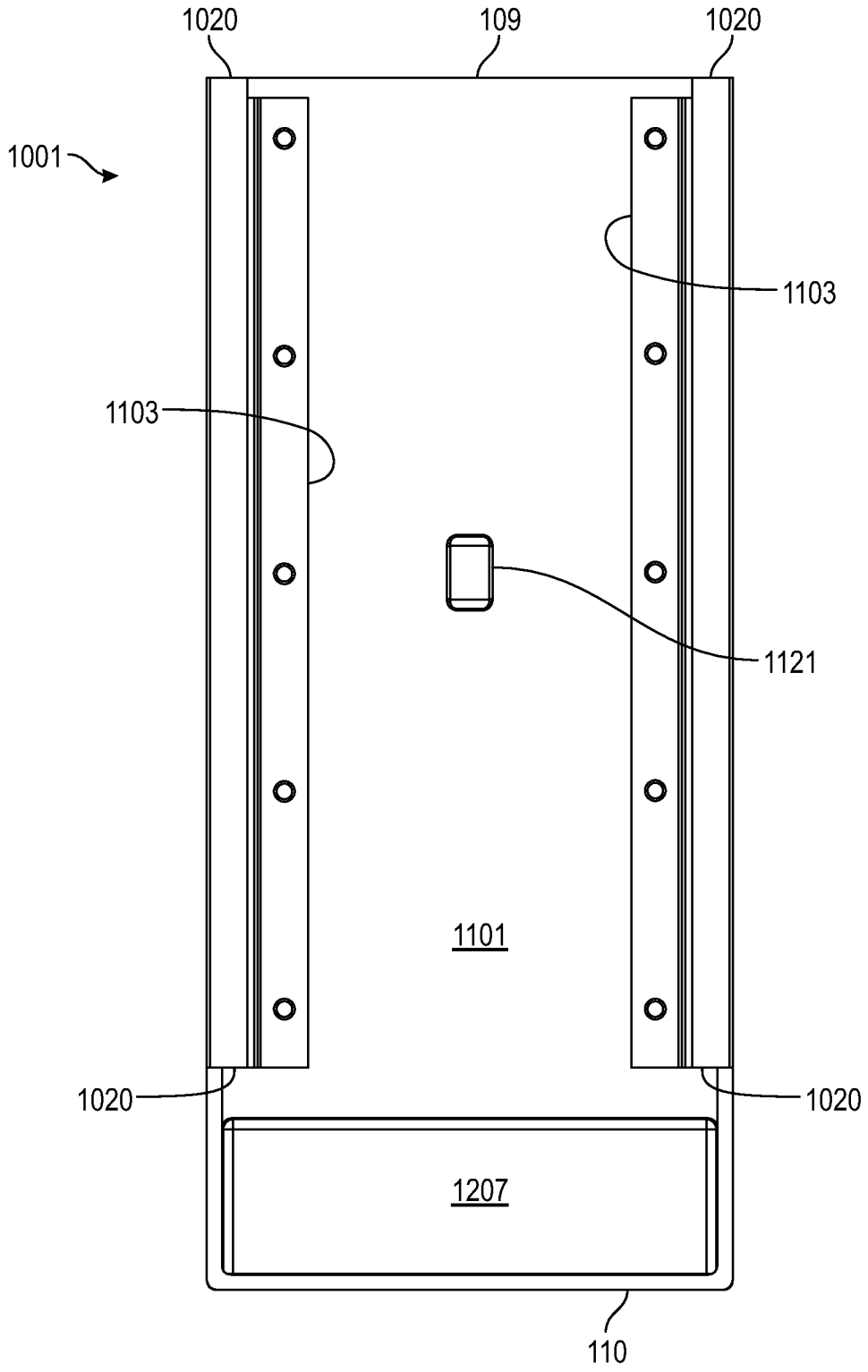
FIG. 11 may be a rear (back) view of a cabinet (without the door-attachment-hardware shown).
Figure 12A:
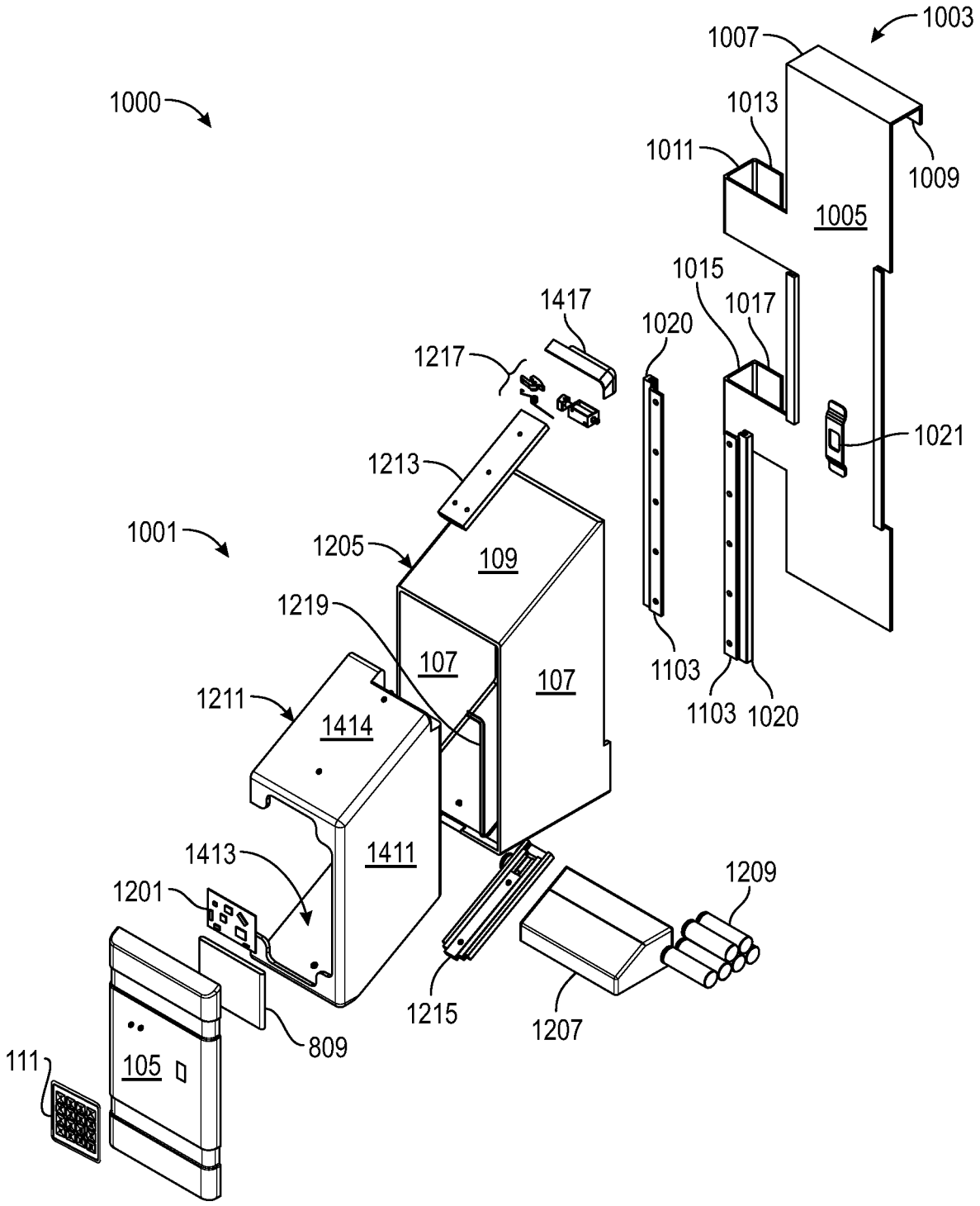
FIG. 12A may be an exploded perspective view of the medication-receiver shown in FIG. 10A.

Figures FIG. 10A through and including FIG. 10G may show various views of medication-receiver 1000, its cabinet 1001, and its door-attachment-hardware 1003. FIG. 10A may depict a top right perspective view of a medication-receiver 1000 with its cabinet in a process of being removably (slidingly) attached to door-attachment-hardware 1003. FIG. 10B may depict a front view of the configuration shown in FIG. 10A. FIG. 10C may depict a rear (back) view of the configuration shown in FIG. 10A. FIG. 10B and FIG. 10C may be opposing views with respect to each other. FIG. 10D may depict a left-side view of the configuration shown in FIG. 10A. FIG. 10E may depict a right-side view of the configuration shown in FIG. 10A. FIG. 10D and FIG. 10E may be opposing views with respect to each other. FIG. 10F may depict a top view of the configuration shown in FIG. 10A. FIG. 10G may depict a bottom view of the configuration shown in FIG. 10A. FIG. 10F and FIG. 10G may be opposing views with respect to each other. In figures FIG. 10A through and including FIG. 10G, the drawer-member 1211 of cabinet 1001 may be shown in its closed (shut) configuration. FIG. 11 may be a rear (back) view of cabinet 1001 (without door-attachment-hardware 1003 being shown). FIG. 12A (and FIG. 12B) may be an exploded perspective view of medication-receiver 1000 shown in FIG. 10A.

In some embodiments, medication-receiver 1000 may comprise two main components/assemblies: a cabinet 1001 and either door-attachment-hardware 1003 or mounting-plate 1601. Medication-receiver 1000 with cabinet 1001 and door-attachment-hardware 1003 may be shown in figures FIG. 10A through and including FIG. 12B, and in figures FIG. 15A through and including FIG. 15C. Whereas, medication-receiver 1000 with cabinet 1001 and with mounting-plate 1601 may be shown in figures FIG. 16A through and including FIG. 16C. In some embodiments, rear-wall 1101 of cabinet 1001 may be removably attached to either door-attachment-hardware 1003 or to mounting-plate 1601. In some embodiments, attachment-hardware 1003 or mounting-plate 1601 may be attached (removably so in some embodiments.) to door 190. See e.g., figures FIG. 15A, FIG. 15B, FIG. 15C, FIG. 16B, and FIG. 16C.

In some embodiments, cabinet 1001 may comprise a housing (enclosure) 1205, that houses a slide-out drawer (e.g., drawer-member 1211). In some embodiments, housing 1205 may comprise: two opposing sides, sides-of-cabinet 107 (see e.g., FIG. 10A, FIG. 10D, and FIG. 10E); a top, top-of-cabinet 109 (see e.g., FIG. 10A, FIG. 10B, and FIG. 10F); a back, rear-wall 1101 (see e.g., FIG. 11); a bottom, bottom-of-cabinet 110 (see e.g., FIG. 10G); and an open front for receiving drawer-member 1211 into an interior volume of housing 1205 (see e.g., FIG. 12A).

In some embodiments, top-of-cabinet 109 and bottom-of-cabinet 110 may be opposing surfaces of housing 1205. In some embodiments, housing 1205 may have two opposing substantially vertical side walls, sides-of-cabinet 107. In some embodiments, a front opening to housing 1205 may be opposing rear-wall 1101. In some embodiments, the two sides-of-cabinet 107 may be substantially parallel with each other. In some embodiments, the opening to housing 1205 for drawer-member 1211 may be substantially parallel with rear-wall 1101. In some embodiments, top-of-cabinet 109 and bottom-of-cabinet 110 may not be parallel. In some embodiments, bottom-of-cabinet 110 may be substantially parallel with a ground or floor of door 190. In some embodiments, bottom-of-cabinet 110 may be substantially parallel with top-of-door 192 and/or with bottom-of-door 195. In some embodiments, top-of-cabinet 109 may not be parallel with the ground or floor of door 190, top-of-door 192, and/or with bottom-of-door 195. Rather, top-of-cabinet 109 may run at a fixed and predetermined angle with respect to the ground or floor of door 190, top-of-door 192, and/or with bottom-of-door 195. (so as to be non-parallel). This fixed and predetermined angle may permit runoff of water, such as, rain, dew, snow, ice, and the like. In some embodiments, rear-wall 1101 may be substantially parallel with exterior-door-surface 191. In some embodiments, side-of-cabinet 107 may be substantially parallel with hinge-side 193 and/or with not-hinge-side 194. Note, comparisons in this paragraph between cabinet 1001 structures and door 190 and/or with the ground/floor of door 190, may be with respect to when cabinet 1001 may be attached to door 190.

In some embodiments, sides-of-cabinet 107, top-of-cabinet 109, bottom-of-cabinet 110, and rear-wall 1101 may substantially bound (enclose) an interior volume of housing 1205 for removably receiving drawer-member 1211. In some embodiments, the walls, floor, ceiling/roof (e.g., sides-of-cabinet 107, top-of-cabinet 109, bottom-of-cabinet 110, and/or rear-wall 1101) of housing 1205 may be formed such where these walls, floor, ceiling/roof connect to each other, that housing 1205 may be substantially free of gaps.

In some embodiments, front-of-drawer 105, sides-of-cabinet 107, top-of-cabinet 109, bottom-of-cabinet 110, and/or rear-wall 1101 may be one or more of: solid; structural-member; rigid; semi-rigid; weather proof; water proof; wind proof; insulated; shielded; with at least one ventilation aperture; with at least one port; with at least one electronic connection; combinations thereof; and/or the like.

In some embodiments, front-of-drawer 105, sides-of-cabinet 107, top-of-cabinet 109, bottom-of-cabinet 110, and/or rear-wall 1101 may comprise one or more: exterior-interface 111, fingerprint-scanner 401, keypad 403, first-I/O-means 405, second-I/O-means 407, I/O Means 807, light(s) 807*a*, combinations thereof, and/or the like.

In some embodiments, cabinet 101, cabinet 1001, and/or lower-compartment 1207 may meet or exceed standards and/or requirements for electronics housings/enclosure, such as for NEMA, UL, and/or the like.

In some embodiments, drawer-member 1211 may be a slide out drawer that may slide in and out of housing 1205. In some embodiments, drawer-member 1211 may have front-of-drawer 105 as a front face or front wall of drawer-member 1211. In some embodiments, when drawer-member 1211 may be closed (shut), front-of-drawer 105 may be the front of housing 1205, such that housing 1205 is entirely sealed (closed). See e.g., FIG. 10A, FIG. 14A, or FIG. 15A.

In some embodiments, when drawer-member 1211 slides out from housing 1205, front-of-drawer 105 may slide out with drawer-member 1211 away from housing 1205. See e.g., FIG. 14B, FIG. 15C, or FIG. 16C.

Figure 13:
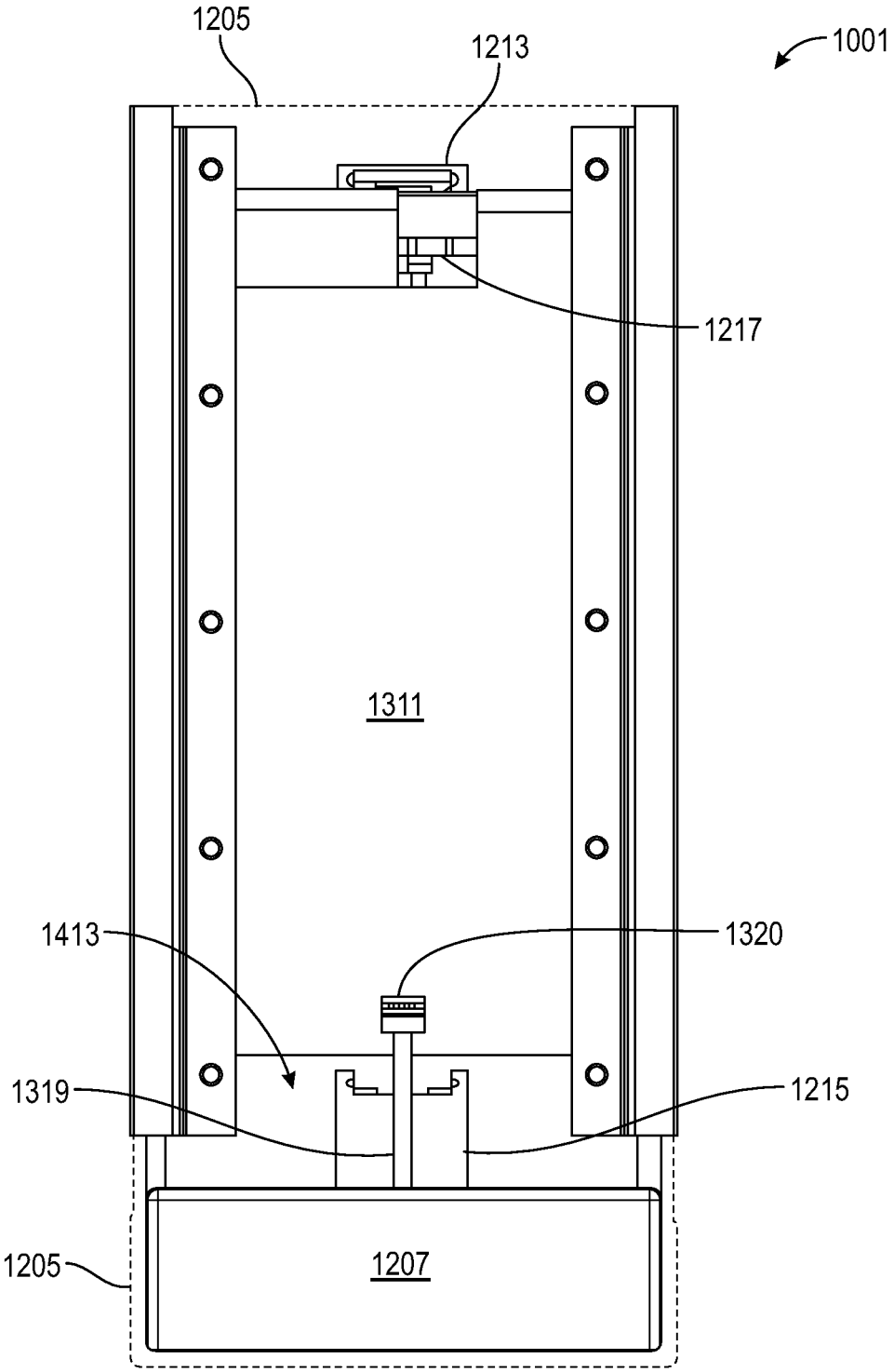
FIG. 13 may be a rear (back) view of a cabinet with its enclosure (housing) hidden/transparent so a rear-of-drawer-member may be seen.

In some embodiments, drawer-member 1211 may be five sided, with: front-of-drawer 105 (see e.g., FIG. 10A, FIG. 12A, and FIG. 14B); a drawer-side-wall 1411 (see e.g., FIG. 12A, FIG. 14A, and FIG. 14B); a drawer-floor 1413 (see e.g., FIG. 12A, FIG. 14A, and FIG. 14B); a drawer-roof (ceiling) 1414 (see e.g., FIG. 12A, FIG. 14A, and FIG. 14B); and a rear-of-drawer-member 1311 (see e.g., FIG. 13). In some embodiments, a sixth side, opposing drawer-side-wall 1411 may be substantially open to permit entry and exit of article(s) within drawer-member 1211 (see e.g., FIG. 12A).

In some embodiments, front-of-drawer 105, drawer-side-wall 1411, drawer-floor 1413, drawer-roof (ceiling) 1414, and/or rear-of-drawer-member 1311 may be one or more of: solid; structural-member; rigid; semi-rigid; weather proof; water proof; wind proof; insulated; shielded; with at least one ventilation aperture; with at least one port; with at least one electronic connection; combinations thereof; and/or the like.

In some embodiments, front-of-drawer 105 (and/or drawer-inside-front 1415), drawer-side-wall 1411, drawer-floor 1413, drawer-roof (ceiling) 1414, and/or rear-of-drawer-member 1311 may comprise one or more: processor 801, memory 803, I/O for External Communications 805, Power Supply 809, PCB 1201, power supply 1209, exterior-interface 111, fingerprint-scanner 401, keypad 403, first-I/O-means 405, second-I/O-means 407, I/O Means 807, light(s) 807*a*, combinations thereof, and/or the like.

Figure 14A:
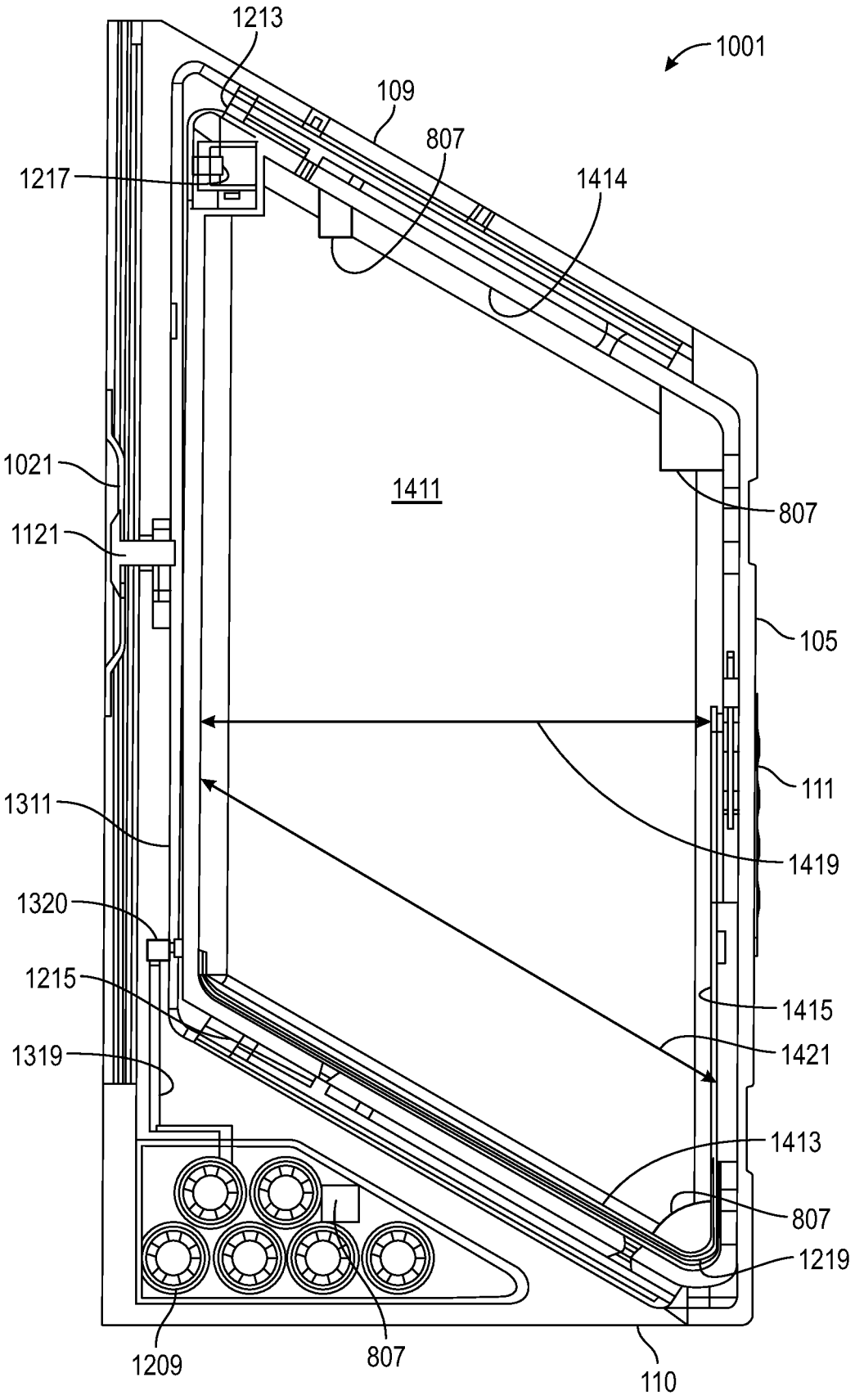
FIG. 14A may depict a longitudinal cross-section through about a middle of the medication-receiver of FIG. 10A, with a drawer-member shown closed (shut).

FIG. 14A may show two different ways of dimensioning a depth of drawer-member 1211, denoted as depth-of-drawer 1419 and depth-of-drawer 1421. In some embodiments, depth-of-drawer 1419 may run orthogonally from drawer-rear-wall 1311 to drawer-inside-front 1415. In some embodiments, drawer-inside-front 1415 may be an inside surface of front-of-drawer 105. In some embodiments, depth-of-drawer 1419 may run in parallel with drawer-floor 1413 between drawer-rear-wall 1311 and drawer-inside-front 1415. In some embodiments, depth-of-drawer 1419 and depth-of-drawer 1421 may not be parallel with each other.

In some embodiments, in order to help article(s) placed into drawer-member 1211 (e.g., on top of drawer-floor 1413) from unintentionally falling out, across the opening to drawer-member 1211, opposite of drawer-side-wall 1411, may be a bar and/or netting running in parallel with depth-of-drawer 1419 and/or with depth-of-drawer 1421. The bar and/or netting may only partially block the opening to drawer-member 1211.

Note, in some embodiments, the opening to drawer 201/1211 may be on one the side of drawer 201/1211 (e.g., opposite drawer-side-wall 1411) and not on a top, bottom, rear, or front of drawer 201/1211.

Figure 12B:
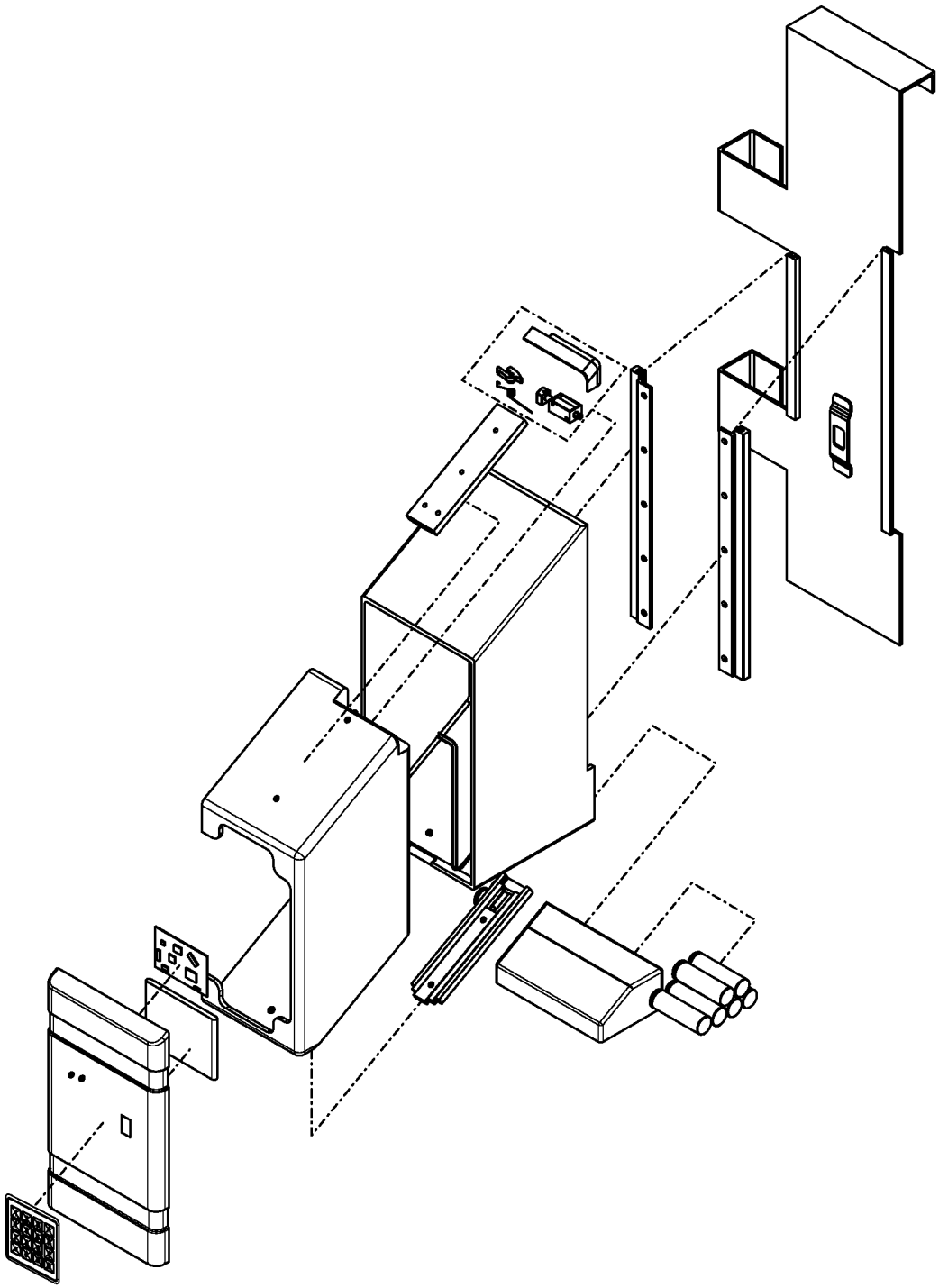
FIG. 12B may be an exploded perspective view of the medication-receiver shown in FIG. 10A. Note, FIG. 12B may be the same figure as FIG. 12A, except in FIG. 12B projection lines (as broken lines) may be shown that otherwise may have been too crowded to include in FIG. 12A.

In some embodiments, the opening to drawer 201/1211 may face away from side-bracket(s) 607/1011/1015. For example, and without limiting the scope of the present invention, such an embodiment could if the drawer-member 1211 of FIG. 12A and FIG. 12B was replaced with a mirror-image drawer-member 1211, with the opening to the drawer on the right side instead of on the left side as shown in FIG. 12A and FIG. 12B. In some embodiments, the opening to drawer 201/1211 may face away from hinge-side 193.

In some embodiments, within drawer-member 1211 may be one or more I/O Means 807. In some embodiments, these one or more I/O Means 807 within drawer-member 1211 may be one or more internal camera(s), motion detector(s), light(s), combinations thereof, and/or the like. In some embodiments, these one or more I/O Means 807 within drawer-member 1211 may be in electrical communication with one or more of processor 801, PCB 1201, combinations thereof, and/or the like. In some embodiments, these one or more I/O Means 807 within drawer-member 1211 may be located in an upper portion of drawer-member 1211. See e.g., FIG. 14A. In some embodiments, these one or more I/O Means 807 within drawer-member 1211 may be used to monitor, verify, and/or validate a status/condition of article(s) within drawer-member 1211.

In some embodiments, within drawer-member 1211 may be one or more I/O Means 807. In some embodiments, these one or more I/O Means 807 within drawer-member 1211 may be one or more heater/cooler, fan, temperature sensor, combinations thereof, and/or the like. In some embodiments, the heater/cooler may be a solid-state Peltier effect component and/or the like. In some embodiments, these one or more I/O Means 807 within drawer-member 1211 may be in electrical communication with one or more of processor 801, PCB 1201, combinations thereof, and/or the like. In some embodiments, these one or more I/O Means 807 within drawer-member 1211 may be located in anywhere within and/or on drawer-member 1211. See e.g., FIG. 14A. In some embodiments, these one or more I/O Means 807 within drawer-member 1211 may be used to heat or cool article(s) within drawer-member 1211.

In some embodiments, the communicative relationship between drawer-member 1211 and its housing 1205 may be a sliding relationship. In some embodiments, this sliding relationship may be facilitated by one or more rail systems/assemblies that operatively link drawer-member 1211 with 1205 in a sliding translation fashion. In some embodiments, cabinet 1001 may comprise at least one such rail system/assembly, such as, but not limited to, upper-rail-assembly 1213; and/or lower-rail-assembly 1215. See e.g., FIG. 12A, FIG. 14A, and FIG. 14B. In some embodiments, upper-rail-assembly 1213 may be disposed between top-of-cabinet 109 and drawer-roof 1414. In some embodiments, a portion of upper-rail-assembly 1213 may be attached to an underside of top-of-cabinet 109; and a different portion of upper-rail-assembly 1213 may be attached to a top of drawer-roof 1414. See e.g., FIG. 14A, and FIG. 14B. In some embodiments, lower-rail-assembly 1215 may be disposed between bottom-of-cabinet 110 and drawer-floor 1413. In some embodiments, a portion of lower-rail-assembly 1215 may be attached to a lower portion of housing 1205; and a different portion of lower-rail-assembly 1215 may be attached to a bottom of drawer-floor 1413. See e.g., FIG. 14A, and FIG. 14B. In some embodiments, when drawer-member 1211 may be extended out (e.g., slid out and/or open) from housing 1205, upper-rail-assembly 1213 and/or lower-rail-assembly 1215 may structurally support (in a cantilever fashion) a weight (load) of drawer-member 1211 and its article(s). See e.g., FIG. 14B. In some embodiments, upper-rail-assembly 1213 and/or lower-rail-assembly 1215 may be elongate members, with rails, slots, ball bearings, and attachment/mounting hardware.

In some embodiments, drawer 201/1211 may be slidingly attached to the housing (e.g., 1205) of cabinet 101/1001 by at least one rail subassembly (e.g., 211, 609, 1213, and/or 1215), wherein the at least one rail subassembly may be in physical contact with both drawer 201/1211 and with the housing of cabinet 101/1001. In some embodiments, the at least one rail subassembly (e.g., 1213 and/or 1215) may be located beneath a floor of the drawer (e.g., drawer-floor 1413) and above a bottom (e.g., bottom-of-cabinet 110) of the housing of cabinet 1001. In some embodiments, the at least one rail subassembly (e.g., 1213 and/or 1215) may be located above a roof of the drawer (e.g., drawer-roof 1414) and beneath a top (e.g., top-of-cabinet 109) of the housing of cabinet 1001. In some embodiments, the at least one rail subassembly may comprise an upper rail subassembly 1213 and a lower rail subassembly 1215. In some embodiments, lower rail subassembly 1215 may be located beneath a floor of the drawer (e.g., drawer-floor 1413) and above a bottom (e.g., bottom-of-cabinet 110) of the housing of cabinet 1001; and upper rail subassembly 1213 may be located above a roof of the drawer (e.g., drawer-roof 1414) and beneath a top (e.g., top-of-cabinet 109) of the housing of cabinet 1001. See e.g., FIG. 12A, FIG. 14A and/or FIG. 14B. In some embodiments, when cabinet 101/1001 may be in the unlocked configuration, the at least one rail subassembly (e.g., 211, 609, 1213, and/or 1215) may provide cantilever structural support to drawer 201/1211 that may be extended from the housing of cabinet 101/1001.

In some embodiments, drawer-member 1211, via upper-rail-assembly 1213 and/or lower-rail-assembly 1215, may extend/slide outwards and downwards away from housing 1205 such that a portion of drawer-floor 1413 may be below bottom-of-cabinet 110. See e.g., FIG. 14B. This may facilitate ease of loading and/or unloading drawer-member 1211 with article(s) when medication-receiver 1000 may be mounted to (attached to) door 190 above the door's door knob/handle as shown in FIG. 15B, FIG. 15C, FIG. 16B, and FIG. 16C.

Figure 14B:
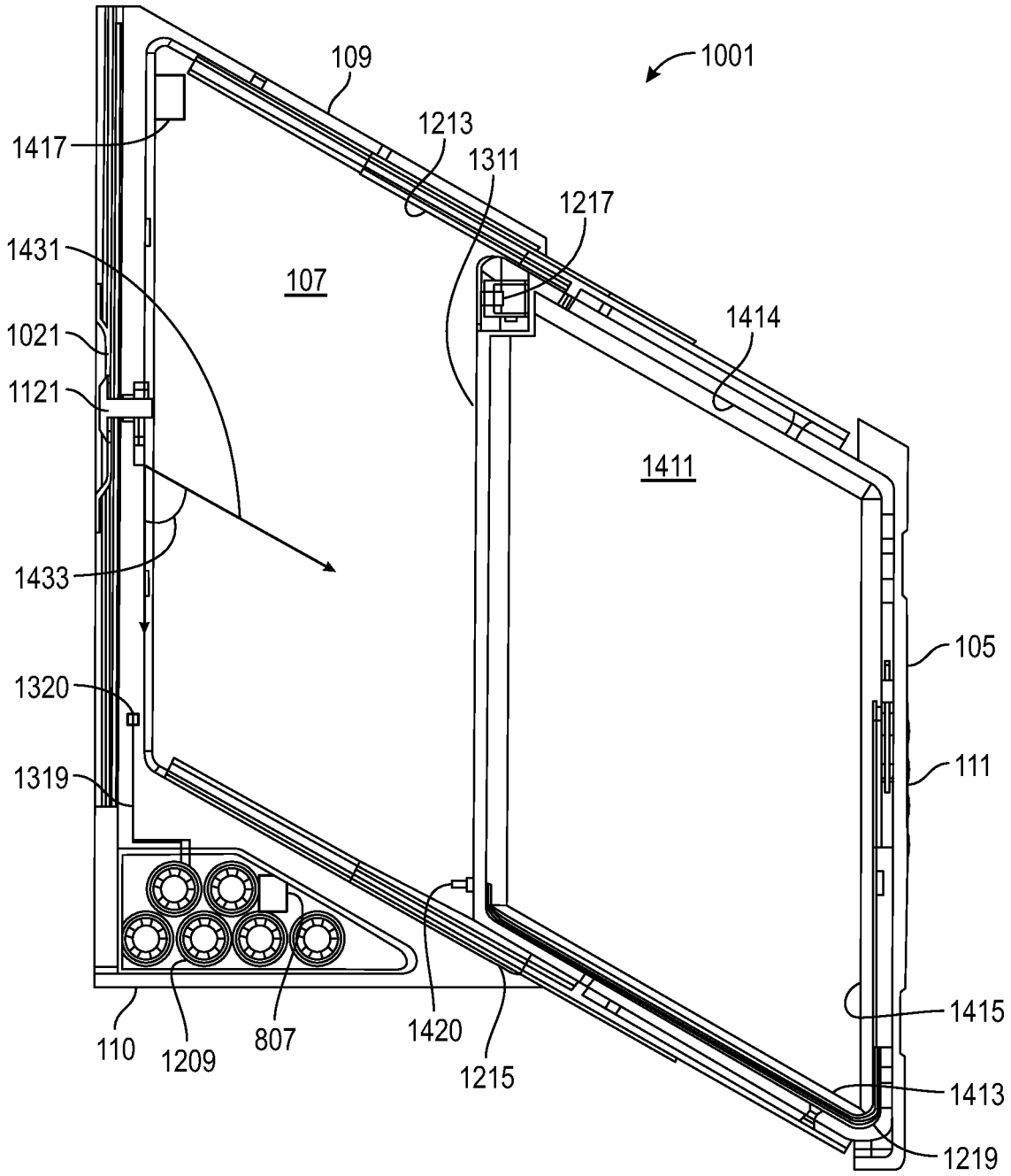
FIG. 14B may depict a longitudinal cross-section through about a middle of the medication-receiver of FIG. 10A, with the drawer-member shown open (out.)

A comparison between FIG. 14A and FIG. 14B shows the downward sliding of drawer-member 1211 out from housing 1205 is within a single plane that may be parallel with drawer-floor 1413 (or parallel with drawer-roof 1414); as opposed to drawer-member 1211 first sliding outwards parallel with bottom-of-cabinet 110 or parallel with the ground/floor and then drawer-member 1211 moving down towards the ground/floor. Opening downwards sliding mechanics of drawer-member 1211 sliding out from housing 1205 within the single plane that may be parallel with drawer-floor 1413 (or parallel with drawer-roof 1414) may then be naturally facilitated by normal Earth gravity.

In some embodiments, the sliding mechanics between the housing of cabinet 101/1001 and drawer 201/1211 may be such that transitions between the locked configuration and the unlocked configuration move back and forth in a single linear line. See e.g., direction-of-sliding 1431 in FIG. 14B. In some embodiments, this single linear line (direction-of-sliding 1431) may be at an angle 1433 from a major plane of the rear of the cabinet (e.g., rear-wall 1101 or rear-of-drawer-member 1311) to at least one rail subassembly of cabinet 101/1001, wherein this angle 1433 may be less than ninety degrees and greater than zero degrees such that drawer 201/1211 opens downwards with respect to the housing of cabinet 101/1001. For a given embodiment, angle 1433 may be fixed (non-variable) and predetermined. In some embodiments, angle 1433 may be from 30 degrees to 70 degrees. In some embodiments, the downwards opening of drawer 201/1211 may not be perfectly vertical, nor perfectly horizontal, with respect to the horizontal ground below door 190. In some embodiments, the downwards opening of drawer 201/1211 may not be parallel with rear-wall 1101 (in which case angle 1433 would be zero degrees), nor orthogonal with rear-wall 1101 (in which case angle 1433 would be ninety degrees).

Figure 15A:
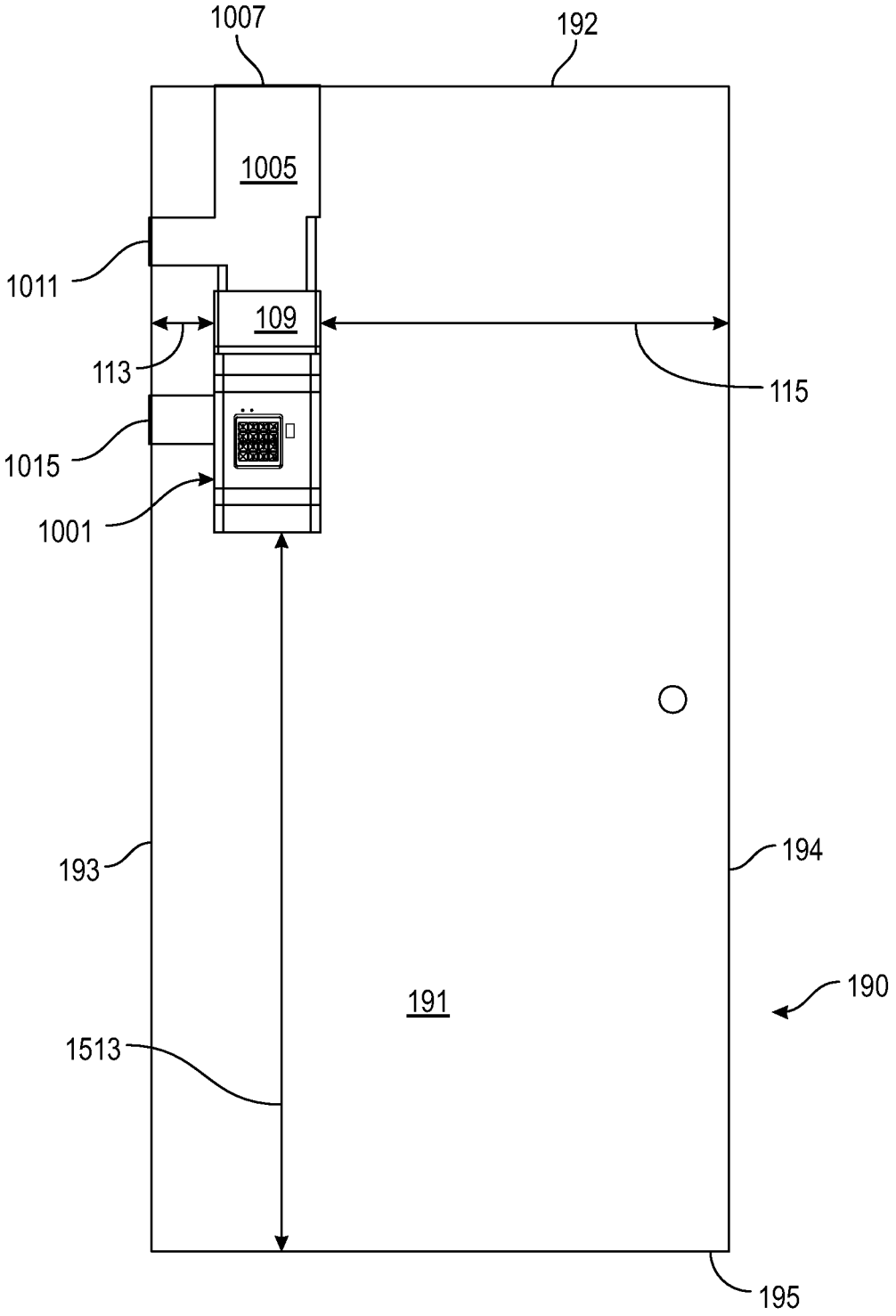
FIG. 15A may depict the medication-receiver of FIG. 10A, shown with its drawer-member closed (shut) and shown while the medication-receiver is removably attached to a front of a door, all shown from a front view.
Figure 15B:
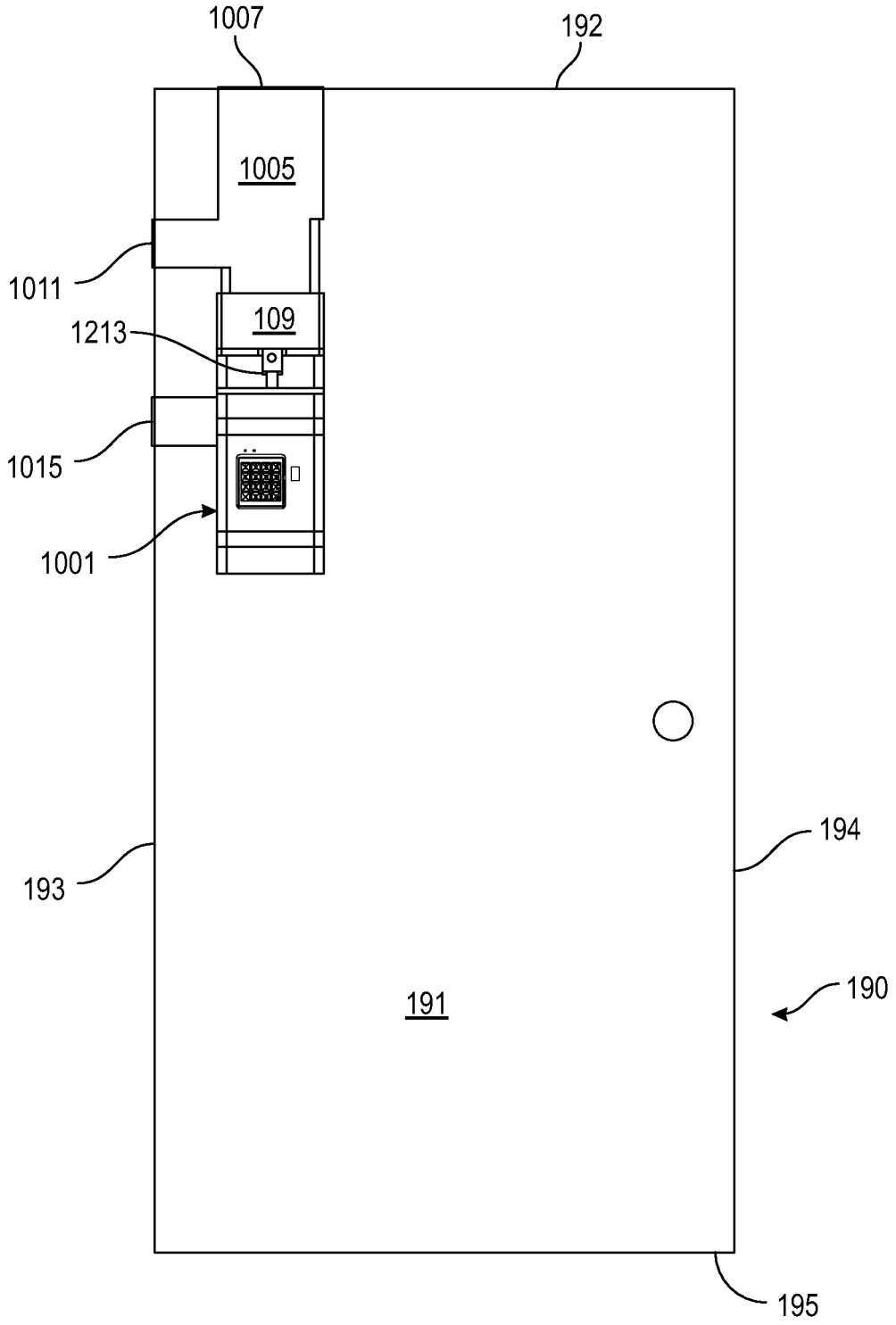
FIG. 15B may the same view and scenario as in FIG. 15A, except in FIG. 15B the drawer-member may be open (out).
Figure 15C:
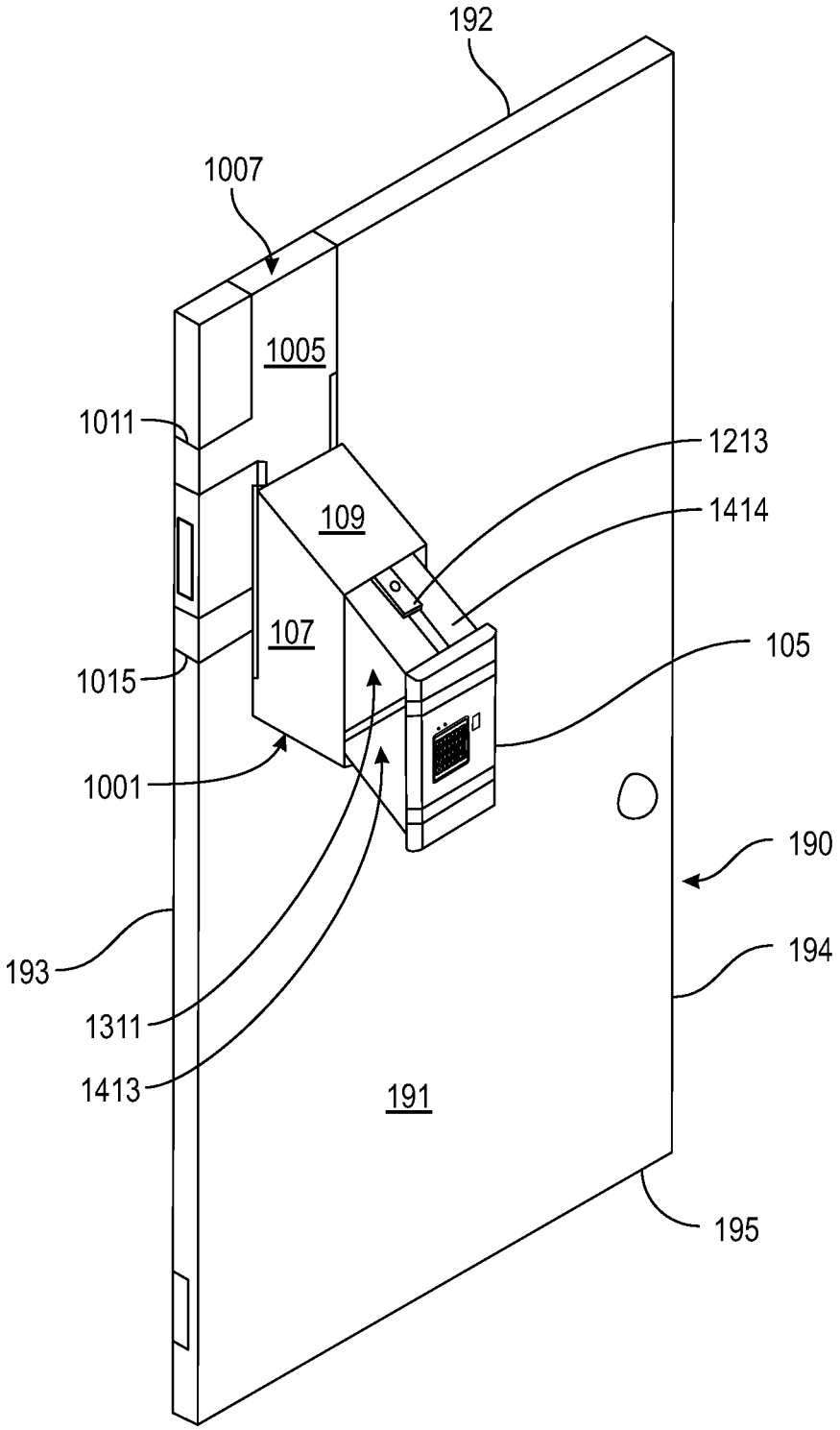
FIG. 15C may be the same scenario as in FIG. 15B (drawer open), but shown from a front perspective view.

In some embodiments, when drawer-member 1211 may be closed (shut and/or slid into housing 1205), 1211 may be locked to housing 1205, such as in shown in figures FIG. 10A through FIG. 10G, FIG. 14A, and in FIG. 15A. In some embodiments, 1211 may comprise a locking means; and housing 1205 may comprise a complimentary locking means that permits removable and repeatable locking between this locking means and the complimentary locking means. In some embodiments, the locking means and the complimentary locking means may be types of I/O Means 807. In some embodiments, the locking means and complimentary locking means may be one or more of: electronically powered, electronic lock, magnetic lock, solenoid, servo motor, bolt and bolt-receiver, combinations thereof, and/or the like. In some embodiments, when top-of-cabinet 105 and/or drawer-member 1211 may be slid up into housing 1205, the locking means and the complimentary locking means may engage to the locked configuration. Such locking engagement may be communicated to the user by sound, by light(s), and/or by feel. Unlocking may be accomplished by processor 801 (e.g., PCB 1201) of cabinet 1001 receiving an authorized, approved, and/or validated unlock/open communication, and then disengaging the locking means/complimentary locking means. In some embodiments, the locking means and/or the complimentary locking means may be electrically, optically, and/or operatively linked to processor 801 (e.g., PCB 1201) of cabinet 1001. In some embodiments, the unlock/open communication may be receipt of: a proper passcode; a proper password; a proper biometric input (e.g., fingerprint scan, face or eye scan, voice recognition, etc.); a proper RF signal; a proper NFC signal; a proper RFID signal; a proper IR signal; combinations thereof; and/or the like. Such unlocking may be communicated to the user: by drawer-member 1211 sliding/extending outwards, by sound, by light(s), and/or by feel.

In some embodiments, the locking means may be lock-assembly 1217, see e.g., FIG. 12A, FIG. 13, FIG. 14A, and FIG. 14B. In some embodiments, lock-assembly 1217 may be located at least partially in an upper rear portion of drawer-member 1211 as shown in FIG. 14A and FIG. 14B. In some embodiments, lock-assembly 1217 may be electrically and/or operatively linked to processor 801 (e.g., PCB 1201) of cabinet 1001. In some embodiments, lock-assembly 1217 may be electrically powered by Power Supply 809, power supply 1209, combinations thereof, and/or the like.

In some embodiments, the complimentary locking means may be lock-receiver 1417, see e.g., FIG. 14B. In some embodiments, lock-receiver 1417 may be located in an upper rear portion of housing 1205, such that when drawer-member 1211 may be closed (slid in), at least portions of lock-receiver 1417 and at least portions of lock-assembly 1217 may be removably attached to each other, providing the locking function. In some embodiments, lock-receiver 1417 may provide a point of attachment and/or a point of anchor for at least a portion of lock-assembly 1217. In some embodiments, lock-assembly 1217 may comprise a movable bolt and/or hook, that when electrically engaged may catch on lock-receiver 1417. See e.g., FIG. 13, FIG. 14A and FIG. 14B.

In some embodiments, the positions (locations) of lock-assembly 1217 and lock-receiver 1417 may be switched;

that is, lock-assembly 1217 may be located in an upper rear portion of housing 1205 and lock-receiver 1417 may be located in an upper rear portion of drawer-member 1211, such that when drawer-member 1211 may be closed (slid), at least portions of lock-receiver 1417 and at least portions of lock-assembly 1217 may be removably attached to each other, providing the locking function.

In some embodiments, medication-receiver 100/1000 may comprise lock-assembly 1217 and lock-receiver 1417. In some embodiments, lock-assembly 1217 may be located in an upper rear portion of drawer-member 1211, wherein lock-receiver 1417 may be located in an upper rear portion of housing 1205. In some embodiments, at least a portion lock-assembly 1217 may be configured to removably physically engage at least a portion of lock-receiver 1417 during the locked configuration to lock drawer-member 1211 to housing 1205. In some embodiments, lock-assembly 1217 may be operatively and/or electronically linked with processor 801 and/or with PCB 1201. In some embodiments, processor 801 and/or with PCB 1201 may control locking and/or unlocking of lock-assembly 1217.

In some embodiments, housing 1205 may comprise a lower-compartment 1207 located below (underneath) at least a portion of drawer-member 1211 when drawer-member 1211 may be closed. See e.g., FIG. 14A and FIG. 14B. In some embodiments, lower-compartment 1207 may comprise one or more electrical components and/or computer hardware elements. In some embodiments, lower-compartment 1207 may house one or more electrical components and/or computer hardware elements.

In some embodiments, cabinet 101/1001 may comprise lower-compartment 1207. In some embodiments, lower-compartment 1207 may be located substantially within housing 1205, wherein lower-compartment 1207 may be further located at a lower rear portion of housing 1205, wherein when cabinet 101/1001 may be in the locked configuration lower-compartment 1207 may be located substantially beneath drawer 201/1211. See e.g., FIG. 14A. In some embodiments, substantially within lower-compartment 1207 may be at least one electronic hardware component. In some embodiments, this at least one electronic hardware component may be selected from one or more of: processor 801, memory 803, I/O for External Communications 805, I/O Means 807, light 807*a*, power supply 809, GPS 811, PCB 1201, power supply 1209, combinations thereof, and/or the like.

In some embodiments, lower-compartment 1207 may comprise one or more of: processor 801, memory 803, I/O for External Communications 805, Power Supply 809, PCB 1201, power supply 1209, exterior-interface 111, fingerprint-scanner 401, keypad 403, first-I/O-means 405, second-I/O-means 407, I/O Means 807, light(s) 807*a*, combinations thereof, and/or the like.

In some embodiments, lower-compartment 1207 may house one or more of: processor 801, memory 803, I/O for External Communications 805, Power Supply 809, PCB 1201, power supply 1209, exterior-interface 111, fingerprint-scanner 401, keypad 403, first-I/O-means 405, second-I/O-means 407, I/O Means 807, light(s) 807*a*, combinations thereof, and/or the like.

In some embodiments, within lower-compartment 1207 may be one or more I/O Means 807. In some embodiments, these one or more I/O Means 807 within lower-compartment 1207 may be one or more heater/cooler, fan, temperature sensor, portions thereof, combinations thereof, and/or the like. In some embodiments, the heater/cooler may be a solid-state Peltier effect component and/or the like. In some embodiments, these one or more I/O Means 807 within lower-compartment 1207 may be in electrical communication with one or more of processor 801, PCB 1201, combinations thereof, and/or the like. In some embodiments, these one or more I/O Means 807 within lower-compartment 1207 may be located in anywhere within and/or on lower-compartment 1207. See e.g., FIG. 14A. In some embodiments, these one or more I/O Means 807 within lower-compartment 1207 may be used to heat or cool article(s) within drawer-member 1211.

In some embodiments, electrical components in lower-compartment 1207 may be wired to electrical components in/on drawer-member 1211 via wiring 1219, complimentary-wiring 1319, electrical-connector 1320, and/or complimentary-connector 1420. See e.g., FIG. 12A, FIG. 13, FIG. 14A, and FIG. 14B. In some embodiments, wiring 1219 may be at least partially attached to drawer-member 1211, such that when drawer-member 1211 slidingly translates, wiring 1219 moves along with drawer-member 1211. In some embodiments, wiring 1219 may be in, on, and/or under at least a portion of drawer-floor 1413, drawer-side-wall 1411, and/or front-of-drawer 105. At a rear of drawer-member 1211, wiring 1211 may terminate in complimentary-connector 1420. In some embodiments, complimentary-wiring 1319 may run from at least one electrical component in lower-compartment 1207 to electrical-connector 1320. In some embodiments, complimentary-wiring 1319 and electrical-connector 1320 may be located in housing 1205. In some embodiments, electrical-connector 1320 may be located in a rear internal portion of housing 1205. In some embodiments, electrical-connector 1320 and complimentary-connector 1420 may be configured to removably attach to each other to permit a functional electrical connection between wiring 1219 and complimentary-wiring 1319. In some embodiments, when drawer-member 1211 may be closed (slid in) to housing 1205, electrical-connector 1320 and complimentary-connector 1420 may be removably attached to each other permitting the functional electrical connection between wiring 1219 and complimentary-wiring 1319.

In some embodiments, when drawer-member 1211 may be open (slid out) from housing 1205, electrical-connector 1320 and complimentary-connector 1420 may intentionally become disengaged; and may intentionally reengage when drawer-member 1211 may be closed.

For example, and without limiting the scope of the present invention, in some embodiments, when drawer-member 1211 may be closed (slid in) to housing 1205, electrical-connector 1320 and complimentary-connector 1420 may be removably attached to each other permitting power supply 1209 to power (charge) Power Supply 809.

Figure 17:
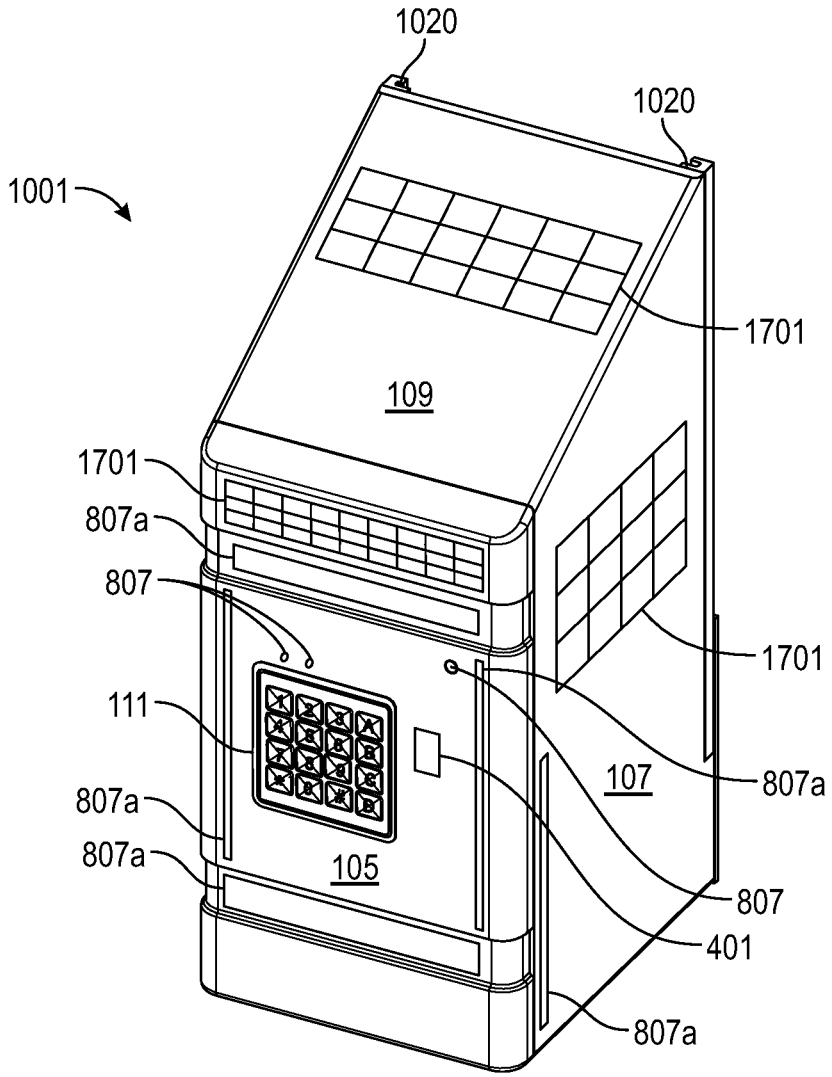
FIG. 17 may depict a perspective view of a cabinet with one or more solar panels and/or one or more I/O (input/output) components/means.

FIG. 17 may depict a perspective view of cabinet 1001 with one or more solar-panels 1701 and/or one or more I/O Means 807. In some embodiments, front-of-drawer 105, side-of-cabinet 107, and/or top-of-cabinet 109, may have one or more solar-panels 1701. In some embodiments, one or more solar-panels 1701 may be located on an exterior surface of cabinet 1001. In some embodiments, one or more solar-panels 1701 may be electrically and/or operatively linked to one or more of: exterior-interface 111, fingerprint-scanner 401, keypad 403, first-I/O-means 405, second-I/O-means 407, processor 801, memory 803, I/O for External Communications 805, I/O Means 807, light(s) 807*a*, Power Supply 809, GPS 811, PCB 1201, power supply 1209, lock-assembly 1217, combinations thereof, and/or the like. In some embodiments, one or more solar-panels 1701 may power one or more of: exterior-interface 111, fingerprint-scanner 401, keypad 403, first-I/O-means 405, second-I/O-means 407, processor 801, memory 803, I/O for External Communications 805, I/O Means 807, light(s) 807*a*, Power Supply 809, GPS 811, PCB 1201, power supply 1209, lock-assembly 1217, combinations thereof, and/or the like.

In some embodiments, front-of-drawer 105, side-of-cabinet 107, and/or top-of-cabinet 109, may have one or more I/O Means 807. In some embodiments, one or more I/O Means 807 may be located on an exterior surface of cabinet 1001. See e.g., FIG. 17.

In some embodiments, front-of-drawer 105, side-of-cabinet 107, and/or top-of-cabinet 109, may have one or more light(s) 807*a*. In some embodiments, one or more light(s) 807*a* may be located on an exterior surface of cabinet 1001. See e.g., FIG. 17.

In some embodiments, cabinet 1001 (and cabinet 101) may be intended for use by attaching to (mounting to) some substantially vertical structure of a building and/or some fence and/or wall like structure(s) associated with real property. These structures may be doors (e.g., door 190), gates, walls, fences, combinations thereof, and/or the like. See e.g., figures FIG. 1A through FIG. 3, FIG. 15B, FIG. 15C, FIG. 16B, and FIG. 16C for door 190. In some embodiments, the given cabinet (e.g., cabinet 1001 and/or cabinet 101) may be attached (removably so in some embodiments) to a given mounting-means; and in turn, this mounting-means may then be attached to (removably so in some embodiments) the given substantially vertical structure of a building and/or some fence and/or wall like structure(s) associated with real property, such as, but not limited to door 190 and/or a wall. As previously noted, door 190 may be an exterior hinged swing door to a building and/or may be a gate in a wall and/or a gate in a fence. In some embodiments, this mounting-means may be selected from: door-attachment-hardware 103 (see e.g., FIG. 1A), door-attachment-hardware 603 (see e.g., FIG. 6), door-attachment-hardware 1003 (see e.g., FIG. 10A), and/or mounting-plate 1601 (see e.g., FIG. 16A).

In some embodiments, door-attachment-hardware 103, door-attachment-hardware 603, door-attachment-hardware 1003, and/or mounting-plate 1601 may be attached to a back (rear) (e.g., rear-wall 1101 and back-side-of-cabinet 507) of the given cabinet (e.g., cabinet 1001 and/or cabinet 101).

In some embodiments, door-attachment-hardware 103, door-attachment-hardware 603, door-attachment-hardware 1003, and/or mounting-plate 1601 may be removably attached to a back (rear) (e.g., rear-wall 1101 and back-side-of-cabinet 507) of the given cabinet (e.g., cabinet 1001 and/or cabinet 101).

In some embodiments, door-attachment-hardware 103, door-attachment-hardware 603, door-attachment-hardware 1003, and/or mounting-plate 1601 may be attached to door 190.

In some embodiments, door-attachment-hardware 103, door-attachment-hardware 603, door-attachment-hardware 1003, and/or mounting-plate 1601 may be removably attached to door 190.

In some embodiments, door-attachment-hardware 103, door-attachment-hardware 603, door-attachment-hardware 1003, and/or mounting-plate 1601 may be: with at least one top bracket; with at least one side bracket; substantially planar; mostly planar; substantially flat; mostly flat; substantially rigid; rigid; a structural member; a load bearing member; substantially made of metal; substantially made of carbon fiber; substantially made of plastic; substantially made of plastic with filler(s) (such as, but not limited to, glass fillers, carbon fiber fillers, combinations thereof, and/or the like); combinations thereof, and/or the like.

In some embodiments, door-attachment-hardware 1003 may be comprised of main-planar-member 1005. In some embodiments, main-planar-member 1005 may be a substantially planar member. In some embodiments, main-planar-member 1005 may be a substantially flat member. In some embodiments, main-planar-member 1005 may be a substantially rectangular prism member. In some embodiments, main-planar-member 1005 may be substantially rigid. In some embodiments, main-planar-member 1005 may be a rigid member. In some embodiments, main-planar-member 1005 may be longer than wide. In some embodiments, main-planar-member 1005 may be about as wide as cabinet 1001 (or about as wide as cabinet 101). In some embodiments, main-planar-member 1005 may be less wide as compared to cabinet 1001 (or less wide as compared to cabinet 101). In some embodiments, main-planar-member 1005 may be about as wide as rear-wall 1101. In some embodiments, main-planar-member 1005 may be less wide as compared to rear-wall 1101. In some embodiments, main-planar-member 1005 may be a substantially elongate member. In some embodiments, main-planar-member 1005 may be longer than rear-wall 1101. In some embodiments, main-planar-member 1005 may be a structural member. In some embodiments, main-planar-member 1005 may be load bearing member. In some embodiments, main-planar-member 1005 may have fixed width. In some embodiments, main-planar-member 1005 may different, but fixed, widths. In some embodiments, main-planar-member 1005 may have a fixed length. In some embodiments, main-planar-member 1005 may be substantially constructed from one or more of: metal, plastic, carbon fiber, plastic with filler, combinations thereof, and/or the like. In some embodiments, main-planar-member 1005 may be attached to rear-wall 1101. In some embodiments, main-planar-member 1005 may be removably attached to rear-wall 1101. See e.g., figures FIG. 10A through and including, FIG. 10G.

In some embodiments, running along at least an outer portion of main-planar-member 1005, in parallel with a length of main-planar-member 1005, may be a pair of opposing rails 1019. See e.g., figures FIG. 10A through and including, FIG. 10F.

In some embodiments, rear-wall 1101 may comprise a pair of opposing slots 1020 (slots-for-rails 1020). In some embodiments, the at least the portion of door-attachment-hardware 1003/1601 may comprises a pair of opposing rails 1019/1619. In some embodiments, the pair of opposing slots 1020 may removably receive the pair of opposing rails 1019/1619 such that the at least the portion of the door attachment hardware 1003/1601 may be slidingly attached to rear-wall 1101 (i.e., the rear of the cabinet/housing).

In some embodiments, a given rail 1019 may be configured to complimentary fit to a given slot-for-rail 1020. In some embodiments, slot-for-rail 1020 may be an elongate slot member, with a slot. In some embodiments, at least a portion of a given rail 1019 may be slidingly coupled to a given slot-for-rail 1020. In some embodiments, at least a portion of a given rail 1019 may be attached to at least a portion of a given slot-for-rail 1020. In some embodiments, at least a portion of a given rail 1019 may be removably attached to at least a portion of a given slot-for-rail 1020. In some embodiments, at least a portion of a given rail 1019 may be slidingly attached to at least a portion of a given slot-for-rail 1020. In some embodiments, at least a portion of a given rail 1019 may be removably and slidingly attached to at least a portion of a given slot-for-rail 1020. See e.g., FIG. 10A, FIG. 10C, FIG. 10D, FIG. 10E, and FIG. 10F.

In some embodiments, cabinet 1001 may comprise at least one slot-for-rail 1020. In some embodiments, cabinet 1001 may comprise a pair of opposing slots-for-rails 1020. In some embodiments, rear-wall 1101 may comprise at least one slot-for-rail 1020. In some embodiments, rear-wall 1101 may comprise a pair of opposing slots-for-rails 1020. In some embodiments, the pair of opposing slots-for-rails 1020 may be located along at least a portion of rear-wall 1101, separated by about a width of rear-wall 1101, running in parallel with a length of rear-wall 1101. See e.g., FIG. 10A, FIG. 10C, FIG. 10D, FIG. 10E, and FIG. 10F.

In some embodiments, a given slot-for-rail 1020 may be attached to rear-wall 1101 via reinforcement-member 1103. In some embodiments, reinforcement-member 1103 may be attached to rear-wall 1101. In some embodiments, running along a length of slot-for-rail 1020 may be reinforcement-member 1103. In some embodiments, reinforcement-member 1103 may face away from the slot opening of slot-for-rail 1020. In some embodiments, reinforcement-member 1103 may be an elongate member. In some embodiments, reinforcement-member 1103 may be a strip. In some embodiments, reinforcement-member 1103 may be a structural member. In some embodiments, reinforcement-member 1103 may be a loading bearing member. In some embodiments, reinforcement-member 1103 may be flat. In some embodiments, reinforcement-member 1103 may be rigid. In some embodiments, reinforcement-member 1103 may be planar. In some embodiments, reinforcement-member 1103 may be substantially constructed of one or more of: metal, plastic, plastic with filler, combinations thereof, and/or the like. In some embodiments, reinforcement-member 1103 may be attached to rear-wall 1101 by one or more of: mechanical fastener, welding, heat welding, ultrasonic welding, solvent bonding, adhesive, chemical adhesive, combinations thereof, and/or the like. See e.g., FIG. 11.

In some embodiments, the locations of rails 1019 and slots-for-rails 1020 may be switched; that is, rails 1019 may be attached to rear-wall 1101 and slots-for-rails 1020 may be part of main-planar-member 1005.

In some embodiments, sliding translation between rails 1019 and slots-for-rails 1020 may be stopped, locked, and/or fixed once rails 1019 have been sufficiently slid into slots-for-rails 1020. In some embodiments, this may be accomplished by either the tops or the bottoms of slots-for-rails 1020 being closed to act as stops. In some embodiments, this may be accomplished by either the tops or the bottoms of rails 1019 having tabs to act as stops. In some embodiments, this may be accomplished by main-planar-member 1005 having a stop 1021 (e.g., FIG. 10A) and rear-wall 1101 having a complimentary-stop 1121 (e.g., FIG. 11), such that when rails 1019 have been sufficiently slid into slots-for-rails 1020, stop 1021 engages with complimentary-stop 1121. In some embodiments, stop 1021 may be a hole; and complimentary-stop 1121 may be protrusion configured to fit at least partially within this hole of stop 1021. In some embodiments, stop 1021 may be located in about a middle region/portion of main-planar-member 1005. In some embodiments, complimentary-stop 1121 may be located in about a middle region/portion of rear-wall 1101. See e.g., FIG. 11 and FIG. 12A.

In some embodiments, the sliding attachment between the rear of the cabinet (e.g., rear-wall 1101) and the at least the portion of the door attachment hardware 1003/1601 may be stopped by a stop 1021/1621 located on door attachment hardware 1003/1601 physically engaging a complimentary-stop 1121 on the rear of the cabinet (e.g., rear-wall 1101).

In some embodiments, a top of main-planar-member 1005 may extend into a top-bracket 1007, wherein main-planar-member 1005 and top-bracket 1007 are substantially orthogonal to each other. In some embodiments, top-bracket 1007 may removably attach to top-of-door 192. In some embodiments, top-bracket 1007 may removably rest on top of top-of-door 192. When cabinet 1001 may be removably attached to door 190 via door-attachment-hardware 1003, top-bracket 1007 and top-of-door 192 may be substantially parallel with each other and at least partially in physical contact with each other. In some embodiments, top-bracket 1007 may be sized to cover a depth/thickness of door 190 at top-of-door 192. In some embodiments, top-bracket 1007 may continue to extend into a downward facing top-tab 1009, such that top-bracket 1007 and top-tab 1009 are orthogonal to each other. In some embodiments, top-tab 1009 may be separated from main-planar-member 1005 by a width of top-bracket 1007. In some embodiments, top-tab 1009 may be substantially parallel with main-planar-member 1005. In some embodiments, top-tab 1009 may minimize unintentional dissociation between top-bracket 1007 and top-of-door 192. In some embodiments, a portion of door 190 proximate to top-of-door 192 may fit inside a pocket formed from portions of main-planar-member 1005, top-bracket 1007, and top-tab 1009. Portions of main-planar-member 1005, top-bracket 1007, and top-tab 1009 may form a U-shaped bracket (in cross-section) configured to removably attach to top-of-door 192. See e.g., FIG. 10A through and including FIG. 10G, and FIG. 15A through and including FIG. 15C.

In some embodiments, door attachment hardware 103 may comprises a main member 1005 (main-planar-member 1005) that may be substantially planar. Herein, the "main member" and "main-planar-member 1005" may be used interchangeably. In some embodiments, door attachment hardware 1003 may comprise top-bracket 1007 that may extend from a top portion of the main member 1005. In some embodiments, top-bracket 1007 may be configured to removably physically engage a top edge of door 190 (top-of-door 192), wherein top-bracket 1007 may be substantially orthogonal with the main member 1005. Herein, the "top edge of the door" and "top-of-door 192" may be used interchangeably.

In some embodiments, top-bracket 1007 may be substantially similar to top-bracket 605, in terms of structure and/or in terms of function/purpose.

In some embodiments, a side of main-planar-member 1005 may extend into a first-side-bracket 1011, wherein main-planar-member 1005 and first-side-bracket 1011 are substantially orthogonal to each other. In some embodiments, first-side-bracket 1011 may removably attach to hinge-side 193 of door 190. When cabinet 1001 may be removably attached to door 190 via door-attachment-hardware 1003, first-side-bracket 1011 and hinge-side 193 may be substantially parallel with each other and at least partially in physical contact with each other. In some embodiments, first-side-bracket 1011 may be sized to cover a depth/thickness of door 190 at hinge-side 193. In some embodiments, first-side-bracket 1011 may continue to extend into a first-side-tab 1013, such that first-side-bracket 1011 and first-side-tab 1013 are orthogonal to each other. In some embodiments, first-side-tab 1013 may be separated from main-planar-member 1005 by a width of first-side-bracket 1011. In some embodiments, first-side-tab 1013 may be substantially parallel with main-planar-member 1005. In some embodiments, first-side-tab 1013 may minimize unintentional dissociation between first-side-bracket 1011 and hinge-side 193. In some embodiments, a portion of door 190 proximate to hinge-side 193 may fit inside a pocket formed from portions of main-planar-member 1005, first-side-bracket 1011, and first-side-tab 1013. Portions of main-planar-member 1005, first-side-bracket 1011, and first-side-tab 1013 may form a U-shaped bracket (in cross-section) configured to removably attach to hinge-side 193. See e.g., FIG. 10A through and including FIG. 10F, and FIG. 15A through and including FIG. 15C.

In some embodiments, first-side-bracket 1011 may be substantially similar to side-bracket 607, in terms of structure and/or in terms of function/purpose.

In some embodiments, a side of main-planar-member 1005 may extend into a second-side-bracket 1015, wherein main-planar-member 1005 and second-side-bracket 1015 are substantially orthogonal to each other. In some embodiments, second-side-bracket 1015 may removably attach to hinge-side 193 of door 190. When cabinet 1001 may be removably attached to door 190 via door-attachment-hardware 1003, second-side-bracket 1015 and hinge-side 193 may be substantially parallel with each other and at least partially in physical contact with each other. In some embodiments, second-side-bracket 1015 may be sized to cover a depth/thickness of door 190 at hinge-side 193. In some embodiments, second-side-bracket 1015 may continue to extend into a second-side-tab 1017, such that second-side-bracket 1015 and second-side-tab 1017 are orthogonal to each other. In some embodiments, second-side-tab 1017 may be separated from main-planar-member 1005 by a width of second-side-bracket 1015. In some embodiments, second-side-tab 1017 may be substantially parallel with main-planar-member 1005. In some embodiments, second-side-tab 1017 may minimize unintentional dissociation between second-side-bracket 1015 and hinge-side 193. In some embodiments, a portion of door 190 proximate to hinge-side 193 may fit inside a pocket formed from portions of main-planar-member 1005, second-side-bracket 1015, and second-side-tab 1017. Portions of main-planar-member 1005, second-side-bracket 1015, and second-side-tab 1017 may form a U-shaped bracket (in cross-section) configured to removably attach to hinge-side 193. See e.g., FIG. 10A through and including FIG. 10F, and FIG. 15A through and including FIG. 15C.

In some embodiments, second-side-bracket 1015 may be substantially similar to side-bracket 607, in terms of structure and/or in terms of function/purpose.

In some embodiments, door-attachment-hardware 1003 may comprise two side brackets, first-side-bracket 1011 and second-side-bracket 1015. In some embodiments, along a length of main-planar-member 1005, first-side-bracket 1011 and second-side-bracket 1015 may be spaced apart by a fixed and predetermined distance. In some embodiments, this fixed and predetermined distance may be intended to accommodate one or more hinges along hinge-side 193 of door 190. See e.g., FIG. 10B and FIG. 10C.

In some embodiments, door attachment hardware 1003 may comprise side-bracket 1011 that may extend from a side of the main member 1005. Herein, the "side bracket" and "first-side-bracket 1011" may be used interchangeably. In some embodiments, side-bracket 1011 may be substantially orthogonal with the main member. In some embodiments, side-bracket 1011 may be substantially orthogonal with the top bracket. In some embodiments, side-bracket 1011 may be configured to removably physically engage hinge-side 193. In some embodiments, hinge-side 193 may be orthogonal to top-of-door 192.

In some embodiments, door attachment hardware 1003 may further comprise an additional side-bracket 1015 that may extend from the side of the main member 1005. Herein, the "additional side bracket" and "second-side-bracket 1015" may be used interchangeably.

In some embodiments, the additional side-bracket 1015 may be located below side-bracket 1011. In some embodiments, the additional side-bracket 1015 may be spaced apart from side-bracket 1011 by a predetermined distance. In some embodiments, this predetermined distance may be sized to accommodate a length of an upper hinge on door 190. In some embodiments, there may be a gap between side-bracket 1011 and the additional side-bracket 1015. In some embodiments, this gap may be sized to accommodate a length of an upper hinge on door 190. See e.g., FIG. 15C. In some embodiments, the additional side-bracket 1015 may be substantially parallel with side-bracket 1011. In some embodiments, the additional side-bracket 1015 may be configured to removably physically engage hinge-side 193 in a different location than side-bracket 1011. See e.g., FIG. 15C.

In some embodiments, side-bracket(s) 1101/1015 may be located below top-bracket 1007. See e.g., FIG. 10C.

In some embodiments, main-planar-member 1005, top-bracket 1007, top-tab 1009, first-side-bracket 1011, first-side-tab 1013, second-side-bracket 1015, and/or second-side-tab 1017 may all be one part/component. In some embodiments, main-planar-member 1005, top-bracket 1007, top-tab 1009, first-side-bracket 1011, first-side-tab 1013, second-side-bracket 1015, and/or second-side-tab 1017 may all be one integral part/component.

In some embodiments, door-attachment-hardware 1003 may removably attach to two orthogonal sides of door 190, such as hinge-side 193 and top-of-door 192. In some embodiments, door-attachment-hardware 1003 may removably attach to an upper quadrant of door 190, closer to hinge-side 193 than to not-hinge-side 194; and closer to top-of-door 192 than to bottom-of-door 195. See e.g., figures FIG. 15A through and including FIG. 15C.

In some embodiments, medication-receiver 1000 may removably attach to an upper quadrant of door 190, closer to hinge-side 193 than to not-hinge-side 194; and closer to top-of-door 192 than to bottom-of-door 195. In some embodiments, medication-receiver 1000 may removably attach to an upper portion of door 190, closer to hinge-side 193 than to not-hinge-side 194; and closer to top-of-door 192 than to bottom-of-door 195. See e.g., figures FIG. 15A through and including FIG. 15C; and see FIG. 16B and FIG. 16C.

In some embodiments, door-attachment-hardware 1003 may removably attach to two orthogonal sides of door 190, such as not-hinge-side 194 and top-of-door 192.

In some embodiments, medication-receiver 100/1000 may be attached closer to hinge-side 193 than to not-hinge-side 194, wherein hinge-side 193 may be opposed from and parallel with not-hinge-side 194. Such placement of medication-receiver 100/1000 on door 190 may minimize medication-receiver 100/1000 interfering with normal/typical door 190 swing mechanics. Herein, the "hinge-side of the door" and "hinge-side 193" may be used interchangeably. Herein, the "not-hinge-side of the door" and "not-hinge-side 194" may be used interchangeably.

In some embodiments, medication-receiver 100/1000 may be attached closer to top-of-door 192 than to bottom-of-door 195, wherein bottom-of-door 195 may oppose and be parallel with top-of-door 192. In some embodiments, medication-receiver 100/1000 may be located on an upper half of door 190. See e.g., FIG. 15A through and including FIG. 15C, and FIG. 16B and FIG. 16C. This may facilitate ease of user access to drawer 201/1211. In some embodiments, medication-receiver 100/1000 may be located on an upper half of door 190 so that when drawer 201/1211 may be open, drawer 201/1211 may be located at about chest to face mean/average height of a standing adult human. Herein, the "bottom edge of the door" and "bottom-of-door 195" may be used interchangeably.

In some embodiments, portions of door-attachment-hardware 1003 and/or of mounting-plate 1601 that are intended to physically contact portions of door 190, may have protective padding in order to protect door 190 from undesired scratches. In some embodiments, this protective padding may be in the form of foam, rubber, silicone, a soft plastic, an elastomer, combinations thereof, and/or the like.

Figure 18A:
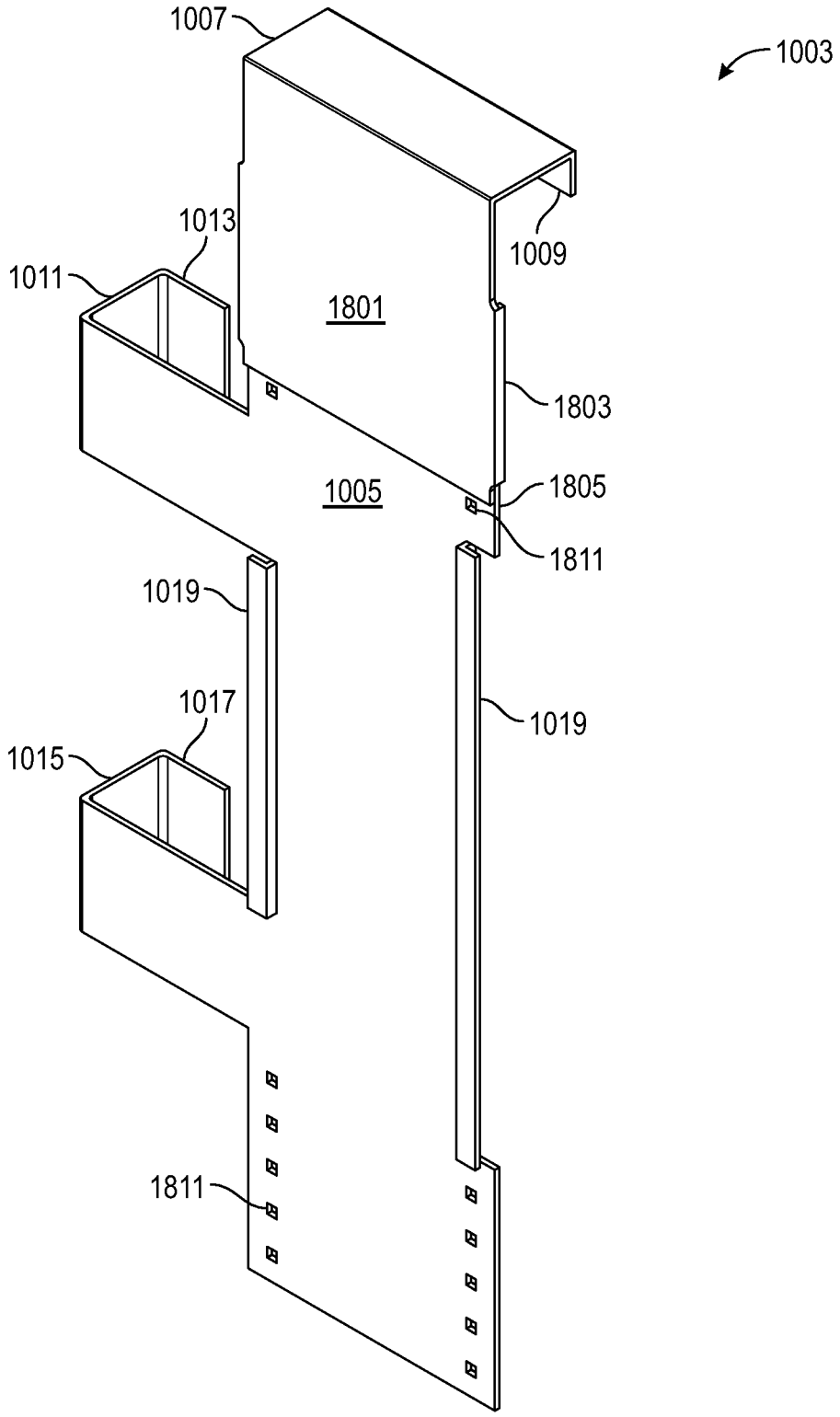
FIG. 18A may depict a perspective view of door-attachment-hardware.
Figure 18B:
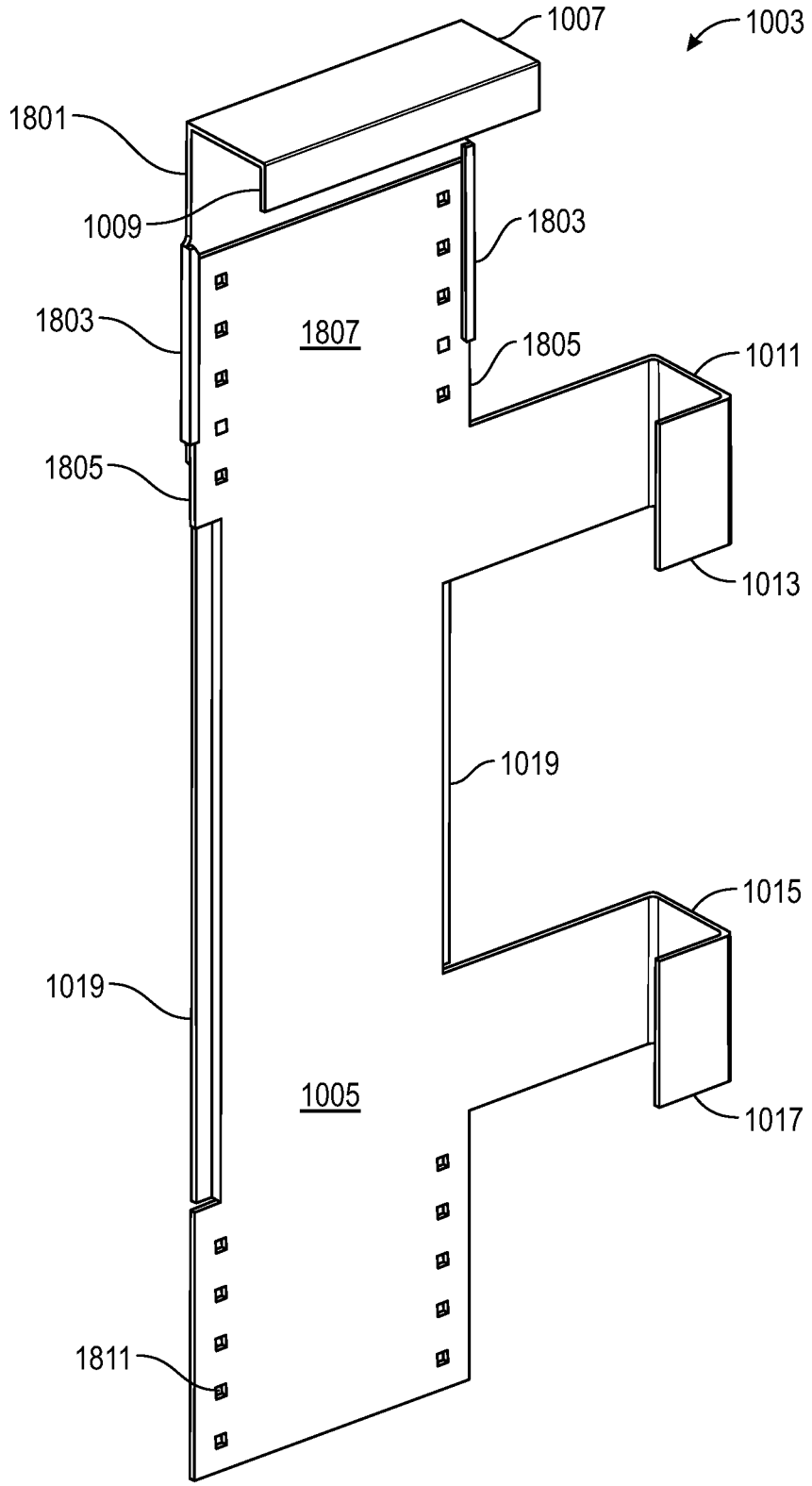
FIG. 18B may depict a different perspective view of the door-attachment-hardware of FIG. 18A.

In some embodiments, top-bracket 1007 may be slidingly attached to main-planar-member 1005. This may allow an ability to set a desired height of medication-receiver 1000 on door 190. This may facilitate removable attachment of door-attachment-hardware 1003 to door 109. See e.g., FIG. 18 and FIG. 18B.

In some embodiments, top-of-planar-member 1807 may an upper/top portion of main-planar-member 1005. In some embodiments, bottom-of-top-bracket 1801 may be attached to and orthogonal to top-bracket 1007, parallel with top-tab 1009, but spaced apart from top-tab 1009 by a width of top-bracket 1007. In cross-section, bottom-of-top-bracket 1801, top-bracket 1007, and top-tab 1009 may be substantially U-shaped or substantially L-shaped. See e.g., FIG. 18 and FIG. 18B.

In some embodiments, a top-of-planar-member 1807 may be attached to a bottom-of-top-bracket 1801. In some embodiments, a top-of-planar-member 1807 may be removably attached to a bottom-of-top-bracket 1801. In some embodiments, a top-of-planar-member 1807 may be slidingly attached to a bottom-of-top-bracket 1801. In some embodiments, bottom-of-top-bracket 1801 may comprise an opposing pair of slots-for-rails 1803 for removably receiving a pair of opposing rails 1805 of top-of-planar-member 1807. In some embodiments, slots-for-rails 1803 may be located on opposing sides of bottom-of-top-bracket 1801. In some embodiments, rails 1805 may be located on opposing sides of top-of-planar-member 1807. See e.g., FIG. 18 and FIG. 18B.

In some embodiments, main-planar-member 1005 and/or top-of-planar-member 1807 may comprise at least one through hole 1811. In some embodiments, main-planar-member 1005 and/or top-of-planar-member 1807 may comprise a plurality of through holes 1811. In some embodiments, main-planar-member 1005 and/or top-of-planar-member 1807 may comprise at least one linear series of a plurality of through holes 1811. See e.g., FIG. 18 and FIG. 18B.

In some embodiments, first-side-bracket 1011 may be slidingly attached to main-planar-member 1005. This may allow an ability to set a desired lateral position of medication-receiver 1000 on door 190. This may allow a single door-attachment-hardware 1003 to be used with either a door 190 with hinges on a left side or a door 190 with hinges on a right side, by sliding first-side-bracket 1011 out from main-planar-member 1005 and slidingly inserted on the other opposing side.

In some embodiments, second-side-bracket 1015 may be slidingly attached to main-planar-member 1005. This may allow an ability to set a desired lateral position of medication-receiver 1000 on door 190. This may allow a single door-attachment-hardware 1003 to be used with either a door 190 with hinges on a left side or a door 190 with hinges on a right side, by sliding second-side-bracket 1015 out from main-planar-member 1005 and slidingly inserted on the other opposing side.

Figure 16A:
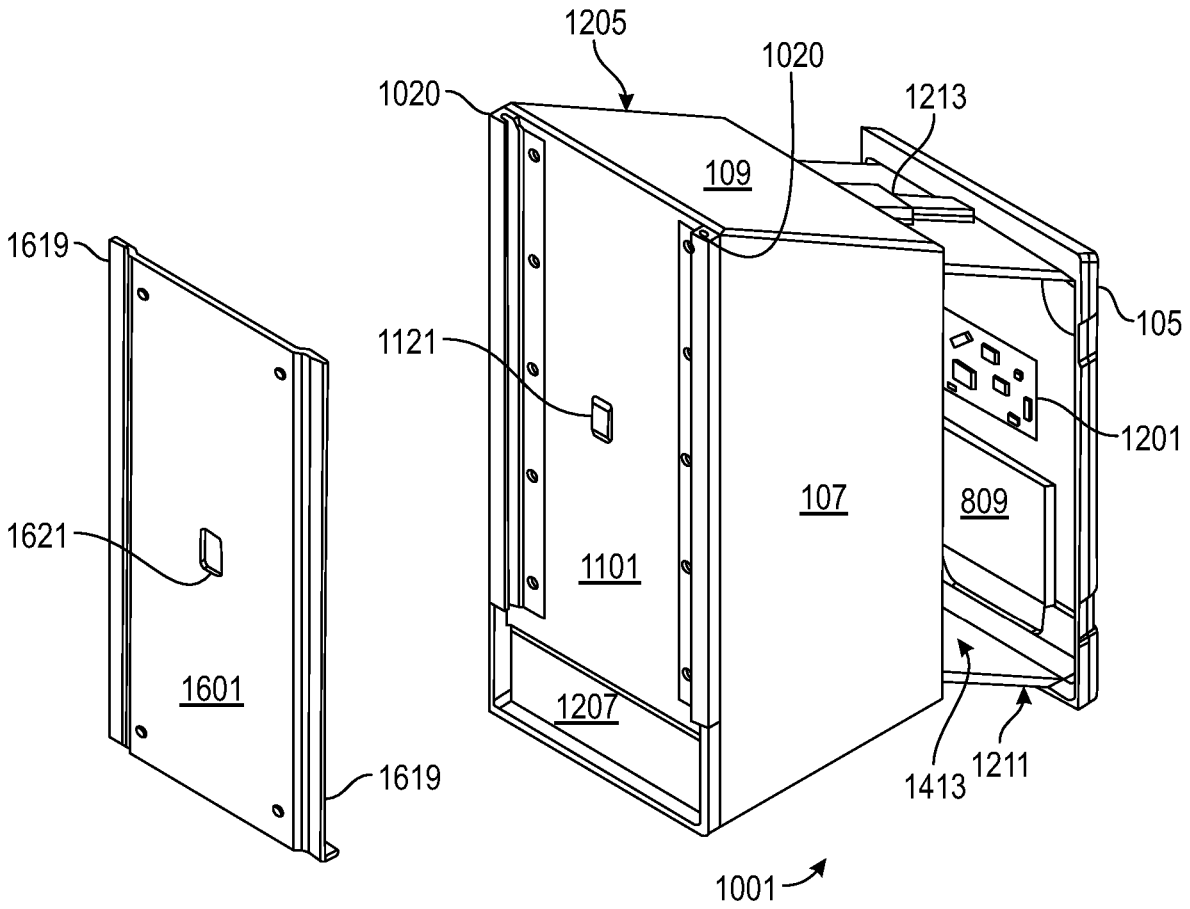
FIG. 16A may a partial rear perspective exploded view, showing a mounting-plate exploded away from a rear of a cabinet.
Figure 16B:
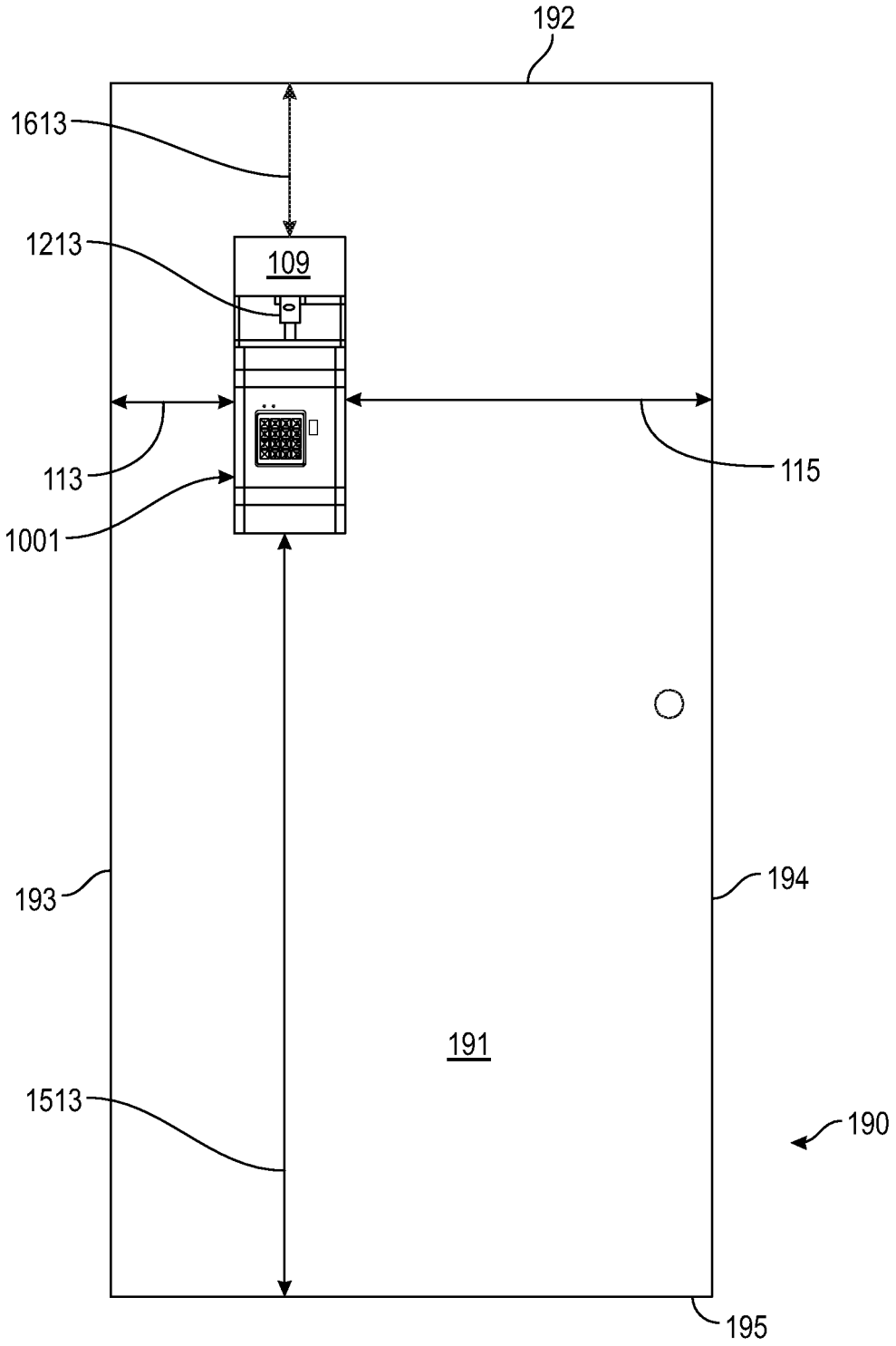
FIG. 16B may depict the medication-receiver of FIG. 16A, shown with its drawer-member open (out) and shown while the medication-receiver is removably attached to a front of a door using the mounting-plate, all shown from a front view.
Figure 16C:
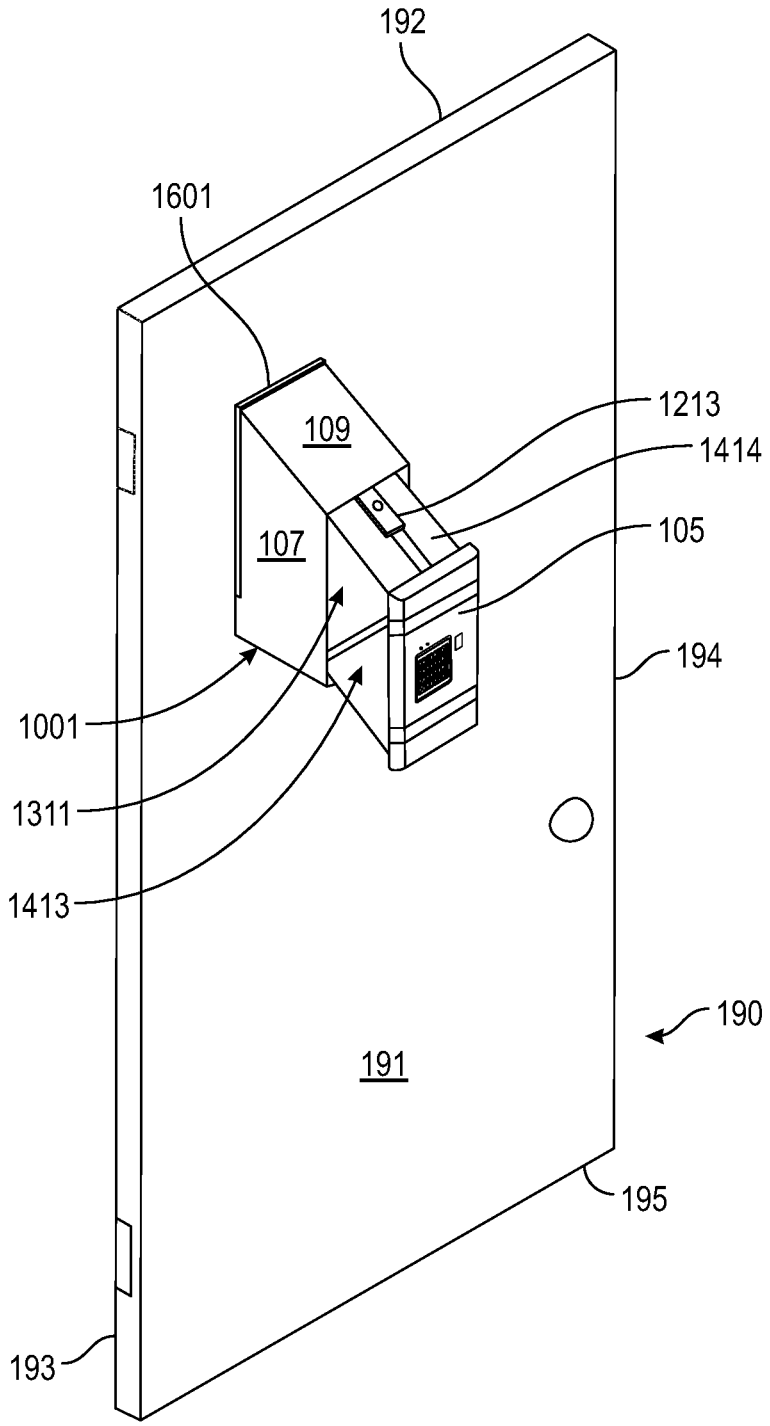
FIG. 16C may be the same scenario as in FIG. 16B (drawer open), but shown from a front perspective view.

FIG. 16A may a partial rear perspective exploded view, showing mounting-plate 1601 exploded away from a rear of cabinet 1001. FIG. 16B may depict the medication-receiver 1000 of FIG. 16A, shown with its drawer-member 1211 open (out) and shown while medication-receiver 1000 is removably attached to a front (exterior-door-surface 191) of door 190 using mounting-plate 1601 instead of door-attachment-hardware 1003, all shown from a front view. FIG. 16C may be the same scenario as in FIG. 16B (drawer open), but shown from a front perspective view. In some embodiments, in FIG. 16B and/or in FIG. 16C door 190 may be a wall and/or a fence.

In some embodiments, medication-receiver 1000 may comprise cabinet 1001 and mounting-plate 1601. In some embodiments, mounting-plate 1601 may be used instead of door-attachment-hardware 1003. In some embodiments, mounting-plate 1601 may be attached to rear-wall 1101 of cabinet 1001 in a same and/or substantially similar fashion as door-attachment-hardware 1003 may be removably attached to rear-wall 1101. In some embodiments, mounting-plate 1601 may be: substantially a rectangular prism member; with at least one mounting hole for receiving at least one screw, nail, and/or bolt; substantially planar; mostly planar; substantially flat; mostly flat; substantially rigid; rigid; a structural member; a load bearing member; substantially made of metal; substantially made of carbon fiber; substantially made of plastic; substantially made of plastic with filler(s) (such as, but not limited to, glass fillers, carbon fiber fillers, combinations thereof, and/or the like); combinations thereof, and/or the like. See e.g., figures FIG. 16A through and including FIG. 16C.

In some embodiments, mounting-plate 1601 may be longer than wide. In some embodiments, running along opposing sides of mounting-plate 1601 and in parallel with a length of mounting-plate 1601 may be a pair of rails mounting-plate 1601. In some embodiments, rails 1619 may function and may be substantially similar structurally as rails 1019. In some embodiments, rails 1619 may be removably and slidingly received/captured within slots-for-rails 1020 of rear-wall 1101 of cabinet 1001. See e.g., figures FIG. 16A through and including FIG. 16C.

In some embodiments, rails 1619 and slots-for-rails 1020 may have their locations switched. That is, in some embodiments, rails 1619 may be located on rear-wall 1101 where slots-for-rails 1020 might have been; and slots-for-rails 1020 may be located on mounting-plate 1601 where rails 1619 might have been.

In practice, mounting-plate 1601 may be attached to exterior-of-door 191 of door 190 before mounting-plate 1601 may be removably attached to rear-wall 1101 of cabinet 1001. In some embodiments, via one or more mechanical fasteners, mounting-plate 1601 may be attached to exterior-of-door 191 of door 190. In some embodiments, such one or more mechanical fasteners may be selected from one or more of: screws, nails, bolts, Velcro (plurality of loops on one surface and plurality of complimentary hooks on an opposing surface to be mated with the other surface), combinations thereof, and/or the like. In some embodiments, mounting-plate 1601 may have one or more through holes for receiving one or more of: screws, nails, bolts, combinations thereof, and/or the like. In some embodiments, a side of mounting-plate 1601 that may be put into physical contact with exterior-of-door 191 may be attached to exterior-of-door 191 via Velcro, chemical adhesive, and/or the like. Once mounting-plate 1601 may be attached to exterior-of-door 191, then rails 1619 of mounting-plate 1601 may be removably attached to slots-for-rails 1020 of rear-wall 1101 of cabinet 1001. See e.g., figures FIG. 16A through and including FIG. 16C.

In some embodiments, sliding translation between rails 1619 and slots-for-rails 1020 may be stopped, locked, and/or fixed once rails 1619 have been sufficiently slid into slots-for-rails 1020. In some embodiments, this may be accomplished by either the tops or the bottoms of slots-for-rails 1020 being closed to act as stops. In some embodiments, this may be accomplished by either the tops or the bottoms of rails 1619 having tabs to act as stops. In some embodiments, this may be accomplished by mounting-plate 1601 having a stop 1621 (e.g., FIG. 16A) and rear-wall 1101 having a complimentary-stop 1121 (e.g., FIG. 11), such that when rails 1619 have been sufficiently slid into slots-for-rails 1020, stop 1621 engages with complimentary-stop 1121. In some embodiments, stop 1621 may be a hole; and complimentary-stop 1121 may be protrusion configured to fit at least partially within this hole of stop 1621. In some embodiments, stop 1621 may be located in about a middle region/portion of mounting-plate 1601. In some embodiments, complimentary-stop 1121 may be located in about a middle region/portion of rear-wall 1101. See e.g., figures FIG. 16A through and including FIG. 16C.

In some embodiments, when cabinet 1001 may be attached to door 190 using mounting-plate 1601, distance-from-door-top 1613 to cabinet 1001 may be less than distance-from-door-bottom to 1513 to cabinet 1001. In some embodiments, a ratio of distance-from-door-bottom to 1513 to distance-from-door-top 1613 may be from 6 to 3. See e.g., FIG. 15A, FIG. 15B, and FIG. 16B.

In some embodiments, a ratio of distance-from-not-hinge-side 115 to distance-from-hinge-side 113 may be from 9 to 2. See e.g., FIG. 15A, FIG. 15B, and FIG. 16B.

In some embodiments, door-attachment-hardware 103/1003/1601, front-of-drawer 105, sides-of-cabinet 107, top-of-cabinet 109, drawer 201, top-of-drawer 203, interior-side-wall 205, bottom-of-drawer 207, exterior-side-wall 209, J-hook-region 501, back-side 503, back-side-of-cabinet 507, door-attachment-hardware 603, top-bracket 605, side-bracket 607, back-side 703, lower-side-bracket 707, side-bracket-guide 709, main-planar-member 1005, top-bracket 1007, top-tab 1009, first-side-bracket 1011, first-side-tab 1013, second-side-bracket 1015, second-side-tab 1017, rail 1019, slot-for-rail 1020, stop 1021, rear-wall 1101, reinforcement-member 1103, complimentary-stop 1121, housing 1205, lower-compartment 1207, drawer-member 1211, drawer-rear-wall 1311, drawer-side-wall 1411, drawer-floor 1413, drawer-roof 1414, drawer-inside-front 1415, mounting-plate 1601, rail 1619, stop 1621, bottom-of-top-bracket 1801, slot-for-rail 1803, rail 1805, and/or top-of-planar-member 1807 may be substantially constructed from one or more types of metals, sheet metals, thermoplastics (with or without fillers), wood, laminates, combinations thereof, and/or the like. In some embodiments, at least some portions of such sheet metals may be covered and/or coated, e.g., via powder coating, to protect the sheet metal from environmental conditions, abrasions, and/or scratches.

Note with respect to the materials of construction, it is not desired nor intended to thereby unnecessarily limit the present invention by reason of such disclosure.

Various medication-receivers have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A medication receiver for removably receiving at least one article for temporary housing of the at least one article, wherein the medication receiver is configured for attachment to a door with hinges, wherein the medication receiver comprises:

a cabinet comprised of a locking means, a housing, and a drawer with an interior of the drawer that is configured for removably receiving the at least one article;

wherein the cabinet exists in two operational configurations a locked configuration and an unlocked configuration; wherein when the cabinet is in the locked configuration, the housing of the cabinet and a front of the drawer substantially encloses the interior of the drawer with the locking means maintaining the locked configuration;

wherein when the cabinet is in the unlocked configuration, at least a portion of the drawer slidingly extends out from the housing of the cabinet providing access to at least a portion of the interior of the drawer; and door attachment hardware, wherein the door attachment hardware comprises a main member that is substantially planar, wherein the door attachment hardware comprises a top bracket that extends from a top portion of the main member, wherein the top bracket is configured to removably physically engage a top edge of the door with the hinges, wherein the top bracket is substantially orthogonal with the main member; wherein the door attachment hardware further comprises a side bracket that extends from a side of the main member, wherein the side bracket is substantially orthogonal with the main member, wherein the side bracket is substantially orthogonal with the top bracket, wherein the side bracket is configured to removably physically engage a hinge-side of the door with the hinges, wherein the hinge-side of the door is orthogonal to the top edge of the door; wherein at least a portion of the door attachment hardware is attached to a rear of the housing.

2. The medication receiver according to claim 1, wherein the rear of the housing comprises a pair of opposing slots; wherein the at least the portion of the door attachment hardware comprises a pair of opposing rails; wherein the pair of opposing slots removably receives the pair of opposing rails such that the at least the portion of the door attachment hardware is slidingly attached to the rear of the housing.

3. The medication receiver according to claim 2, wherein the sliding attachment between the rear of the housing and the at least the portion of the door attachment hardware is stopped by a stop located on the door attachment hardware that physically engages a complimentary-stop located on the rear of the housing.

4. The medication receiver according to claim 1, wherein the door attachment hardware further comprises an additional side bracket that extends from the side of the main member, wherein the additional side bracket is located below the side bracket and is spaced apart from the side bracket by a predetermined distance, wherein the additional side bracket is substantially parallel with the side bracket, wherein the additional side bracket is configured to removably physically engage the hinge-side of the door with the hinges in a different location than the side bracket.

5. The medication receiver according to claim 1, wherein the medication-receiver is attached closer to the hinge-side of the door with the hinges than a not-hinge-side of the door with the hinges, wherein the not-hinge-side of the door with the hinges is opposed from and parallel with the hinge-side of the door with the hinges.

6. The medication receiver according to claim 1, wherein the medication-receiver is attached closer to the top edge of the door with the hinges than to a bottom edge of the door with the hinges, wherein the bottom edge of the door with the hinges opposes and is parallel with the top edge of the door with the hinges.

7. The medication receiver according to claim 1, wherein the drawer is slidingly attached to the housing of the cabinet by at least one rail subassembly, wherein the at least one rail subassembly is in physical contact with both the drawer and the housing.

8. The medication receiver according to claim 7, wherein when the cabinet is in the unlocked configuration, the at least one rail subassembly provides cantilever structural support to the drawer that is extended from the housing.

9. The medication receiver according to claim 1, wherein the medication receiver comprises at least one external camera, at least one light emitting diode, at least one input interface, at least one antenna, at least one power source, and at least one processor; wherein the at least one external camera, the at least one light emitting diode, the at least one input interface, the at least one antenna, and the at least one power source are all operatively connected to the at least one processor.

10. The medication receiver according to claim 1, wherein the cabinet comprises a lower compartment, wherein the lower compartment is located substantially within the housing, wherein the lower compartment is further located at a lower rear portion of the housing, wherein when the cabinet is in the locked configuration the lower compartment is located substantially beneath the drawer.

11. The medication receiver according to claim 10, wherein substantially within the lower compartment is at least one electronic hardware component.

12. A medication receiver for removably receiving at least one article for temporary housing of the at least one article, wherein the medication receiver is configured for attachment to a door with hinges, wherein the medication receiver comprises:

a cabinet comprised of a locking means, a housing, at least one rail subassembly, and a drawer with an interior of the drawer that is configured for removably receiving the at least one article;

wherein the drawer is slidingly attached to the housing of the cabinet by the at least one rail subassembly, wherein the at least one rail subassembly is in physical contact with both the drawer and the housing;

wherein the at least one rail subassembly is located beneath a floor of the drawer and above a bottom of the housing;

wherein the cabinet exists in two operational configurations a locked configuration and an unlocked configuration; wherein when the cabinet is in the locked configuration, the housing of the cabinet and a front of the drawer substantially encloses the interior of the drawer with the locking means maintaining the locked configuration;

wherein when the cabinet is in the unlocked configuration, at least a portion of the drawer slidingly extends out from the housing of the cabinet, via the at least one rail subassembly, providing access to at least a portion of the interior of the drawer; and door attachment hardware, wherein at least a portion of the door attachment hardware is attached to a rear of the housing, wherein at least another portion of the door attachment hardware is attached to the door with the hinges.

13. The medication receiver according to claim 12, wherein the rear of the housing comprises a pair of opposing slots; wherein the at least the portion of the door attachment hardware comprises a pair of opposing rails; wherein the pair of opposing slots removably receives the pair of opposing rails such that the at least the portion of the door attachment hardware is slidingly attached to the rear of the housing.

14. The medication receiver according to claim 13, wherein the sliding attachment between the rear of the housing and the at least the portion of the door attachment hardware is stopped by a stop located on the door attachment hardware that physically engages a complimentary-stop located on the rear of the housing.

15. The medication receiver according to claim 12, wherein the medication-receiver is attached closer to a hinge-side of the door with the hinges than a not-hinge-side of the door with the hinges, wherein the not-hinge-side of the door with the hinges is opposed from and parallel with the hinge-side of the door with the hinges.

16. The medication receiver according to claim 12, wherein the medication-receiver is attached closer to a top edge of the door with the hinges than to a bottom edge of the door with the hinges, wherein the bottom edge of the door with the hinges opposes and is parallel with the top edge of the door with the hinges.

17. The medication receiver according to claim 12, wherein when the cabinet is in the unlocked configuration, the at least one rail subassembly provides cantilever structural support to the drawer that is extended from the housing.

18. The medication receiver according to claim 12, wherein the medication receiver comprises at least one external camera, at least one light emitting diode, at least one input interface, at least one antenna, at least one power source, and at least one processor; wherein the at least one external camera, the at least one light emitting diode, the at least one input interface, the at least one antenna, and the at least one power source are all operatively connected to the at least one processor.

19. The medication receiver according to claim 12, wherein the cabinet comprises a lower compartment, wherein the lower compartment is located substantially within the housing, wherein the lower compartment is further located at a lower rear portion of the housing, wherein when the cabinet is in the locked configuration the lower compartment is located substantially beneath the drawer.

20. The medication receiver according to claim 19, wherein substantially within the lower compartment is at least one electronic hardware component.

21. A medication receiver for removably receiving at least one article for temporary housing of the at least one article, wherein the medication receiver is configured for attachment to a door with hinges, wherein the medication receiver comprises:

a cabinet comprised of a locking means, a housing, at least one rail subassembly, and a drawer with an interior of the drawer that is configured for removably receiving the at least one article;

wherein the drawer is slidingly attached to the housing of the cabinet by the at least one rail subassembly, wherein the at least one rail subassembly is in physical contact with both the drawer and the housing;

wherein the at least one rail subassembly is located above a roof of the drawer and beneath a top of the housing; wherein the cabinet exists in two operational configurations a locked configuration and an unlocked configuration;

wherein when the cabinet is in the locked configuration, the housing of the cabinet and a front of the drawer substantially encloses the interior of the drawer with the locking means maintaining the locked configuration;

wherein when the cabinet is in the unlocked configuration, at least a portion of the drawer slidingly extends out from the housing of the cabinet, via the at least one rail subassembly, providing access to at least a portion of the interior of the drawer; and door attachment hardware, wherein at least a portion of the door attachment hardware is attached to a rear of the housing, wherein at least another portion of the door attachment hardware is attached to the door with the hinges.

22. The medication receiver according to claim 21, wherein the rear of the housing comprises a pair of opposing slots; wherein the at least the portion of the door attachment hardware comprises a pair of opposing rails; wherein the pair of opposing slots removably receives the pair of opposing rails such that the at least the portion of the door attachment hardware is slidingly attached to the rear of the housing.

23. The medication receiver according to claim 22, wherein the sliding attachment between the rear of the housing and the at least the portion of the door attachment hardware is stopped by a stop located on the door attachment hardware that physically engages a complimentary-stop located on the rear of the housing.

24. The medication receiver according to claim 21, wherein the medication-receiver is attached closer to a hinge-side of the door with the hinges than a not-hinge-side of the door with the hinges, wherein the not-hinge-side of the door with the hinges is opposed from and parallel with the hinge-side of the door with the hinges.

25. The medication receiver according to claim 21, wherein the medication-receiver is attached closer to a top edge of the door with the hinges than to a bottom edge of the door with the hinges, wherein the bottom edge of the door with the hinges opposes and is parallel with the top edge of the door with the hinges.

26. The medication receiver according to claim 21, wherein when the cabinet is in the unlocked configuration, the at least one rail subassembly provides cantilever structural support to the drawer that is extended from the housing.

27. The medication receiver according to claim 21, wherein the medication receiver comprises at least one external camera, at least one light emitting diode, at least one input interface, at least one antenna, at least one power source, and at least one processor; wherein the at least one external camera, the at least one light emitting diode, the at least one input interface, the at least one antenna, and the at least one power source are all operatively connected to the at least one processor.

28. The medication receiver according to claim 21, wherein the cabinet comprises a lower compartment, wherein the lower compartment is located substantially within the housing, wherein the lower compartment is further located at a lower rear portion of the housing, wherein when the cabinet is in the locked configuration the lower compartment is located substantially beneath the drawer.

29. The medication receiver according to claim 28, wherein substantially within the lower compartment is at least one electronic hardware component.

30. A medication receiver for removably receiving at least one article for temporary housing of the at least one article, wherein the medication receiver is configured for attachment to a door with hinges, wherein the medication receiver comprises:

a cabinet comprised of a locking means, a housing, at least one rail subassembly, and a drawer with an interior of the drawer that is configured for removably receiving the at least one article;

wherein the drawer is slidingly attached to the housing of the cabinet by the at least one rail subassembly, wherein the at least one rail subassembly is in physical contact with both the drawer and the housing;

wherein the at least one rail subassembly comprises an upper rail subassembly and a lower rail subassembly; wherein the lower rail subassembly is located beneath a floor of the drawer and above a bottom of the housing; and wherein the upper rail subassembly is located above a roof of the drawer and beneath a top of the housing;

wherein the cabinet exists in two operational configurations a locked configuration and an unlocked configuration; wherein when the cabinet is in the locked configuration, the housing of the cabinet and a front of the drawer substantially encloses the interior of the drawer with the locking means maintaining the locked configuration;

wherein when the cabinet is in the unlocked configuration, at least a portion of the drawer slidingly extends out from the housing of the cabinet, via the at least one rail subassembly, providing access to at least a portion of the interior of the drawer; and door attachment hardware, wherein at least a portion of the door attachment hardware is attached to a rear of the housing, wherein at least another portion of the door attachment hardware is attached to the door with the hinges.

31. The medication receiver according to claim 30, wherein the rear of the housing comprises a pair of opposing slots; wherein the at least the portion of the door attachment hardware comprises a pair of opposing rails; wherein the pair of opposing slots removably receives the pair of opposing rails such that the at least the portion of the door attachment hardware is slidingly attached to the rear of the housing.

32. The medication receiver according to claim 31, wherein the sliding attachment between the rear of the housing and the at least the portion of the door attachment hardware is stopped by a stop located on the door attachment hardware that physically engages a complimentary-stop located on the rear of the housing.

33. The medication receiver according to claim 30, wherein the medication-receiver is attached closer to a hinge-side of the door with the hinges than a not-hinge-side of the door with the hinges, wherein the not-hinge-side of the door with the hinges is opposed from and parallel with the hinge-side of the door with the hinges.

34. The medication receiver according to claim 30, wherein the medication-receiver is attached closer to a top edge of the door with the hinges than to a bottom edge of the door with the hinges, wherein the bottom edge of the door with the hinges opposes and is parallel with the top edge of the door with the hinges.

35. The medication receiver according to claim 30, wherein when the cabinet is in the unlocked configuration, the at least one rail subassembly provides cantilever structural support to the drawer that is extended from the housing.

36. The medication receiver according to claim 30, wherein the medication receiver comprises at least one external camera, at least one light emitting diode, at least one input interface, at least one antenna, at least one power source, and at least one processor; wherein the at least one external camera, the at least one light emitting diode, the at least one input interface, the at least one antenna, and the at least one power source are all operatively connected to the at least one processor.

37. The medication receiver according to claim 30, wherein the cabinet comprises a lower compartment, wherein the lower compartment is located substantially within the housing, wherein the lower compartment is further located at a lower rear portion of the housing, wherein when the cabinet is in the locked configuration the lower compartment is located substantially beneath the drawer.

38. The medication receiver according to claim 37, wherein substantially within the lower compartment is at least one electronic hardware component.

39. A medication receiver for removably receiving at least one article for temporary housing of the at least one article, wherein the medication receiver is configured for attachment to a door with hinges, wherein the medication receiver comprises:

a cabinet comprised of a locking means, a housing, at least one rail subassembly, and a drawer with an interior of the drawer that is configured for removably receiving the at least one article; wherein the cabinet exists in two operational configurations a locked configuration and an unlocked configuration; wherein when the cabinet is in the locked configuration, the housing of the cabinet and a front of the drawer substantially encloses the interior of the drawer with the locking means maintaining the locked configuration; wherein when the cabinet is in the unlocked configuration, at least a portion of the drawer slidingly extends out from the housing of the cabinet providing access to at least a portion of the interior of the drawer; wherein the at least one rail subassembly is configured to facilitate sliding mechanics between the housing and the drawer is such that transitions between the locked configuration and the unlocked configuration move back and forth in a single linear line, wherein this single linear line is at an angle from a major plane of the rear of the housing to at least one rail subassembly of the cabinet, wherein this angle is less than ninety degrees and greater than zero degrees, such that the drawer opens downwards with respect to the housing; and door attachment hardware, wherein at least a portion of the door attachment hardware is attached to the rear of the housing, wherein at least another portion of the door attachment hardware is attached to the door.

40. The medication receiver according to claim 39, wherein the rear of the housing comprises a pair of opposing slots; wherein the at least the portion of the door attachment hardware comprises a pair of opposing rails; wherein the pair of opposing slots removably receives the pair of opposing rails such that the at least the portion of the door attachment hardware is slidingly attached to the rear of the housing.

41. The medication receiver according to claim 40, wherein the sliding attachment between the rear of the housing and the at least the portion of the door attachment hardware is stopped by a stop located on the door attachment hardware that physically engages a complimentary-stop located on the rear of the housing.

42. The medication receiver according to claim 39, wherein the medication-receiver is attached closer to a hinge-side of the door with the hinges than a not-hinge-side of the door with the hinges, wherein the not-hinge-side of the door with the hinges is opposed from and parallel with the hinge-side of the door with the hinges.

43. The medication receiver according to claim 39, wherein the medication-receiver is attached closer to a top edge of the door with the hinges than to a bottom edge of the door with the hinges, wherein the bottom edge of the door with the hinges opposes and is parallel with the top edge of the door with the hinges.

44. The medication receiver according to claim 39, wherein when the cabinet is in the unlocked configuration, the at least one rail subassembly provides cantilever structural support to the drawer that is extended from the housing.

45. The medication receiver according to claim 39, wherein the medication receiver comprises at least one external camera, at least one light emitting diode, at least one input interface, at least one antenna, at least one power source, and at least one processor; wherein the at least one external camera, the at least one light emitting diode, the at least one input interface, the at least one antenna, and the at least one power source are all operatively connected to the at least one processor.

46. The medication receiver according to claim 39, wherein the cabinet comprises a lower compartment, wherein the lower compartment is located substantially within the housing, wherein the lower compartment is further located at a lower rear portion of the housing, wherein when the cabinet is in the locked configuration the lower compartment is located substantially beneath the drawer.

47. The medication receiver according to claim 46, wherein substantially within the lower compartment is at least one electronic hardware component.

48. A medication receiver for removably receiving at least one article for temporary housing of the at least one article, wherein the medication receiver is configured for attachment to a door with hinges, wherein the medication receiver comprises:

a cabinet comprised of a locking means, a housing, and a drawer with an interior of the drawer that is configured for removably receiving the at least one article;

wherein the cabinet exists in two operational configurations a locked configuration and an unlocked configuration;

wherein when the cabinet is in the locked configuration, the housing of the cabinet and a front of the drawer substantially encloses the interior of the drawer with the locking means maintaining the locked configuration;

wherein when the cabinet is in the unlocked configuration, at least a portion of the drawer slidingly extends out from the housing of the cabinet providing access to at least a portion of the interior of the drawer;

wherein the locking means comprises a lock assembly and a lock receiver, wherein the lock assembly is located in an upper rear portion of the drawer, wherein the lock receiver is located in an upper rear portion of the housing, wherein at least a portion the lock assembly is configured to removably physically engage at least a portion of the lock receiver during the locked configuration to lock the drawer to the housing; and door attachment hardware, wherein at least a portion of the door attachment hardware is attached to a rear of the housing, wherein at least another portion of the door attachment hardware is attached to the door.

49. The medication receiver according to claim 48, wherein the rear of the housing comprises a pair of opposing slots; wherein the at least the portion of the door attachment hardware comprises a pair of opposing rails; wherein the pair of opposing slots removably receives the pair of opposing rails such that the at least the portion of the door attachment hardware is slidingly attached to the rear of the housing.

50. The medication receiver according to claim 49, wherein the sliding attachment between the rear of the housing and the at least the portion of the door attachment hardware is stopped by a stop located on the door attachment hardware that physically engages a complimentary-stop located on the rear of the housing.

51. The medication receiver according to claim 48, wherein the medication-receiver is attached closer to a hinge-side of the door with the hinges than a not-hinge-side of the door with the hinges, wherein the not-hinge-side of the door with the hinges is opposed from and parallel with the hinge-side of the door with the hinges.

52. The medication receiver according to claim 48, wherein the medication-receiver is attached closer to a top edge of the door with the hinges than to a bottom edge of the door with the hinges, wherein the bottom edge of the door with the hinges opposes and is parallel with the top edge of the door with the hinges.

53. The medication receiver according to claim 48, wherein the cabinet comprises at least one rail subassembly, wherein the drawer is slidingly attached to the housing of the cabinet by the at least one rail subassembly, wherein the at least one rail subassembly is in physical contact with both the drawer and the housing; wherein when the cabinet is in the unlocked configuration, the at least one rail subassembly provides cantilever structural support to the drawer that is extended from the housing.

54. The medication receiver according to claim 48, wherein the medication receiver comprises at least one external camera, at least one light emitting diode, at least one input interface, at least one antenna, at least one power source, and at least one processor; wherein the at least one external camera, the at least one light emitting diode, the at least one input interface, the at least one antenna, and the at least one power source are all operatively connected to the at least one processor.

55. The medication receiver according to claim 48, wherein the cabinet comprises a lower compartment, wherein the lower compartment is located substantially within the housing, wherein the lower compartment is further located at a lower rear portion of the housing, wherein when the cabinet is in the locked configuration the lower compartment is located substantially beneath the drawer.

56. The medication receiver according to claim 55, wherein substantially within the lower compartment is at least one electronic hardware component.

57. A medication receiver for removably receiving at least one article for temporary housing of the at least one article, wherein the medication receiver is configured for attachment to a door with hinges, wherein the medication receiver comprises:

a cabinet comprised of a locking means, a housing, and a drawer with an interior of the drawer that is configured for removably receiving the at least one article;

wherein the cabinet exists in two operational configurations a locked configuration and an unlocked configuration;

wherein when the cabinet is in the locked configuration, the housing of the cabinet and a front of the drawer substantially encloses the interior of the drawer with the locking means maintaining the locked configuration;

wherein when the cabinet is in the unlocked configuration, at least a portion of the drawer slidingly extends out from the housing of the cabinet providing access to at least a portion of the interior of the drawer;

at least one interior camera and at least one external camera; wherein the at least one interior camera is directed to view the interior of the drawer and is attached to the drawer; wherein the at least one external camera is attached to the front of the drawer and directed to capturing images that are external and in front of the medication receiver within a predetermined field of range; and door attachment hardware, wherein at least a portion of the door attachment hardware is attached to a rear of the housing, wherein at least another portion of the door attachment hardware is attached to the door.

58. The medication receiver according to claim 57, wherein the rear of the housing comprises a pair of opposing slots; wherein the at least the portion of the door attachment hardware comprises a pair of opposing rails; wherein the pair of opposing slots removably receives the pair of opposing rails such that the at least the portion of the door attachment hardware is slidingly attached to the rear of the housing.

59. The medication receiver according to claim 58, wherein the sliding attachment between the rear of the housing and the at least the portion of the door attachment hardware is stopped by a stop located on the door attachment hardware that physically engages a complimentary-stop located on the rear of the housing.

60. The medication receiver according to claim 57, wherein the medication-receiver is attached closer to a hinge-side of the door with the hinges than a not-hinge-side of the door with the hinges, wherein the not-hinge-side of the door with the hinges is opposed from and parallel with the hinge-side of the door with the hinges.

61. The medication receiver according to claim 57, wherein the medication-receiver is attached closer to a top edge of the door with the hinges than to a bottom edge of the door with the hinges, wherein the bottom edge of the door with the hinges opposes and is parallel with the top edge of the door with the hinges.

62. The medication receiver according to claim 57, wherein the cabinet comprises at least one rail subassembly, wherein the drawer is slidingly attached to the housing of the cabinet by the at least one rail subassembly, wherein the at least one rail subassembly is in physical contact with both the drawer and the housing; wherein when the cabinet is in the unlocked configuration, the at least one rail subassembly provides cantilever structural support to the drawer that is extended from the housing.

63. The medication receiver according to claim 57, wherein the medication receiver further comprises at least one light emitting diode, at least one input interface, at least one antenna, at least one power source, and at least one processor; wherein the at least one external camera, the at least one light emitting diode, the at least one input interface, the at least one antenna, and the at least one power source are all operatively connected to the at least one processor.

64. The medication receiver according to claim 57, wherein the cabinet comprises a lower compartment, wherein the lower compartment is located substantially within the housing, wherein the lower compartment is further located at a lower rear portion of the housing, wherein when the cabinet is in the locked configuration the lower compartment is located substantially beneath the drawer.

65. The medication receiver according to claim 64, wherein substantially within the lower compartment is at least one electronic hardware component.

66. A medication receiver for removably receiving at least one article for temporary housing of the at least one article, wherein the medication receiver is configured for attachment to a door with hinges, wherein the medication receiver comprises:

a cabinet comprised of a locking means, a housing, and a drawer with an interior of the drawer that is configured for removably receiving the at least one article;

wherein the cabinet exists in two operational configurations a locked configuration and an unlocked configuration; wherein when the cabinet is in the locked configuration, the housing of the cabinet and a front of the drawer substantially encloses the interior of the drawer with the locking means maintaining the locked configuration;

wherein when the cabinet is in the unlocked configuration, at least a portion of the drawer slidingly extends out from the housing of the cabinet providing access to at least a portion of the interior of the drawer;

at least one external camera, at least one light emitting diode, at least one input interface, at least one antenna, at least one power source, and at least one processor; wherein the at least one external camera, the at least one light emitting diode, the at least one input interface, the at least one antenna, and the at least one power source are all operatively connected to the at least one processor; wherein the at least one external camera, the at least one light emitting diode, and the at least one input interface are all at least partially located on an exterior of the cabinet; wherein the at least one antenna, the at least one power source, and the at least one processor are located at least partially within the front of the drawer; and door attachment hardware, wherein at least a portion of the door attachment hardware is attached to a rear of the housing, wherein at least another portion of the door attachment hardware is attached to the door.

67. The medication receiver according to claim 66, wherein the rear of the housing comprises a pair of opposing slots; wherein the at least the portion of the door attachment hardware comprises a pair of opposing rails; wherein the pair of opposing slots removably receives the pair of opposing rails such that the at least the portion of the door attachment hardware is slidingly attached to the rear of the housing.

68. The medication receiver according to claim 67, wherein the sliding attachment between the rear of the housing and the at least the portion of the door attachment hardware is stopped by a stop located on the door attachment hardware that physically engages a complimentary-stop located on the rear of the housing.

69. The medication receiver according to claim 66, wherein the medication-receiver is attached closer to a hinge-side of the door with the hinges than a not-hinge-side of the door with the hinges, wherein the not-hinge-side of the door with the hinges is opposed from and parallel with the hinge-side of the door with the hinges.

70. The medication receiver according to claim 66, wherein the medication-receiver is attached closer to a top edge of the door with the hinges than to a bottom edge of the door with the hinges, wherein the bottom edge of the door with the hinges opposes and is parallel with the top edge of the door with the hinges.

71. The medication receiver according to claim 66, wherein the cabinet comprises at least one rail subassembly, wherein the drawer is slidingly attached to the housing of the cabinet by the at least one rail subassembly, wherein the at least one rail subassembly is in physical contact with both the drawer and the housing; wherein when the cabinet is in the unlocked configuration, the at least one rail subassembly provides cantilever structural support to the drawer that is extended from the housing.

72. The medication receiver according to claim 66, wherein the at least one external camera, the at least one light emitting diode, the at least one input interface, the at least one antenna, and the at least one power source are all operatively connected to the at least one processor.

73. The medication receiver according to claim 66, wherein the cabinet comprises a lower compartment, wherein the lower compartment is located substantially within the housing, wherein the lower compartment is further located at a lower rear portion of the housing, wherein when the cabinet is in the locked configuration the lower compartment is located substantially beneath the drawer.

74. The medication receiver according to claim 73, wherein substantially within the lower compartment is at least one electronic hardware component.

* * * * *